US007384731B2

(12) United States Patent
Hosokawa et al.

(10) Patent No.: US 7,384,731 B2
(45) Date of Patent: Jun. 10, 2008

(54) METHOD FOR FORMING COLOR IMAGE AND SILVER HALIDE COLOR PHOTOSENSITIVE MATERIAL USED FOR THE SAME

(75) Inventors: Junichiro Hosokawa, Ashigara (JP); Naoharu Kiyoto, Ashigara (JP); Yoshio Ishii, Ashigara (JP); Takanori Hioki, Ashigara (JP); Katsumi Kobayashi, Ashigara (JP); Takashi Hoshimiya, Ashigara (JP)

(73) Assignee: FUJIFILM Corporation, Tokyo (JP)

( * ) Notice: Subject to any disclaimer, the term of this patent is extended or adjusted under 35 U.S.C. 154(b) by 672 days.

(21) Appl. No.: 10/945,162

(22) Filed: Sep. 21, 2004

(65) Prior Publication Data

US 2005/0069822 A1 Mar. 31, 2005

(30) Foreign Application Priority Data

Sep. 22, 2003 (JP) ..... 2003-329946

(51) Int. Cl.

| | |
|---|---|
| ***G03C 1/46*** | (2006.01) |
| ***G03C 1/06*** | (2006.01) |
| ***G03C 5/18*** | (2006.01) |
| ***G03C 5/26*** | (2006.01) |

(52) U.S. Cl. ..... 430/502; 430/503; 430/504; 430/505; 430/506; 430/449; 430/464; 430/467; 430/470; 430/483; 430/486; 430/599; 430/600; 430/607; 430/613; 430/614; 430/615

(58) Field of Classification Search ..... 430/502–506, 430/449, 464, 467, 470, 483, 486, 599, 600, 430/607, 613–615

See application file for complete search history.

(56) References Cited

U.S. PATENT DOCUMENTS

| | | | |
|---|---|---|---|
| 6,197,488 | B1 | 3/2001 | Allway et al. |
| 6,316,177 | B1 | 11/2001 | Allway et al. |
| 6,319,660 | B1 | 11/2001 | Allway et al. |
| 6,426,180 | B1 | 7/2002 | Bringley et al. |
| 2003/0142289 | A1 | 7/2003 | Ortyn et al. |
| 2003/0175627 | A1 | 9/2003 | Hosokawa et al. |
| 2003/0198905 | A1 | 10/2003 | Hosokawa et al. |

FOREIGN PATENT DOCUMENTS

| | | |
|---|---|---|
| JP | 62-27740 | 2/1987 |

*Primary Examiner*—Geraldina Visconti
(74) *Attorney, Agent, or Firm*—Sughrue Mion, PLLC

(57) ABSTRACT

A method for forming color images comprising subjecting a silver halide color photosensitive material to a development processing in the presence of a compound (A) defined below, wherein the silver halide color photosensitive material having a blue-sensitive unit, a green-sensitive unit and a red-sensitive unit, each of which comprises at least one silver halide emulsion layer, and at least one non-light-sensitive layer on a support, compound (A): a heterocyclic compound having one or two hetero atoms, the heterocyclic compound being capable of increasing speed of the silver halide color photosensitive material by the presence thereof in comparison to the case where the heterocyclic compound is absent.

8 Claims, No Drawings

METHOD FOR FORMING COLOR IMAGE AND SILVER HALIDE COLOR PHOTOSENSITIVE MATERIAL USED FOR THE SAME

CROSS-REFERENCE TO RELATED APPLICATIONS

This application is based upon and claims the benefit of priority from the prior Japanese Patent Application No. 2003-329946, filed Sep. 22, 2003, the entire contents of which are incorporated herein by reference.

BACKGROUND OF THE INVENTION

1. Field of the Invention

The present invention relates to a method for color image formation and to a silver halide photosensitive material used for the method. More particularly, the invention relates to a method for forming a color image which has a high speed and a superior storability and which further has a superior color image storability, and to a silver halide photosensitive material which can yield such color images.

2. Description of the Related Art

In the field of silver halide color photosensitive materials, to enhance speed without deterioration in graininess is a long-existing problem. The photographic speed generally depends on the size of silver halide emulsion grains. The larger the emulsion grains, the more the speed increases. However, since the graininess deteriorates with increase of the size of silver halide grains, the speed and the graininess have a trade-off relationship. In this field, to increase the speed without deteriorating the graininess is the most basic and important problem in improving the image quality of a photosensitive material.

A technique of increasing the speed without deteriorating the graininess by incorporating, in a silver halide photosensitive material, a compound having at least three hetero atoms, has been disclosed, for example, in Jpn. Pat Appln. KOKAI Publication No. (hereinafter referred to as JP-A-) 2000-194085 and JP-A-2003-156823.

However, although the speed is increased by the above-mentioned method, the effect thereof is insufficient, and the use of the method has caused some new problems. It has been found that the photosensitive materials obtained by use of the method have deteriorated raw photosensitive material storability.

BRIEF SUMMARY OF THE INVENTION

The object of the present invention is to provide a method for increasing the speed of a silver halide photosensitive material without degrading the storability, deteriorating the graininess, and so on and to provide such silver halide color photosensitive materials.

As a result of continuous studies for achieving a more advantageous effect and for solving the problem, the present inventors conceived a method of preferably increasing the speed.

The present inventors found that use of a compound (A) defined below can solve the above mentioned problem.

They found also that use of the compound (A) of the present invention exhibits an unexpected advantage of preferably improving the image stability of a photosensitive material after processing.

Accordingly, the present invention provides the following methods and photosensitive materials:

(1) a method for forming color images comprising subjecting a silver halide color photosensitive material to a development processing in the presence of a compound (A) defined below, wherein the silver halide color photosensitive material having a blue-sensitive unit, a green-sensitive unit and a red-sensitive unit, each of which comprises at least one silver halide emulsion layer, and at least one non-light-sensitive layer on a support, compound (A): a heterocyclic compound having one or two hetero atoms, the heterocyclic compound being capable of increasing speed of the silver halide color photosensitive material by the presence thereof in comparison to the case where the heterocyclic compound is absent;

(2) the method for forming color images according to (1), wherein the compound (A) is contained in a developing solution;

(3) a silver halide color photosensitive material having a blue-sensitive unit, a green-sensitive unit and a red-sensitive unit, each of which comprises at least one silver halide emulsion layer, and at least one non-light-sensitive layer on a support, wherein at least one layer in the silver halide color photosensitive material contains a compound (A) defined below:

compound (A): a heterocyclic compound having one or two hetero atoms, the heterocyclic compound being capable of increasing speed of the silver halide color photosensitive material by the presence thereof in the silver halide color photosensitive material in comparison to the case where the heterocyclic compound is absent.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

DETAILED DESCRIPTION OF THE INVENTION

The heterocyclic compound of the present invention having one or two hetero atoms will be described in detail below.

When a specific moiety is called "group" in the present invention, it means either that the moiety is not substituted itself or that the moiety may be substituted with one or more substituents up to the number as many as possible. For example, "alkyl group" means an unsubstituted or substituted alkyl group. In addition, the substituents which can be used in the compound according to the present invention include any substituent regardless of being substituted or not.

When such a substituent is represented by W, the substituent W is not particularly restricted and may be any substituent, for example, a halogen atom, alkyl group (including cycloalkyl group, bicycloalkyl group and tricycloalkyl group), alkenyl group (including cycloalkenyl group and bicycloalkenyl group), alkynyl group, aryl group, heterocyclic group, cyano group, hydroxyl group, nitro group, carboxyl group, alkoxy group, aryloxy group, silyloxy group, heterocyclic oxy group, acyloxy group, carbamoyloxy group, alkoxycarbonyloxy group, aryloxycarbonyloxy group, amino group (including alkylamino group, arylamino group and heterocyclicamino group), ammonio group, acylamino group, aminocarbonylamino group, alkoxycarbonylamino group, aryloxycarbonylamino group, sulfamoylamino group, alkyl- and aryl-sulfonylamino groups, mercapto group, alkylthio group, arylthio group, heterocyclic thio group, sulfamoyl group, sulfo group, alkyl- and aryl-sulfinyl groups, alkyl- and arylsulfonyl groups, acyl group, aryloxycarbonyl group, alkoxycarbonyl group, carbamoyl group, aryl- and heterocyclic-azo groups, imido group, phosphino group, phosphinyl group, phosphinyloxy group, phosphinylamino group, phosphono group, silyl group, hydrazino group, ureido group, boric acid group ($—B(OH)_2$), phosphato group ($—OPO(OH)_2$), sulphato group ($—OSO_3H$), and other known substituents.

More particularly, the examples of W include a halogen atom (e.g., fluorine, chlorine, bromine, iodine), alkyl group {[a straight chain, branched, or cyclic, substituted or unsubstituted alkyl group including an alkyl group (preferably an alkyl group having from 1 to 30 carbon atoms, e.g., methyl, ethyl, n-propyl, isopropyl, t-butyl, n-octyl, eicosyl, 2-chloroethyl, 2-cyanoethyl, 2-ethylhexyl), cycloalkyl group (preferably a substituted or unsubstituted cycloalkyl group having from 3 to 30 carbon atoms, e.g., cyclohexyl, cyclopentyl, 4-n-dodecylcyclohexyl), bicycloalkyl group (preferably a substituted or unsubstituted bicycloalkyl group having from 5 to 30 carbon atoms, i.e., a monovalent group obtained by removing one hydrogen atom from a bicycloalkane group having from 5 to 30 carbon atoms, e.g., bicyclo[1,2,2]heptan-2-yl, bicyclo[2,2,2]octan-3-yl), and tricyclohexyl structure having more ring structures; the alkyl group in the substituent described below (e.g., the alkyl group in an alkylthio group) represents the alkyl group of such a concept, in addition to the above, an alkenyl group and an alkynyl group are also included], alkenyl group [a straight chain, branched, or cyclic, substituted or unsubstituted alkenyl group including an alkenyl group (preferably a substituted or unsubstituted alkenyl group having from 2 to 30 carbon atoms, e.g., vinyl, allyl, prenyl, geranyl, oleyl, cycloalkenyl group (preferably a substituted or unsubstituted cycloalkenyl group having from 3 to 30 carbon atoms, i.e., a monovalent group obtained by removing one hydrogen atom from a cycloalkene group having from 3 to 30 carbon atoms, e.g., 2-cyclopenten-1-yl, 2-cyclohexen-1-yl), bicycloalkenyl group (a substituted or unsubstituted bicycloalkenyl group, preferably a substituted or unsubstituted bicycloalkenyl group having from 5 to 30 carbon atoms, i.e., a monovalent group obtained by removing one hydrogen atom from a bicycloalkene group having one double bond, e.g., bicyclo[2,2,1]hepto-2-en-1-yl, bicyclo [2,2,2]octo-2-en-4-yl)), alkynyl group (preferably a substituted or unsubstituted alkynyl group having from 2 to 30 carbon atoms, e.g., ethynyl, propargyl, trimethylsilylethynyl group), aryl group (preferably a substituted or unsubstituted aryl group having from 6 to 30 carbon atoms, e.g., phenyl, p-tolyl, naphthyl, m-chlorophenyl, o-hexadecanoylaminophenyl), heterocyclic group (preferably a 5- or 6-membered, substituted or unsubstituted, aromatic or non-aromatic monovalent group obtained by eliminating one hydrogen atom from a heterocyclic compound, which may be condensed with a benzene ring or the like, more preferably a 5- or 6-membered aromatic heterocyclic group having from 3 to 30 carbon atoms, e.g., 2-furyl, 2-thienyl, 2-pyrimidinyl, 2-benzothiazolyl, further, a cationic heterocyclic group, e.g., 1-methyl-2-pyridinio, 1-methyl-2-quinolinio may also be included), cyano group, hydroxyl group, nitro group, carboxyl group, alkoxyl group (preferably a substituted or unsubstituted alkoxyl group having from 1 to 30 carbon atoms, e.g., methoxy, ethoxy, isopropoxy, t-butoxy, n-octyloxy, 2-methoxyethoxy), aryloxy group (preferably a substituted or unsubstituted aryloxy group having from 6 to 30 carbon atoms, e.g., phenoxy, 2-methylphenoxy, 4-t-butylphenoxy, 3-nitrophenoxy, 2-tetradecanoylaminophenoxy), silyloxy group (preferably a silyloxy group having from 3 to 20 carbon atoms, e.g., trimethylsilyloxy, t-butyldimethylsilyloxy), heterocyclic oxy group (preferably a substituted or unsubstituted heterocyclic oxy group having from 2 to 30 carbon atoms, e.g., 1-phenyltetrazol-5-oxy, 2-tetrahydropyranyloxy), acyloxy group (preferably a formyloxy group, a substituted or unsubstituted alkylcarbonyloxy group having from 2 to 30 carbon atoms, substituted or unsubstituted arylcarbonyloxy group having from 7 to 30 carbon atoms, e.g., formyloxy, acetyloxy, pivaloyloxy, stearoyloxy, benzoyloxy, p-methoxy-phenylcarbonyloxy), carbamoyloxy group (preferably a substituted or unsubstituted carbamoyloxy group having from 1 to 30 carbon atoms, e.g., N,N-dimethylcarbamoyloxy, N,N-diethylcarbamoyloxy, morpholinocarbonyloxy, N,N-di-n-octylaminocarbonyloxy, N-n-octylcarbamoyloxy), alkoxycarbonyloxy group (preferably a substituted or unsubstituted alkoxycarbonyloxy group having from 2 to 30 carbon atoms, e.g., methoxycarbonyloxy, ethoxycarbonyloxy, t-butoxycarbonyloxy, n-octylcarbonyloxy), aryloxycarbonyloxy group (preferably a substituted or unsubstituted aryloxycarbonyloxy group having from 7 to 30 carbon atoms, e.g., phenoxycarbonyloxy, p-methoxyphenoxycarbonyloxy, p-n-hexadecyloxy-phenoxycarbonyloxy), amino group (preferably an amino group, substituted or unsubstituted alkylamino group having from 1 to 30 carbon atoms, substituted or unsubstituted arylamino group having from 6 to 30 carbon atoms, e.g., amino, methylamino, dimethylamino, anilino, N-methylanilino, diphenylamino), ammonio group (preferably an ammonio group, ammonio group substituted with a substituted or unsubstituted alkyl group, aryl group or heterocyclic group which may have from 1 to 30 carbon atoms, e.g., trimethylammonio, triethylammonio, diphenylmethylammonio), acylamino group (preferably a formylamino group, substituted or unsubstituted alkylcarbonylamino group having from 1 to 30 carbon atoms, substituted or unsubstituted arylcarbonylamino group having from 6 to 30 carbon atoms, e.g., formylamino, acetylamino, pivaloylamino, lauroylamino, benzoylamino, 3,4,5-tri-n-octyloxyphenylcarbonylamino), amino-carbonylamino group (preferably a substituted or unsubstituted aminocarbonylamino group having from 1 to 30 carbon atoms, e.g., carbamoylamino, N,N-dimethylaminocarbonylamino, N,N-diethylaminocarbonylamino, morpholinocarbonylamino), alkoxycarbonylamino group (preferably a substituted or unsubstituted alkoxycarbonylamino group having from 2 to 30 carbon atoms, e.g., methoxycarbonylamino, ethoxycarbonylamino, t-butoxycarbonylamino, n-octadecyloxycarbonylamino, N-methylmethoxycarbonylamino), aryloxycarbonylamino group (preferably a substituted or unsubstituted aryloxycarbonylamino group having from 7 to 30 carbon atoms, e.g., phenoxycarbonylamino, p-chlorophenoxycarbonylamino, m-n-octyloxyphenoxycarbonylamino), sulfamoylamino group (preferably a substituted or unsubstituted sulfamoylamino group having from 0 to 30 carbon atoms, e.g., sulfamoylamino, N,N-dimethylaminosulfonylamino, N-n-octylaminosulfonylamino), alkyl- and aryl-sulfonylamino groups (preferably a substituted or unsubstituted alkylsulfonylamino group having from 1 to 30 carbon atoms, substituted or unsubstituted arylsulfonylamino group having from 6 to 30 carbon atoms, e.g., methylsulfonylamino, butylsulfonylamino, phenylsulfonylamino, 2,3,5-trichlorophenylsulfonylamino, p-methyl-phenylsulfonylamino), mercapto group, alkylthio group (preferably a substituted or unsubstituted alkylthio group having from 1 to 30 carbon atoms, e.g., methylthio, ethylthio, n-hexadecylthio), arylthio group (preferably a substituted or unsubstituted arylthio group having from 6 to 30 carbon atoms, e.g., phenylthio, p-chlorophenylthio, m-methoxyphenylthio), heterocyclic thio group (preferably a substituted or unsubstituted heterocyclic thio group having from 2 to 30 carbon atoms, e.g., 2-benzothiazolylthio, 1-phenyltetrazol-5-ylthio), sulfamoyl group (preferably a substituted or unsubstituted sulfamoyl group having from 0 to 30 carbon atoms, e.g., N-ethylsulfamoyl, N-(3-dodecyloxypropyl)sulfamoyl, N,N-dimethylsulfamoyl, N-acetylsulfamoyl, N-benzoylsulfamoyl, N-(N'-phenylcarbamoyl)sulfamoyl), sulfo group, alkyl- and aryl-sulfinyl groups (preferably a substituted or unsubstituted alkylsulfinyl group having from 1 to 30 carbon atoms, substituted or unsubstituted arylsulfinyl group having from 6 to 30 carbon atoms, e.g., methylsulfinyl, ethylsulfinyl, phenylsulfinyl, p-methylphenylsulfinyl), alkyl- and aryl-sulfonyl groups (preferably a substituted or unsubstituted alkylsulfonyl group having from 1 to 30 carbon atoms, substituted or unsubstituted arylsulfonyl group having from 6 to 30 carbon atoms, e.g., methylsulfonyl, ethylsulfonyl, phenylsulfonyl, p-methylphenylsulfonyl), acyl group (preferably a formyl group, substituted or unsubstituted alkylcarbonyl group having from 2 to 30 carbon atoms, substituted or unsubstituted arylcarbonyl group having from 7 to 30 carbon atoms, substituted or unsubstituted heterocyclic carbonyl group having from 4 to 30 carbon atoms bonded to the carbonyl group via a carbon atom thereof, e.g., acetyl, pivaloyl, 2-chloroacetyl, stearoyl, benzoyl, p-n-octyloxyphenylcarbonyl, 2-pyridylcarbonyl, 2-furylcarbonyl), aryloxycarbonyl group (preferably a substituted or unsubstituted aryloxycarbonyl group having from 7 to 30 carbon atoms, e.g., phenoxycarbonyl, o-chlorophenoxycarbonyl, m-nitrophenoxycarbonyl, p-t-butylphenoxycarbonyl), alkoxycarbonyl group (preferably a substituted or unsubstituted alkoxycarbonyl group having from 2 to 30 carbon atoms, e.g., methoxycarbonyl, ethoxycarbonyl, t-butoxycarbonyl, n-octadecyloxycarbonyl), carbamoyl group (preferably a substituted or unsubstituted carbamoyl group having from 1 to 30 carbon atoms, e.g., carbamoyl, N-methylcarbamoyl, N,N-dimethylcarbamoyl, N,N-di-n-octylcarbamoyl, N-(methylsulfonyl)carbamoyl), aryl- and heterocyclic-azo groups (preferably a substituted or unsubstituted arylazo group having from 6 to 30 carbon atoms, substituted or unsubstituted heterocyclic azo group having from 3 to 30 carbon atoms, e.g., phenylazo, p-chlorophenylazo, 5-ethylthio-1,3,4-thiadiazol-2-ylazo), imido group (preferably N-succinimido, N-phthalimido), phosphino group (preferably a substituted or unsubstituted phosphino group having from 2 to 30 carbon atoms, e.g., dimethylphosphino, diphenylphosphino, methylphenoxyphosphino), phosphinyl group (preferably a substituted or unsubstituted phosphinyl group having from 2 to 30 carbon atoms, e.g., phosphinyl, dioctyloxyphosphinyl, diethoxyphosphinyl), phosphinyloxy group (preferably a substituted or unsubstituted phosphinyloxy group having from 2 to 30 carbon atoms, e.g., diphenoxyphosphinyloxy, dioctyloxyphosphinyloxy), phosphinylamino group (preferably a substituted or unsubstituted phosphinylamino group having from 2 to 30 carbon atoms, e.g., dimethoxyphosphinylamino, dimethylaminophosphinylamino), phospho group, silyl group (preferably a substituted or unsubstituted silyl group having from 3 to 30 carbon atoms, e.g., trimethylsilyl, t-butyl-dimethylsilyl, phenyldimethylsilyl), hydrazino group (preferably a substituted or unsubstituted hydrazino group having from 0 to 30 carbon atoms, e.g., trimethylhydrazino), and ureido group (preferably a substituted or unsubstituted ureido group having from 0 to 30 carbon atoms, e.g., N,N-dimethylureido).

Further, two substituents, W's, may be combined to each other to form a ring, e.g., an aromatic, or a non-aromatic, hydrocarbon ring, or a hetero ring, which may further be combined to form a polycyclic condensed ring. Examples of such rings include a benzene ring, naphthalene ring, anthracene ring, phenanthrene ring, fluorene ring, triphenylene ring, naphthacene ring, biphenyl ring, pyrrole ring, furan ring, thiophene ring, imidazole ring, oxazole ring, thiazole ring, pyridine ring, pyrazine ring, pyrimidine ring, pyridazine ring, indolizine ring, indole ring, benzofuran ring, benzothiophene ring, isobenzofuran ring, quinolizine ring, quinoline ring, phthalazine ring, naphthyridine ring, quinoxaline ring, quinoxazoline ring, isoquinoline ring, carbazole ring, phenanthridine ring, acridine ring, phenanthroline ring, thianthrene ring, chromene ring, xanthene ring, phenoxthine ring, phenothiazine ring, and phenazine ring.

Of the above substituents W, those having a hydrogen atom may be substituted with the above groups after removing the hydrogen atom therefrom. Examples of such substituents include —$CONHSO_2$— group (a sulfonylcarbamoyl group, a carbonylsulfamoyl group), —CONHCO— group (a carbonylcarbamoyl group), and —$SO_2NHSO_2$— group (a sulfonylsulfamoyl group).

More specific examples include an alkylcarbonylaminosulfonyl group (e.g., acetylaminosulfonyl), arylcarbonylaminosulfonyl group (e.g., a benzoylaminosulfonyl group), alkylsulfonylaminocarbonyl group (e.g., methylsulfonylaminocarbonyl), and arylsulfonylaminocarbonyl group (e.g., p-methylphenylsulfonylaminocarbonyl).

The following is an explanation regarding the heterocyclic compound having one or two hetero atoms which is used for the present invention. The hetero atom means an atom other than carbon atom and hydrogen atom. The hetero ring means a cyclic compound having at least one hetero atom. The hetero atom in the "hetero ring having one or two hetero atoms" means only an atom forming a constitutional portion of the ring system of the hetero ring and does not mean an atom located outside the ring system, an atom apart from the ring system via at least one unconjugated single bond, or an atom which is a part of a further substituent on the ring system.

In the case of a polycyclic hetero ring, only a polycyclic hetero ring which contains only one or two hetero atoms in its whole ring system is encompassed by the present invention. For example, 1,3,4,6-tetraazaindene is not included in the hetero rings of the present invention because it has four hetero atoms.

Although any heterocyclic compound meeting these requirements may be employed, the hetero atom preferably is a nitrogen atom, sulfur atom, oxygen atom, selenium atom, tellurium atom, phosphorus atom, silicon atom and boron atom, more preferably is a nitrogen atom, sulfur atom, oxygen atom and selenium atom, particularly preferably is a nitrogen atom, sulfur atom and oxygen atom, and most preferably is a nitrogen atom and sulfur atom.

Although the hetero ring may be one that has any number of ring members, preferred is a 3- to 8-membered ring, more preferred is a 5- to 7-membered ring, and particularly preferred is a 5- or 6-membered ring.

Although the hetero ring may be either saturated or unsaturated, it is preferable that it has at least one unsaturated portion. It is more preferable that it has at least two unsaturated portions. In other words, although the hetero ring may be any of a aromatic one, a pseudaromatic one and a non-aromatic one, preferred are an aromatic one and a pseudaromatic one.

Specific examples of such hetero rings include a pyrrole ring, thiophene ring, furan ring, imidazole ring, pyrazole ring, thiazole ring, isothiazole ring, oxazole ring, isoxazole ring, pyridine ring, pyrazine ring, pyrimidine ring, pyridazine ring, indolizine ring, their benzo-condensed hetero rings such as an indole ring, benzofuran ring, benzothiophene ring, isobenzofuran ring, quinolizine ring, quinoline ring, phthalazine ring, quinoxaline ring, isoquinoline ring, carbazole ring, phenanthridine ring, phenanthroline ring, acridine ring, and their partially or entirely saturated hetero rings such as a pyrrolidine ring, pyrroline ring and imidazoline ring.

Examples of representative hetero rings are as follows:

(a-1)

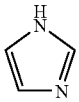

(a-2)

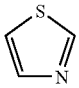

(a-3)

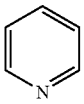

(a-4)

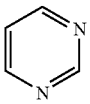

(a-5)

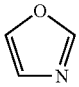

(a-6)

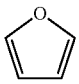

(a-7)

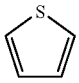

(a-8)

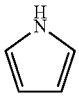

(a-9)

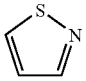

(a-10)

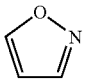

(a-11)

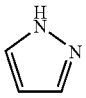

-continued (a-12)

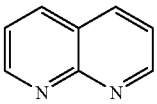

(a-13)

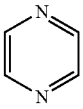

(a-14)

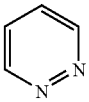

(a-15)

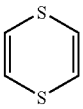

(a-16)

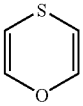

(a-17)

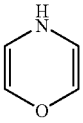

(a-18)

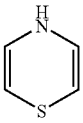

Examples of hetero rings with a condensed benzene ring are as follows:

(b-1)

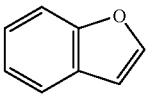

(b-2)

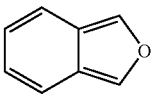

(b-3)

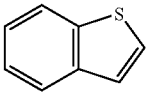

(b-4)

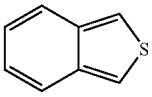

(b-5)

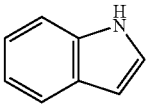

-continued
(b-6)
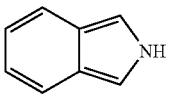
(b-7)
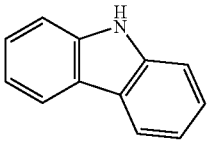
(b-8)
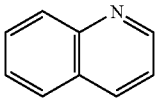
(b-9)
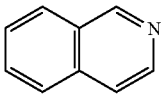
(b-10)
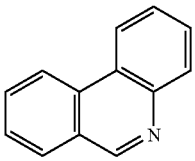
(b-11)
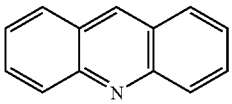
(b-12)
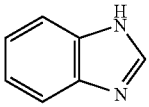
(b-13)
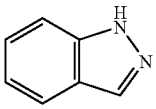
(b-14)
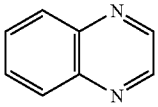
(b-15)
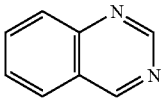
(b-16)
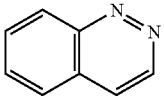
(b-17)
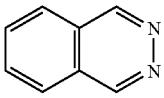
-continued
(b-18)
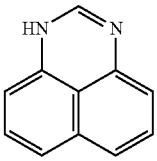
(b-19)
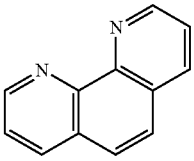
(b-20)
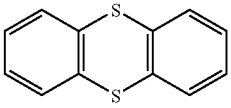
(b-21)
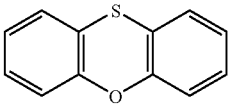
(b-22)
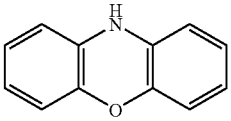
(b-23)
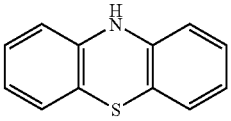
(b-24)
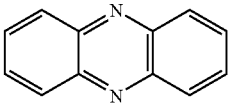
(b-25)
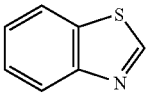
(b-26)
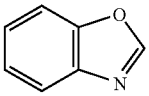
(b-27)
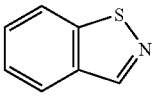
(b-28)
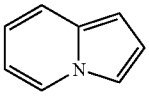
(b-29)
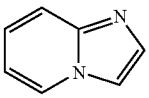

Examples of hetero rings partially or entirely saturated are as follows:
(c-1)
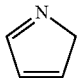
(c-2)
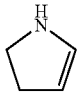
(c-3)
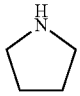
(c-4)
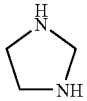
(c-5)
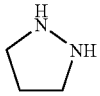
(c-6)
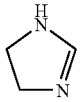
(c-7)
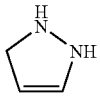
(c-8)
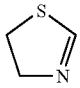
(c-9)
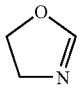
(c-10)
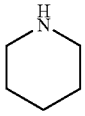
(c-11)
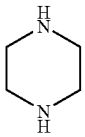
(c-12)
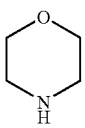
(c-13)
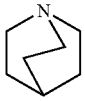
-continued
(c-14)
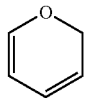
(c-15)
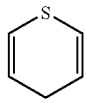
(c-16)
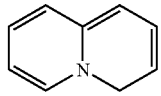
(c-17)
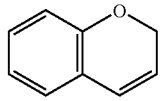
(c-18)
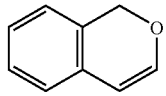
(c-19)
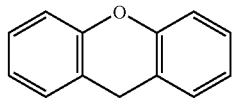
The hetero rings shown below are also available:
(d-1)
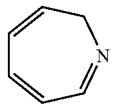
(d-2)
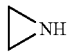
(d-3)
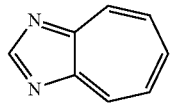
(d-4)
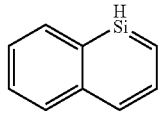
(d-5)
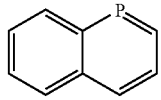
(d-6)
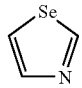
(d-7)
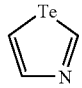

-continued (d-8)

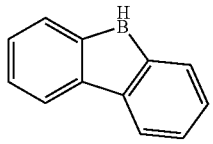

These hetero rings may either be substituted with any substituent or be condensed with another ring unless the hetero rings are out of the definition a "hetero ring having one or two hetero atoms" provided in the present invention. Examples of the substituent may be the previously mentioned W. A tertiary nitrogen atom contained in a hetero ring may be substituted to become a quaternary nitrogen. It should be noted wherever it is possible to write alternative tautomeric structures of the hetero rings, these are considered to be chemically equivalent.

It is desirable that the hetero rings in the present invention have neither a free thiol group (—SH) nor a thiocarbonyl group (>C═S) thereon.

Of the above-listed heterocyclic nuclei, preferred are (a-1) to (a-4). In (a-2), more preferable is (b-25), which has a condensed benzene ring.

The heterocyclic compound of the present invention may be either capable or incapable of reacting with an oxidized developing agent. However, heterocyclic compounds which are incapable of reacting with an oxidized developing agent may be preferably employed.

That is, preferred are those which do not remarkably (namely, 5 or more but less than 10%) undergo a chemical reaction or a redox reaction directly with an oxidized developing agent. Moreover, those which are not couplers and which do not yield dyes or other products through their reaction with oxidized developing agents are preferable.

The reactivity (CRV) of the compound of the present invention with an oxidized developing agent is determined by the following method.

A photosensitive material (A) for evaluation was treated in the same method as that described in Example 1 to be described later, except exposing the material to white light and changing the treatment time in the color development step to 1 minute and 15 seconds. This sensitive material was measured for magenta density and cyan density, followed by determination of the differences, respectively, from the magenta density and the cyan density of a sensitive material containing no compound of the present invention. For improving the speed/graininess ratio, the CRV is preferably 0.01 or less, and more preferably is 0.

Sensitive Material (A) for Evaluation (Support) Cellulose Triacetate

| | |
|---|---|
| (Emulsion Layer) | |
| Em-C in terms of silver | 1.07 $g/m^2$ |
| Gelatin | 2.33 $g/m^2$ |
| ExC-1 | 0.76 $g/m^2$ |
| ExC-4 | 0.42 $g/m^2$ |
| Tricresyl phosphate | 0.62 $g/m^2$ |
| Compound of the present invention | $3.9 \times 10^{-4}$ $mol/m^2$ |
| (Protective Layer) | |
| Gelatin | 2.00 $g/m^2$ |
| H-1 | 0.33 $g/m^2$ |

-continued

| | |
|---|---|
| B-1 (1.7 μm in diameter) | 0.10 $g/m^2$ |
| B-2 (1.7 μm in diameter) | 0.30 $g/m^2$ |
| B-3 | 0.10 $g/m^2$ |

The characteristics of emulsion Em-C used in the above sensitive material (A) for evaluation and the structural formulas of the individual compounds are shown in the section of Example 1 described later.

As a substituent of the compound of the present invention, it is possible to choose any substituent for obtaining photographic characteristics desirable for specific applications for a skilled person. These include, for example, a hydrophobic group (ballast group), a solubilizing group, a blocking group, and a releasing or releasable group. Generally, the number of carbon atoms in these groups is preferably 1 to 60, and more preferably 1 to 50.

In order to control the migration of the compound of the present invention in a photosensitive material, the molecule may contain a polymer main chain containing a high molecular weight hydrophobic group or a ballast group.

The number of carbon atoms in representative ballast groups is preferably from 8 to 60, more preferably from 10 to 57, particularly preferably from 12 to 55, and most preferably from 16 to 53. Examples of these substituents include substituted or unsubstituted, alkyl, aryl or heterocyclic groups having 8 to 60, preferably 10 to 57, more preferably 13 to 55, particularly preferably 16 to 53, and most preferably 20 to 50 carbon atoms. These preferably have a branch. Examples of the representative substituents on those groups include an alkyl group, aryl group, alkoxy group, aryloxy group, alkylthio group, hydroxy group, halogen atom, alkoxycarbonyl group, aryloxycarbonyl group, carboxy group, acyl group, acyloxy group, amino group, anilino group, carbonamido group, carbamoyl group, alkylsulfonyl group, arylsulfonyl group, sulfonamido group and sulfamoyl group. These substituents generally have 1 to 42 carbon atoms. For example, the aforementioned W is mentioned. Moreover, such a substituent may further substituted.

As the ballast group, specifically mentioned are substituents having eight or more carbon atoms which are listed as specific examples of $V_1$ and $V_2$ in formula (II) which will be described later.

When causing a silver halide photosensitive material to contain the compound of the present invention, it is preferable to use a compound which can be fixed to a specific layer during the storage and which diffuses at an appropriate time during a photographic processing (preferably during a developing process). For fixing the compound of the present invention while preventing it from its diffusion during the storage, any compound and method may be used. Preferred are the compounds and methods described below.

(1) A method in which a compound having a specific pKa is added through emulsifying and dispersing the compound of the present invention together with a high-boiling organic solvent to be described later and so on, whereby the compound is dissociated and eluted from the oil only during development.

The pKa of the compound of the present invention is preferably 5.5 or more, more preferably not less than 6.0 but not more than 10.0, particularly preferably not less than 6.5 but not more than 8.4, and most preferably not less than 6.9 but not more than 8.3.

Although any dissociating group is available, preferred are carboxyl group, —$CONHSO_2$— group (sulfonylcarbamoyl group and carbonylsulfamoyl group), —CONHCO— group (carbonylcarbamoyl group), —$SO_2NHSO_2$— group (sulfonylsulfamoyl group), sulfonamido group, sulfamoyl group and phenolic hydroxyl group. More preferred are carboxyl group, —$CONHSO_2$— group, —CONHCO— group and —$SO_2NHSO_2$— group. Particularly preferred are carboxyl group and —$CONHSO_2$— group.

(2) a method in which the compound of the present invention is made to be nondiffusing through introduction of a ballast group thereinto.

(3) A method in which a blocking group is used. It is possible to use a compound which changes in a property thereof (for example, is rendered diffusible) through a chemical reaction, e.g., nucleophilic reaction, electrophilic reaction, oxidation and reduction, which occurs during a photographic processing step. The chemistry regarding these reactions and any method known in the photographic field can be used.

For example, a nucleophilic reaction is described in detail below. A nucleophilic reaction can take place under any conditions and it is accelerated by a base or heat, especially in the presence of a base. The base may be chosen from inorganic bases and organic bases, although any base is available. Examples thereof include tertiary amine such as triethylamine, aromatic heterocyclic amine such as pyridine, and bases having an OH anion such as sodium hydroxide and potassium hydroxide. Particularly in the present invention, the base can be used suitably because a photographic processing at a high pH, e.g., a processing using a developing solution, among the photographic processings accelerates the nucleophilic reaction.

The nucleophile reagent used herein is a chemical species which has a property such that it attacks an atom having a low electron density, e.g., a carbonyl carbon, contained in a group of atoms which forms a group that leaves when it is attacked by the nucleophic agent, thereby giving an electron to or sharing an electron with the atom. The nucleophile reagent may have any structure and preferred examples thereof include reagents which provide a hydroxide ion (e.g., sodium hydroxide, potassium hydroxide, lithium hydroxide, sodium carbonate and potassium carbonate), reagents which provide a sulfite ion (e.g., sodium sulfite and potassium sulfite), reagents which provide a hydroxylamide ion (e.g., hydroxylamine), reagents which provide a hydrazide ion (e.g., hydrazine hydrate and dialkylhydrazines), reagents which provide a hexacyanoferrate(II) ion (e.g., yellow prussiate of potash), cyanide ion, tin(II) ion, ammonia, and reagents which provide an alkoxy ion (e.g., sodium methoxide). Examples of the group which leaves when it is attached by a nucleophile reagent include groups which utilize a reverse Michael reaction disclosed, for example, in Can. J. Chem., vol. 44, p. 2315 (1966), JP-A's-59-137945 and 60-41034, groups which utilize a nucleophilic reaction disclosed, for example, in Chem. Lett., p. 585 (1988), JP-A-59-218439 and Jpn. Pat Appln. KOKOKU Publication No. (hereinafter referred to as JP-B-) 5-78025, and groups which utilize hydrolysis reaction of an ester bond or an amido bond.

For imparting the above-mentioned functions, the compound of the present invention may be substituted with a blocking group which will release the compound of the present invention during a photographic processing step. As the blocking group, there can be employed known blocking groups, which include blocking groups such as acyl and sulfonyl groups as described in, for example, JP-B-48-9968, JP-A's 52-8828 and 57-82834, U.S. Patent No. (hereinafter referred to as USP) U.S. Pat. No. 3,311,476 and JP-B-47-44805 (U.S. Pat. No. 3,615,617); blocking groups utilizing the reverse Michael reaction as described in, for example, JP-B-55-17369 (U.S. Pat. No. 3,888,677), JP-B-55-9696 (U.S. Pat. No. 3,791,830), JP-B-55-34927 (U.S. Pat. No. 4,009,029), JP-A-56-77842 (U.S. Pat. No. 4,307,175) and JP-A's 59-105640, 59-105641 and 59-105642; blocking groups utilizing the formation of a quinone methide or quinone methide homologue through intramolecular electron transfer as described in, for example, JP-B-54-39727, U.S. Pat. Nos. 3,674,478, 3,932,480 and 3,993,661, JP-A-57-135944, JP-A-57-135945 (U.S. Pat. No. 4,420,554), JP-A's 57-136640 and 61-196239, JP-A-61-196240 (U.S. Pat. No. 4,702,999), JP-A-61-185743, JP-A-61-124941 (U.S. Pat. No. 4,639,408) and JP-A-2-280140; blocking groups utilizing an intramolecular nucleophilic substitution reaction as described in, for example, U.S. Pat. Nos. 4,358,525 and 4,330,617, JP-A-55-53330 (U.S. Pat. No. 4,310,612), JP-A's 59-121328 and 59-218439 and JP-A-63-318555 (European Patent Appln. Publication No. (hereinafter referred to as EP) 0295729); blocking groups utilizing a cleavage reaction of 5- or 6-membered ring as described in, for example, JP-A-57-76541 (U.S. Pat. No. 4,335,200), JP-A-57-135949 (U.S. Pat. No. 4,350,752), JP-A's 57-179842, 59-137945, 59-140445, 59-219741 and 59-202459, JP-A-60-41034 (U.S. Pat. No. 4,618,563), JP-A-62-59945 (U.S. Pat. No. 4,888,268), JP-A-62-65039 (U.S. Pat. No. 4,772,537), and JP-A's 62-80647, 3-236047 and 3-238445; blocking groups utilizing an addition reaction of nucleophile reagent to conjugated unsaturated bond as described in, for example, JP-A's 59-201057 (U.S. Pat. No. 4,518,685), 61-43739 (U.S. Pat. No. 4,659,651), 61-95346 (U.S. Pat. No. 4,690,885), 61-95347 (U.S. Pat. No. 4,892,811), 64-7035, 4-42650 (U.S. Pat. No. 5,066,573), 1-245255, 2-207249, 2-235055 (U.S. Pat. No. 5,118,596) and 4-186344; blocking groups utilizing a β-leaving reaction as described in, for example, JP-A's 59-93442, 61-32839 and 62-163051 and JP-B-5-37299; blocking groups utilizing a nucleophilic substitution reaction of diarylmethanes as described in JP-A-61-188540; blocking groups utilizing Lossen rearrangement reaction as described in JP-A-62-187850; blocking groups utilizing a reaction between an N-acyl derivative of thiazolidine-2-thione and an amine as described in, for example, JP-A's 62-80646, 62-144163 and 62-147457; blocking groups having two electrophilic groups and capable of reacting with a binucleophile reagent as described in, for example, JP-A's 2-296240 (U.S. Pat. No. 5,019,492), 4-177243, 4-177244, 4-177245, 4-177246, 4-177247, 4-177248, 4-177249, 4-179948, 4-184337 and 4-184338, WO 92/21064, JP-A-4-330438, WO 93/03419 and JP-A-5-45816; and blocking groups of JP-A's 3-236047 and 3-238445, the entire contents of the above documents disclosing the blocking groups are incorporated herein by reference. Of these blocking groups, blocking groups having two electrophilic groups and capable of reacting with a binucleophile reagent as described in, for example, JP-A's 2-296240 (U.S. Pat. No. 5,019,492), 4-177243, 4-177244, 4-177245, 4-177246, 4-177247, 4-177248, 4-177249, 4-179948, 4-184337 and 4-184338, WO 92/21064, JP-A-4-330438, WO 93/03419 and JP-A-5-45816 are especially preferred. The blocking group may be a group containing a timing group capable of inducing a cleavage reaction with the use of electron transfer reaction as described in U.S. Pat. Nos. 4,409,323 and 4,421,845, the entire contents of which are incorporated herein by reference. In this case, it is desirable that the terminal capable of inducing an electron transfer reaction be blocked.

(4) A method of using a dimer, a trimer or a higher polymer compound containing, as a partial structure, the compound of the present invention.

(5) A method of fixing by using a compound of the present invention (solid dispersion) which is water-insoluble. Like stated in (1), the case where the compound of the present invention has a specific pKa is preferable because the compound of the present invention dissolves only at the time of development. Further, examples of use of a water-insoluble dye solid (solid dispersion) are disclosed, e.g., in JP's-A-56-12639, 55-155350, 55-155351, 63-27838, and 63-197943, and EP 15601, the entire contents of which are incorporated herein by reference.

The method for solid dispersion will be described in detail later.

(6) A method for fixing a compound of the present invention by making a polymer charged oppositely to the compound of the present invention be present as a mordant. Examples of fixing a dye are disclosed, for example, in U.S. Pat. Nos. 2,548,564, 4,124,386 and 3,625,694, the entire contents of which are incorporated herein by reference.

(7) A method of fixing the compound of the present invention by causing a metal salt such as silver halide to adsorb the compound. Examples of fixing a dye are disclosed, for example, in U.S. Pat. Nos. 2,719,088, 2,496,841, and 2,496,843 and JP-A-60-45237, the entire contents of which are incorporated herein by reference.

Representatives of the adsorptive group to silver halide which can be used in the present invention include the groups disclosed in JP-A-2003-156823, page 16, right column, line 1 to page 17, right column, line 12, the disclosures of which are incorporated herein by reference.

Preferred as the adsorptive group are a mercapto-substituted nitrogen-containing heterocyclic group (e.g., 2-mercaptothiadiazole group, 3-mercapto-1,2,4-triazole group, 5-mercaptotetrazole group, 2-mercapto-1,3,4-oxadiazole group, 2-mercaptobenzoxazole group, 2-mercaptobenzothiazole group, 1,5-dimethyl-1,2,4-triazolium-3-thiolate group etc.), or a nitrogen-containing heterocyclic group having a —NH— group that can form imino silver (>NAg) as a partial structure of the hetero ring (e.g., benzotriazol group, benzimidazole group, indazole group etc.). Particularly preferred are 5-mercaptotetrazole group, 3-mercapto-1,2,4-triazole group and benzotriazol group. Most preferred are 3-mercapto-1,2,4-triazole group and 5-mercaptotetrazole group.

Those having, in the molecule thereof, two or more mercapto groups as a partial structure are also especially preferred. Herein, the mercapto group (—SH) may become a thione group when it can be tautomerized. As preferred examples of adsorptive groups having two or more mercapto groups as a partial structure (e.g., dimercapto-substituted nitrogen-containing heterocyclic groups), there can be mentioned 2,4-dimercaptopyrimidine group, 2,4-dimercaptotriazine group and 3,5-dimercapto-1,2,4-triazole group.

Moreover, quaternary salt structures of nitrogen or phosphorus are also preferably used. Specific examples of the quaternary salt structure of nitrogen include an ammonio group (e.g., trialkylammonio group, dialkylaryl (or heteroaryl)ammonio group, alkyldiaryl (or heteroaryl)ammonio group) or a group containing nitrogen-containing heterocyclic group containing quaternary nitrogen atom. Examples of the quaternary salt structure of phosphorus include phosphonio group (trialkylphosphonio group, dialkylaryl(or heteroaryl)phosphonio group, alkyldiaryl(or heteroaryl)phosphonio group and triaryl(or heteroaryl)phosphonio group. More preferably employed are quaternary salt structures of nitrogen. Still more preferably employed are 5- or 6-membered nitrogen-containing aromatic heterocyclic groups containing a quaternary nitrogen atom. Particularly preferably employed are pyridinio group, quinolinio group and isoquinolinio group. The nitrogen-containing heterocyclic groups containing a quaternary nitrogen group may have any substituent.

Examples of counter anions of the quaternary salts include halogen ion, carboxylate ion, sulfonate ion, sulfate ion, perchlorate ion, carbonate ion, nitrate ion, $BF_4^-$, $PF_6^-$ and $Ph_4B^-$. When a group having in the molecule a negative charge in a carboxylate group or the like, the counter anion may form an intramolecular salt together with the negatively charged group. As a counter anion which is not in the molecule, chloride ion, bromide ion or methansulfonate ion is particularly preferred.

Of those mentioned above, preferred as a method for fixing a compound of the present invention are (1) the method using a compound having a specific pKa, (2) the method using a compound having a ballast group, (3) the method using a blocking group, and (5) the method using a solid dispersion. It is preferable to use compound suitable for these methods. More preferable are the method and compound of (1), (2) or (3). Paricularly preferred are the method and compound of (1) or (2). The most preferable is to use the methods (1) and (2) simultateously. That is, a compound of the present invention which has both a specific pKa and a ballast group is most preferably used.

The compound represented by general formula (I) shown below is more preferable as the compound of the present invention.

General formula (I)

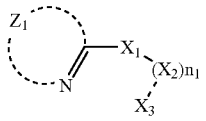

In general formula (I), $Z_1$ represents a group forming a hetero ring having one or two hetero atoms including the nitrogen atom in the formula. $X_1$ represents a sulfur atom, an oxygen atom, a nitrogen atom (N(Va)), or a carbon atom (C(Vb)(Vc)). Va, Vb and Vc each represent a hydrogen atom or a substituent. $X_2$ has the same meaning as $X_1$. $n_1$ is 0, 1, 2 or 3. when $n_1$ is 2 or larger, $X_2$'s are repeated but they are not required to be the same. $X_3$ represents a sulfur atom, an oxygen atom or a nitrogen atom. The bond between $X_2$ and $X_3$ is a single bond or a double bond. $X_3$ may further have a substituent or have a charge according to the type of the bond.

Among the compounds represented by the formula (I), those represented by general formula (II) shown below is particularly preferable as the compound of the present invention.

General formula (II)

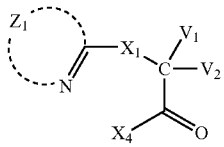

In general formula (II), $Z_1$ and $X_1$ have the same meanings as those in formula (I). $X_4$ represents a sulfur atom (S(Vd), an oxygen atom (O(Ve)) or a nitrogen atom (N(Vf)(Vg)). Vd, Ve, Vf and Vg each represent a hydrogen atom, a substituent or a negative charge. $V_1$ and $V_2$ each represent a hydrogen atom or a substituent.

The formulas (I) and (II) will be described in detail below.

Examples of a preferable hetero ring represented by $Z_1$ include hetero rings of a-1 to a-18, b-1 to b-29, c-1 to c-19, and d-1 to d-8, which are listed above as examples of a hetero ring having one or two hetero atoms. These may either have a substituent (e.g., the afore-mentioned W) or be condensed with another ring unless they are out of the definition "a hetero ring having one or two hetero atoms" provided in the present invention.

$X_1$ is preferably a sulfur atom, an oxygen atom or a nitrogen atom, more preferably a sulfur atom or a nitrogen atom, and particularly preferably a sulfur atom. As the substituents represented by Va, Vb and Vc, the aforementioned W is mentioned. Preferred as the substituents are alkyl group, aryl group and hetero ring group. Preferred as $X_2$ is a carbon atom. Preferred as $n_1$ are 0, 1 and 2. 2 is more preferred. Preferred as $X_3$ is an oxygen atom. The valency of $X_3$ varies depending on whether the bond between $X_2$ and $X_3$ is a single bond or a double bond. For example, when the bond between $X_2$ and $X_3$ is a double bond and $X_3$ is an oxygen atom, $X_3$ represents a carbonyl group. When the bond between $X_2$ and $X_3$ is a single bond and $X_3$ is an oxygen atom, $X_3$ represents, for example, a hydroxyl group, alkoxy group, negatively-charged oxygen atom, or the like.

Preferred as $X_4$ is an oxygen atom. As the substituents represented by Vd, Ve, Vf and Vg, those listed for the aforementioned W are mentioned. It is preferable that at least one selected from the group represented by Vd, the group represented by Ve, and the groups represented by Vf and Vg represent a hydrogen atom or a negative charge. As the substituents represented by $V_1$ and $V_2$, the aforementioned W are mentioned. It is preferable that at least one of $V_1$ and $V_2$ is a substituent except a hydrogen atom.

Specific examples of the substituent include halogen atoms (e.g., chlorine, bromine and fluorine atoms); alkyl groups (having 1 to 60 carbon atoms, such as methyl, ethyl, propyl, iso-butyl, t-butyl, t-octyl, 1-ethylhexyl, nonyl, cyclohexyl, undecyl, pentadecyl, n-hexadecyl, and 3-decaneamidepropyl); alkenyl groups (having 2 to 60 carbon atoms, such as vinyl, allyl and oleyl); cycloalkyl groups (having 5 to 60 carbon atoms, such as cyclopentyl, cyclohexyl, 4-t-butylcyclohexyl, 1-indanyl, and cyclododecyl); aryl groups (having 6 to 60 carbon atoms, such as phenyl, p-tolyl, and naphthyl); acylamino groups (having 2 to 60 carbon atoms, such as acetylamino, n-butaneamido, octanoylamino, 2-hexyldecaneamido, 2-(2',4'-di-t-amylphenoxy)butaneamido, benzoylamino, and nicotineamido); sulfonamido groups (having 1 to 60 carbon atoms, such as methanesulfonamido, octanesulfonamido, and benzenesulfonamido); ureido groups (having 2 to 60 carbon atoms, such as decylaminocarbonylamino, di-n-octylaminocarbonylamino); urethane groups (having 2 to 60 carbon atoms, such as dodecyloxycarbonylamino, phenoxycarbonylamino, and 2-ethylhexyloxycarbonylamino); alkoxy groups (having 1 to 60 carbon atoms, such as methoxy, ethoxy, butoxy, n-octyloxy, hexadecyloxy, and methoxyethoxy); aryloxy groups (having 6 to 60 carbon atoms, such as phenoxy, 2,4-di-t-amylphenoxy, 4-t-octylphenoxy, and naphthoxy); alkylthio groups (having 1 to 60 carbon atoms, such as methylthio, ethylthio, butylthio, and hexadecylthio); arylthio groups (having 6 to 60 carbon atoms, such as phenylthio, and 4-dodecyloxyphenylthio); acyl groups (having 1 to 60 carbon atoms, such as acetyl, benzoyl, butanoyl, and dodecanoyl); sulfonyl groups (having 1 to 60 carbon atoms, such as methanesulfonyl, butanesulfonyl, and toluenesulfonyl); cyano group; carbamoyl groups (having 1 to 60 carbon atoms, such as N,N-dicyclohexylcarbamoyl); sulfamoyl groups (having 0 to 60 carbon atoms, such as N,N-dimethylsulfamoyl); hydroxyl group; sulfo group; carboxyl group; nitro group; alkylamino groups (having 1 to 60 carbon atoms, such as methylamino, diethylamino, octylamino, and octadecylamino); arylamino groups (having 6 to 60 carbon atoms, such as phenylamino, naphthylamino, and N-methyl-N-phenylamino); heterocyclic groups (having 0 to 60 carbon atoms; preferred are heterocyclic groups whose ring-constituting hetero atoms are selected from nitrogen, oxygen and sulfur atoms; more preferred are such heterocyclic groups containing, as a ring-constituting atom, a carbon atom besides the hetero atom(s); the number of the membered atoms in the hetero ring is preferably from 3 to 8, more preferably from 5 to 6; examples of the heterocyclic group are the same as described as the examples of W); and acyloxy groups (having 1 to 60 carbon atoms, such as formyloxy, acetyloxy, myristoyloxy, and benzoyloxy).

Of the substituents mentioned above, alkyl group, cycloalkyl group, aryl group, acylamino group, ureido group, urethane group, alkoxy group, aryloxy group, alkylthio group, arylthio group, acyl group, sulfonyl group, cyano group, carbamoyl group and sulfamoyl group include those having a substituent, examples of which include alkyl group, cycloalkyl group, aryl group, acylamino group, ureido group, urethane group, alkoxy group, aryloxy group, alkylthio group, arylthio group, acyl group, sulfonyl group, cyano group, carbamoyl group and sulfamoyl group.

Of these substituents, preferred are alkyl group, aryl group, alkoxy group and aryloxy group, and more preferred are alkyl group, alkoxy group and aryloxy group. Particularly preferred is a branched alkyl group.

Although the total number of carbon atoms in these substituents is not particularly limited, it is preferably 8 to 60, more preferably 10 to 57, particularly preferably 12 to 55, and most preferably 16 to 53.

Compounds represented by formula (11) or formula (21) set forth below are also preferable compounds of the present invention other than those represented by formula (I) or formula (II).

General formula (11)

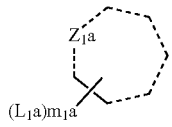

In the formula (11), $Z_1a$ represents a group to form a hetero ring containing one or two hetero atoms. The hetero ring formed with $Z_1a$ is preferably a 5- or 6-membered ring. $L_1a$ represents a substituent. $m_1a$ represents an integer of not less than 1 but not more than a maximum substitutable number to the hetero ring. When $m_1a$ is 2 or more, a plurality of $L_1a$'s may be the same or different, and they may bond together to form a ring. The compound represented by the formula (11) has at least one dissociative group, preferably two or more dissociative groups.

Among the compounds represented by the formula (11), those represented by formula (12) set forth below are more preferable.

General formula (12)

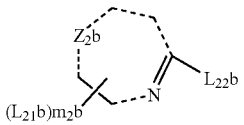

In the formula (12), $Z_2b$ represents a group to form a hetero ring containing one or two hetero atoms including the nitrogen atom in the formula. $L_{21}b$ and $L_{22}b$ each represent a hydrogen atom or a substituent. $m_2b$ represents an integer of not less than 0 but not more than a maximum substitutable number to the hetero ring. When $m_2b$ is 2 or more, a plurality of $L_{21}b$'s may be the same or different and they may bond together to form a ring. The compound represented by the formula (12) has at least 1, preferably 2 or more dissociative groups at $L_{21}b$ or $L_{22}b$.

The compounds represented by the formula (12) are more preferably represented by general formula (13) set forth below.

General formula (13)

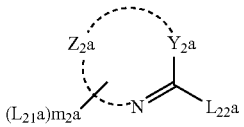

In the formula (13) $Z_2a$ represents a group to form a hetero ring containing one or two hetero atoms including the nitrogen atom and $Y_2a$ in the formula. $Y_2a$ represents a carbon atom, nitrogen atom or sulfur atom. $L_{21}a$, $L_{22}a$ and $m_2a$ have the same meaning as $L_{21}b$, $L_{22}b$ and $m_2b$ of the formula (12), respectively. At least one of $L_{21}a$ and $L_{22}a$ has a dissociative group. The sum of the dissociative groups is preferably two or more.

The compounds represented by the formula (13) are especially preferably those represented by formula (14), formula (15) or formula (16) set forth below. Every compound represented by the formula (14), formula (15) or formula (15) has at least one dissociative group, preferably two or more dissociative groups.

General formula (14)

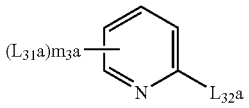

In the formula (14), $L_{31}a$, $L_{32}a$ and $m_3a$ have the same meaning as $L_{21}b$, $L_{22}b$ and $m_2b$ of the formula (12), respectively.

General formula (15)

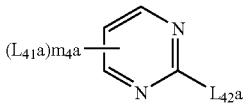

In the formula (15), $L_{41}a$, $L_{42}a$ and $m_4a$ have the same meaning as $L_{21}b$, $L_{22}b$ and $m_2b$ of the formula (12), respectively.

General formula (16)

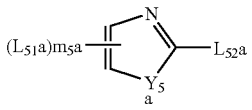

In the formula (16), $Y_5a$ represents a nitrogen atom or sulfur atom, and $L_{51}a$, $L_{52}a$ and $m_5a$ have the same meaning as $L_{21}b$, $L_{22}b$ and $m_2b$ of the formula (12), respectively.

General formula (21)

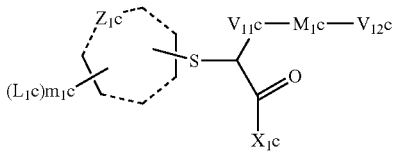

In the formula (21), $Z_1c$ represent a group to form a hetero ring containing one or two hetero atoms. $L_1c$ represents a hydrogen atom or substituent. $m_1c$ represent an integer of not less than 0 but not more than a maximum substitutable number to the hetero ring. When $m_1c$ is 2 or more, a plurality of $L_1c$'s may be the same or different, and they may bond together to form a ring. $X_1c$ represents S-$Va_1$, O-$Vb_1$ or N($Vc_1$)($Vd_1$), wherein $Va_1$, $Vb_1$, $Vc_1$, and $Vd_1$ each represent a hydrogen atom or substituent. When $Va_1$, $Vb_1$, $Vc_1$, or $Vd_1$ represents a hydrogen atom, this hydrogen atom may dissociate to make $X_1c$ charge negatively. $V_{11}c$ represents a linking group. $V_{12}c$ represents a substituent. $M_1c$ represents a sulfur atom or oxygen atom.

Among the compounds represented by the formula (21), those represented by formula (22) set forth below are more preferable.

General formula (22)

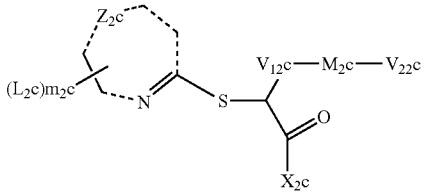

In the formula (22) $Z_2c$ represents a group to form a hetero ring containing one or two hetero atoms including the nitrogen atom in the formula. $L_2c$, $m_2c$, $X_2c$, $V_{21}c$, $V_{22}c$, and $M_2c$ have the same meaning as $L_1c$, $m_1c$, $X_1c$, $V_{11}c$, $V_{12}c$, and $M_1c$ of the formula (21), respectively.

The compounds represented by the formulas (11) to (16) will be described in detail.

In the formula (11), the hetero ring containing one or two hetero atoms formed by $Z_1a$ has the same meaning as $Z_1$ mentioned above, and those preferable as $Z_1$ are also preferable.

$L_1a$ has the same meaning as W mentioned above.

Preferable $L_1a$ are a halogen atom, alkyl group, aryl group, heterocyclic group, cyano group, hydroxyl group, nitro group, carboxyl group, alkoxy group, aryloxy group, heterocyclic oxy group, acyloxy group, carbamoyloxy group, amino group, ammonio group, acylamino group, aminocarbonylamino group, alkoxycarbonylamino group, sulfamoylamino group, alkyl- and aryl-sulfonylamino groups, mercapto group, alkylthio group, arylthio group, heterocyclic thio group, sulfamoyl group, alkyl- and aryl-sulfonyl groups, acyl group, alkoxycarbonyl group, carbamoyl group, imido group, hydrazino group, and ureido group. More preferable $L_1a$ are a halogen atom, alkyl group, aryl group, hydroxyl group, carboxyl group, alkoxy group, amino group, acylamino group, aminocarbonylamino group, alkoxycarbonylamino group, alkyl- and arylsulfonylamino groups, alkylthio group, arylthio group, sulfamoyl group, acyl group, alkoxycarbonyl group, carbamoyl group, and hydrazino group.

The dissociative group included in $L_1a$ may be any one, but preferable examples are carboxyl group, —$CONHSO_2$— group (a sulfonylcarbamoyl group, a carbonylsulfamoyl group), —CONHCO— group (a carbonylcarbamoyl group), and —$SO_2NHSO_2$— group (a sulfonylsulfamoyl group), —$NHCONHSO_2$— group (a carbamoylsulfamoyl grop, a sulfonylureido group), —$NHSO_2$— group (a sulfonamido group, a sulfamoyl group), and phenolic hydroxyl group. The dissociative group is more preferably a carboxyl group, —$CONHSO_2$— group, —$NHCONHSO_2$— group, or —$NHSO_2$— group, and especially preferably a carboxyl group, or —$NHSO_2$— group. When the compound represented by the formula (11) has two or more dissociative groups, the two or more dissociative groups preferably include a combination of two carboxyl groups, or a combination of a carboxyl group and —$NHSO_2$— group. The number of the dissociative groups in the compound represented by the formula (11) is preferably 2 to 4.

In the formula (11), $m_1a$ is preferably an integer of 1 to 5. When $m_1a$ is 2 or more and a plurality of $L_1a$'s form a ring, example of the ring is a 5- or 6-membered, aromatic or nonaromatic, carbon ring or hetero ring. Examples of the cyclic structure (polycyclic ring) thus formed are those mentioned above as examples of the representative hetero rings.

In the formula (12), the hetero rings containing one or two hetero atoms including the nitrogen atom in the formula formed by $Z_2b$ are those mentioned above as examples of the representative hetero rings formed by $Z_1$.

$L_{21}b$ and $L_{22}b$ each represent a hydrogen atom or substituent, wherein the substituent has the same meaning as $L_1a$. At least one of $L_{21}b$ and $L_{22}b$, or both $L_{21}b$ and $L_{22}b$ have a dissociative group. The total sum of the dissociative groups are preferable 2 to 4.

$m_2b$ is preferably an integer of 0 to 4.

In the formula (13), the hetero rings containing one or two hetero atoms including the nitrogen atom and $Y_2a$ in the formula formed by $Z_2a$ are those mentioned above as examples of the representative hetero rings formed by $Z_1$. Among the hetero rings, those of (a-1) to (a-4), and (b-25) are preferable, and those of (a-3), (a-4), and (b-25) are more preferable.

$L_{21}a$ and $L_{22}a$ each represent a hydrogen atom or substituent, wherein the substituent has the same meaning as $L_{21}b$ and $L_{22}b$, respectively.

$m_2a$ preferable is an integer of 0 to 2.

In the formula (14), at least one of $L_{31}a$ and $L_{32}a$ preferably represents a —$NHSO_2$-$L_{33}a$ group. $L_{33}a$ has the same meaning as $L_1a$.

$m_3a$ is preferably an integer of 0 to 3.

In the formula (15), at least one of $L_{41}a$ and $L_{42}a$ represents preferably —$NHSO_2$-$L_{43}a$. $L_{43}a$ has the same meaning as $L_1a$.

$m_4a$ preferable is an integer of 0 to 2.

In the formula (16), $L_{52}a$ is preferably a substituent represented by formula (16-a) set forth below.

General formula (16-a)

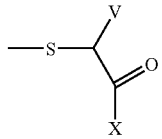

In the formula (16-a), X represents S-Va, O-Vb or N(Vc)(Vd), wherein Va, Vb, Vc, and Vd have the same meaning as $Va_1$, $Vb_1$, $Vc_1$, and $Vd_1$ of the formula (21), respectively. V represents a substituent.

X is preferably an oxygen atom. The substituents represented by Va, Vb, Vc, and Vd are those mentioned above as $L_1a$. At least one selected from the group represented by Va, the group represented by Vb, and the groups represented by Vc and Vd is preferably a hydrogen atom (or the hydrogen atom is dissociated).

Examples of the substituent represented by V are those mentioned above as $L_1a$. V is preferably an alkyl group, aryl group, alkoxy group, or aryloxy group, more preferably an alkyl group, alkoxy group, or aryl group, and especially preferably an alkyl group.

$m_5a$ is preferably an integer from 0 to 2.

The general formulas (21) and (22) will be described in detail.

In the formula (21), the hetero ring containing one or two hetero atoms formed by $Z_1c$ has the same meaning as $Z_1$ mentioned above, and those preferable as $Z_1$ are also preferable.

The substituent represented by $L_1c$ has the same meaning as W mentioned above, and those preferable as $L_1a$ are also preferable.

$m_1c$ is preferable an integer of 0 to 5. When $m_1c$ is 2 or more and a plurality of $L_1c$'s form a ring, example of the ring is a 5- or 6-membered, aromatic or nonaromatic, carbon ring or hetero ring. Examples of the cyclic structure thus formed are those mentioned above as examples of the representative hetero rings.

$X_1c$ is preferably an oxygen atom. Examples of the substituents represented by $Va_1$, $Vb_1$, $Vc_1$, and $Vd_1$ are those shown above as $L_1c$. At least one selected from the group represented by $Va_1$, the group represented by $Vb_1$, and the groups represented by $Vc_1$ and $Vd_1$ is preferably a hydrogen atom (or the hydrogen atom is dissociated).

$V_{11}c$ represents a linking group connecting the carbon atom and $M_1c$. As examples of the linking group, a single bond, and an alkylene group, arylene group, polyvalent heterocyclic group, —O—, —S—, —$NR_{L1}$— (wherein $R_{L11}$ represents a hydrogen atom, or a substituted or unsubstituted aryl group or alkyl group having 1 to 10 carbon atoms), —CO—, —$SO_2$— and so on alone, and groups formed by combination of any two or more of these groups can be mentioned. Preferable examples of the linking group are an alkylene group, arylene group (especially a phenylene group is preferable), —O—, —S—, —$NR_{L1}$—, —CO—, —$SO_2$— and so on alone, and groups formed by combination of any two or more of these groups. More preferable examples of the linking group are an alkylene group, arylene group (especially a phenylene group is preferable), —O— and —S— alone, and groups formed by combination of any two or more of these groups. Especially preferable linking group is an alkylene group.

Examples of the substituent represented by $V_{12}c$ are those mentioned above as $L_1c$.

Preferably, the substituent represented by $V_{12}c$ is an alkyl group, aryl group, heterocyclic group, cyano group, hydroxyl group, nitro group, carboxyl group, alkoxy group, aryloxy group, heterocyclic oxy group, acyloxy group, carbamoyloxy group, acylamino group, aminocarbonylamino group, alkoxycarbonylamino group, sulfamoylamino group, alkyl- and aryl-sulfonylamino groups, alkylthio group, arylthio group, heterocyclic thio group, sulfamoyl group, alkyl- and aryl-sufonyl groups, acyl group, alkoxycarbonyl group, carbamoyl group, imido group, or ureido group. Preferable substituent represented by $V_{12}c$ is an alkyl group, aryl group, heterocyclic group, hydroxyl group, carboxyl group, alkoxy group, acylamino group, aminocarbonylamino group, alkoxycarbonylamino group, alkyl- and aryl-sulfonylamino groups, alkylthio group, arylthio group, sulfamoyl group, acyl group, alkoxycarbonyl group, or carbamoyl group. More preferable substituent represented by $V_{12}c$ is an alkyl group, aryl group, or heterocyclic group.

When $M_1c$ is a sulfur atom, $V_{12}c$ is most preferably an alkyl group (preferably an alkyl group having 6 to 20 carbon atoms), or heterocyclic group (preferably a 5- or 6-membered aromatic heterocyclic group having 3 to 20 carbon atoms). When $M_1c$ is an oxygen atom, $V_{12}c$ is most preferably an aryl group (preferably a substituted or unsubstituted aryl group having 6 to 20 carbon atoms).

Although there is no specific limitation of the total sum of the carbon atoms of these substituents, preferably, the total sum is 3 to 60, more preferably 3 to 57, especially preferably 5 to 55, and most preferably 5 to 53.

In the formula (22), the hetero ring containing one or two hetero atoms including the nitrogen atom in the formula formed by $Z_2c$ is preferably one of (a-1) to (a-4), and (b-25) mentioned above, and more preferably (a-3), (a-4) or (b-25).

$L_2c$, $m_2c$, $X_2c$, $V_{21}c$, $V_{22}c$, $M_2c$ have the same meaning as $L_1c$, $m_1c$, $X_1c$, $V_{11}c$, $V_{12}c$, $M_1c$ of the formula (21), respectively, and preferable ones are also the same.

The compounds represented by formula (I), formula (11) and formula (12) are preferable when those are suitable for the fixation methods (1) to (7) described above, more preferably for the method of (1), (2) or (3), particularly preferably for the method of (1) or (2), and most preferably for the simultaneous use of the methods (1) and (2). That is, compounds which have both a specific pKa and a ballast group are most preferably used.

The compound of the present invention may contain a necessary number of cations or anions when they are necessary for neutralizing the charge of the compound of the present invention. As representative cations, there can be mentioned inorganic cations such as a hydrogen ion ($H^+$), alkali metal ions (e.g., sodium ion, potassium ion and lithium ion) and alkaline earth metal ions (e.g., calcium ion); and organic ions such as ammonium ions (e.g., ammonium ion, tetraalkylammonium ion, triethylammonium ion, pyridinium ion, ethylpyridinium ion and 1,8-diazabicyclo [5.4.0]-7-undecenium ion). The anions can be inorganic anions or organic anions. As such, there can be mentioned halide anions (e.g., fluoride ion, chloride ion and iodide ion), substituted arylsulfonate ions (e.g., p-toluenesulfonate ion and p-chlorobenzenesulfonate ion), aryldisulfonate ions (e.g., 1,3-benzenedisulfonate ion, 1,5-naphthalenedisulfonate ion and 2,6-naphthalenedisulfonate ion), alkylsulfate ions (e.g., methylsulfate ion), sulfate ion, thiocyanate ion, perchlorate ion, tetrafluoroborate ion, picrate ion, acetate ion and trifluoromethanesulfonate ion. Moreover, it is also possible to use ionic polymers or other dyes carrying charges opposite to those of the foregoing dyes. $CO_2$— and $SO_3$— may be indicated as $CO_2H$ and $SO_3H$, respectively, in case where they have a hydrogen ion as their counter ion.

Preferable compounds of the present invention are combinations of preferable ones mentioned above, particularly, combinations of the most preferable ones.

The following are particularly preferable specific examples selected from the compounds of the present invention described in detail in the section of "Detailed Description of the Invention". The present invention, of course, is not restricted thereto.

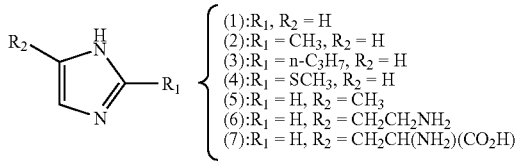

(8)

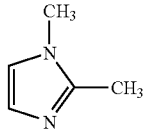

(9)

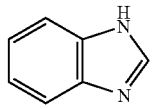

(10)

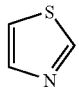

(11)

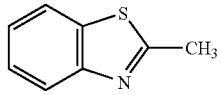

(12)

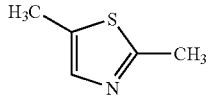

(13)

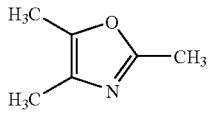

(14)

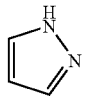

(15)

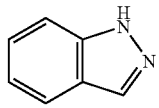

(16)

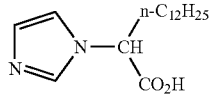

-continued
(17)
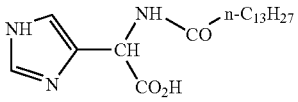
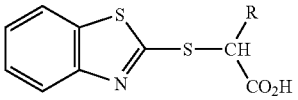
(18):R = n-$C_{12}H_{25}$
(19):R = n-$C_{16}H_{33}$
(20)
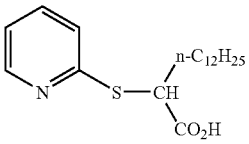
(21)
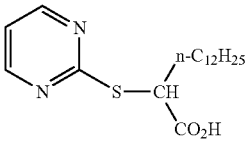
A1-1
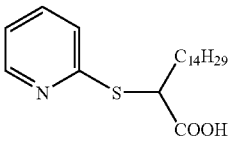
A1-2
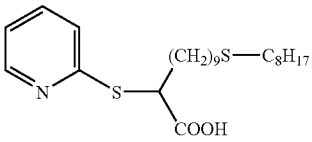
A1-3
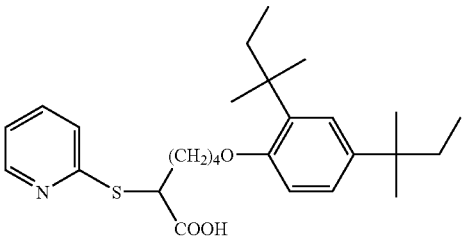
A1-4
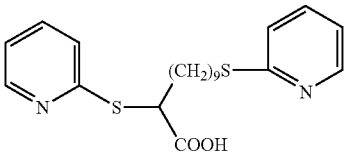
A1-5
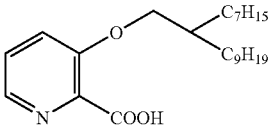
A1-6
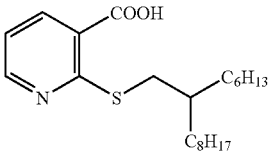
-continued
A1-7
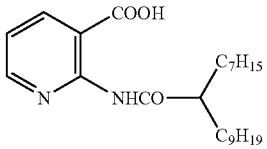
A1-8
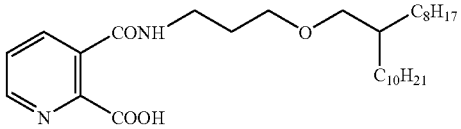
A1-9
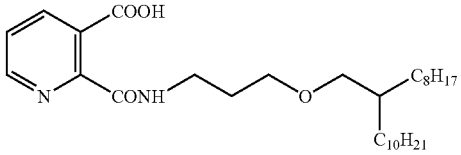
A1-10
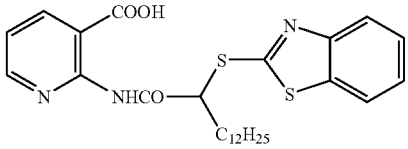
A1-11
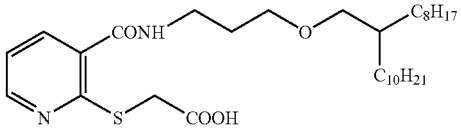
A1-12
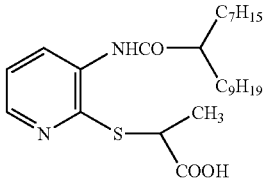
A1-13
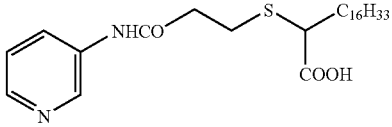
A1-14
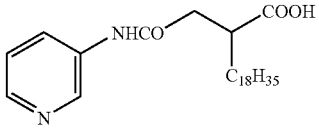
A1-15
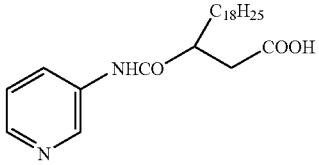
A1-16
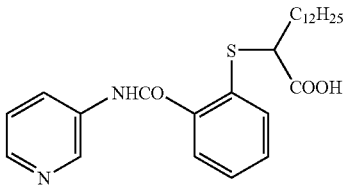

-continued
A1-17
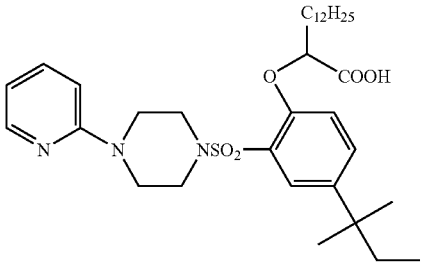
A1-18
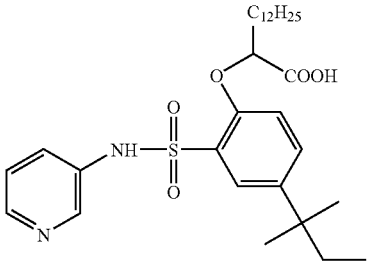
A1-19
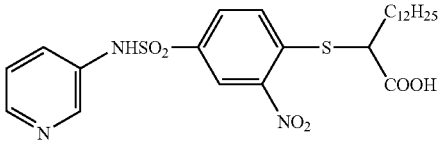
A1-20
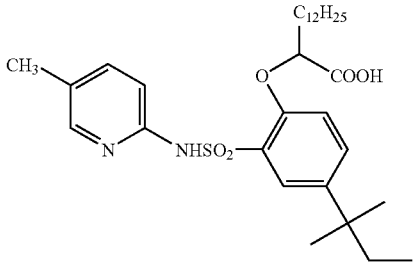
B1-1
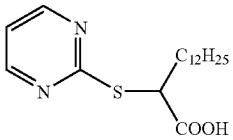
B1-2
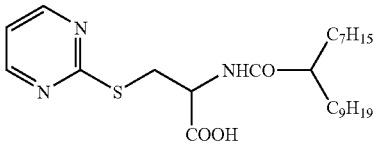
B1-3
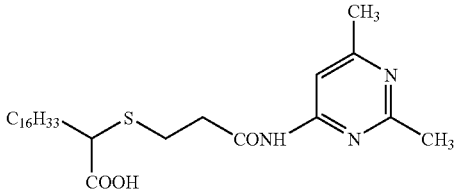
-continued
B1-4
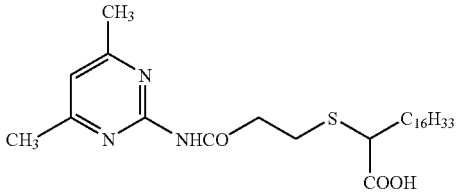
B1-5
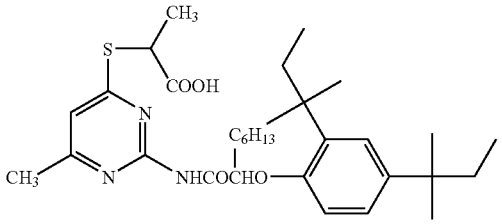
B1-6
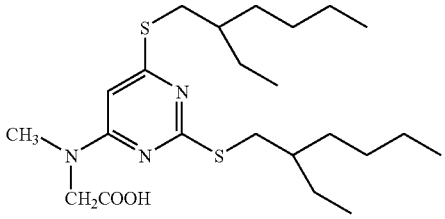
B1-7
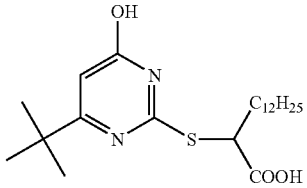
B1-8
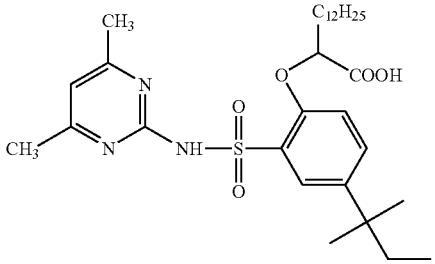
C1-1
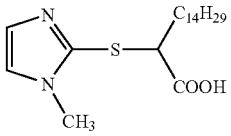
C1-2
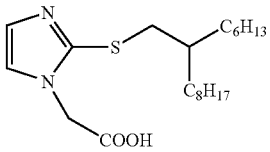

-continued
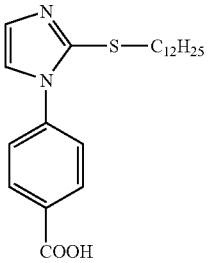
C1-3
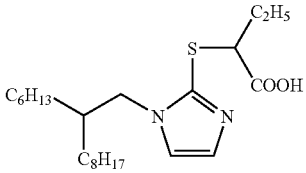
C1-4
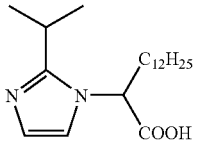
C1-5
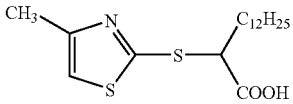
C1-6
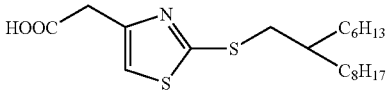
C1-7
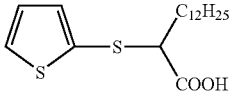
C1-8
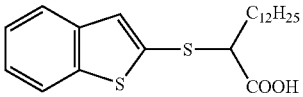
C1-9
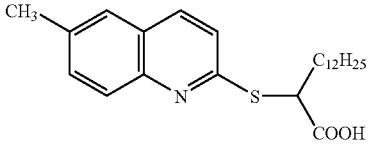
C1-10
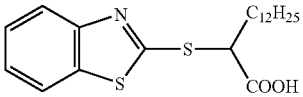
D1-1
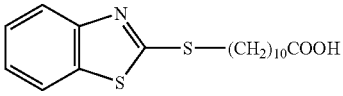
D1-2
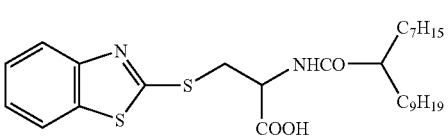
D1-3
-continued
D1-4
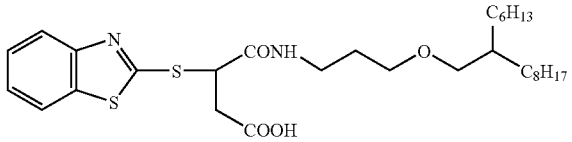
D1-5
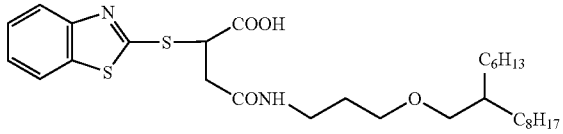
D1-6
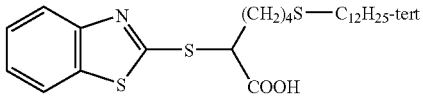
D1-7
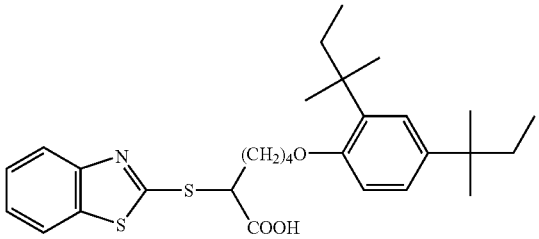
D1-8
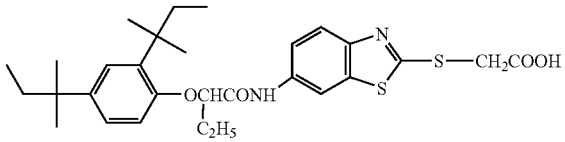
D1-9
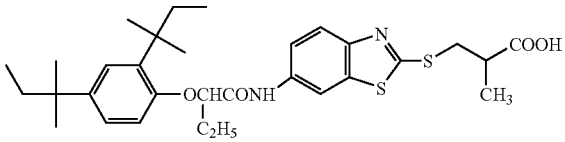
D1-10
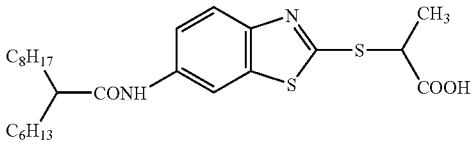
D1-11
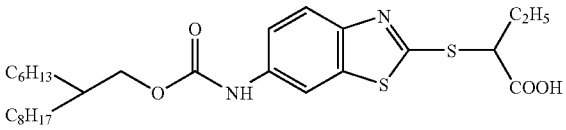
D1-12
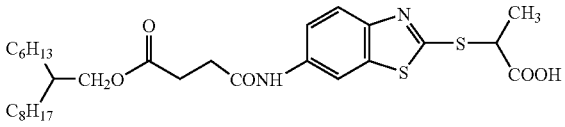

-continued
D1-13
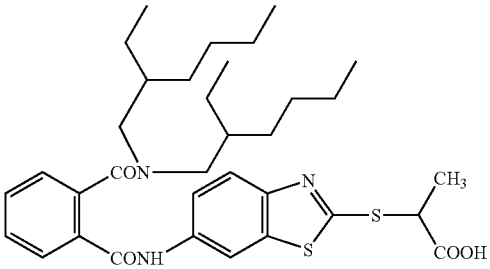
D1-14
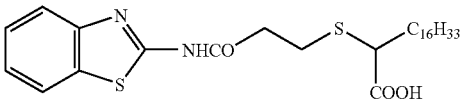
D1-15
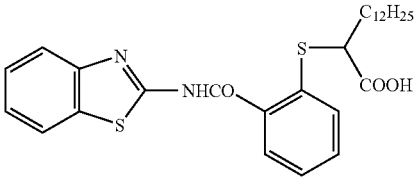
D1-16
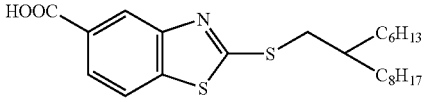
D1-17
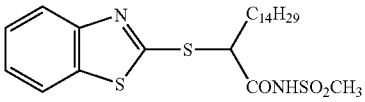
D1-18
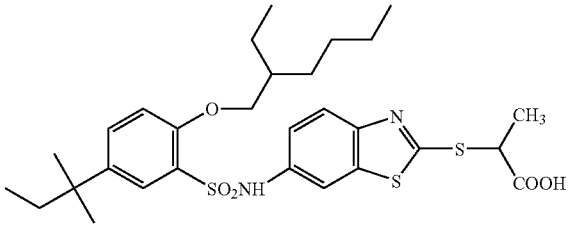
D1-19
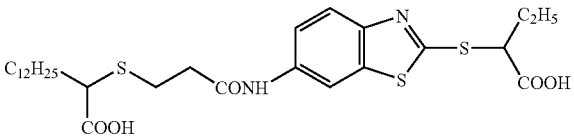
A2-1
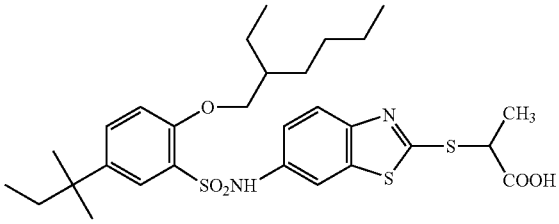
-continued
A2-2
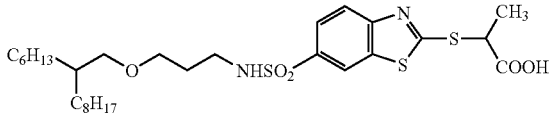
A2-3
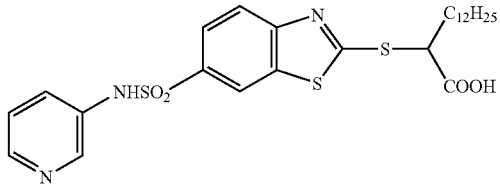
A2-4
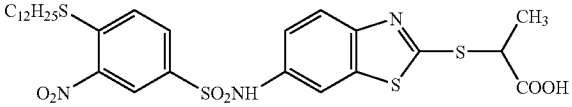
A2-5
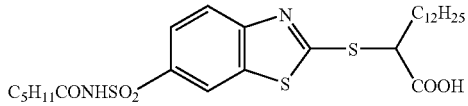
A2-6
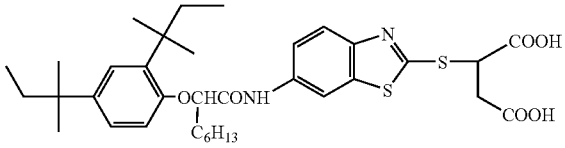
A2-7
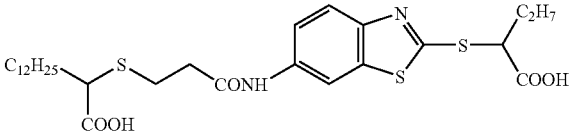
A2-8
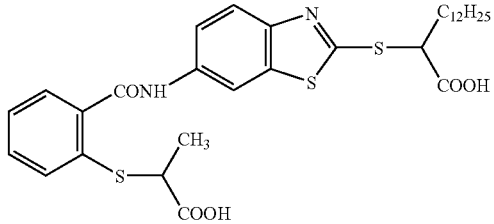
A2-9
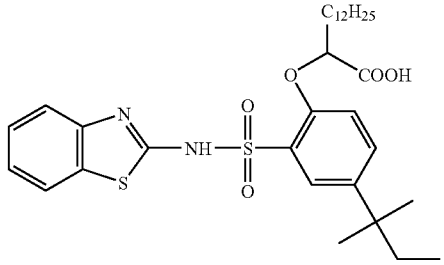
A2-10
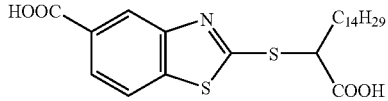

-continued
B2-1
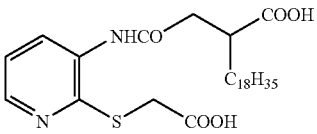
B2-2
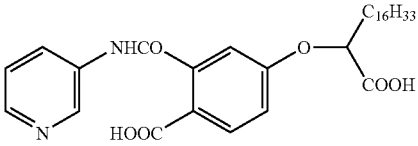
B2-3
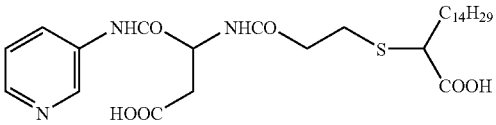
B2-4
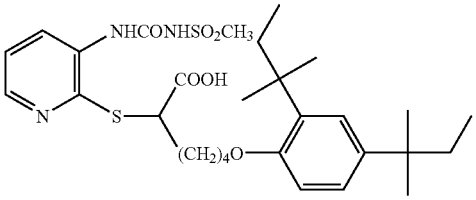
B2-5
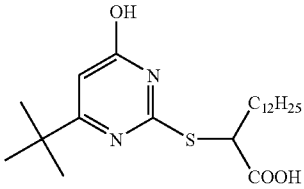
B2-6
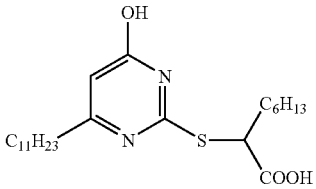
B2-7
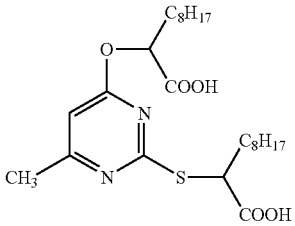
B2-8
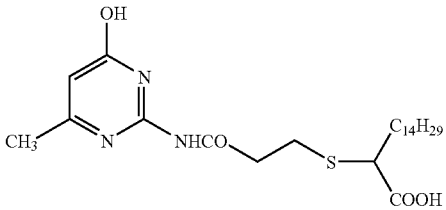
-continued
C2-1
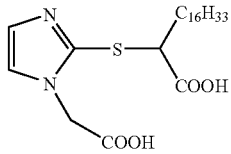
C2-2
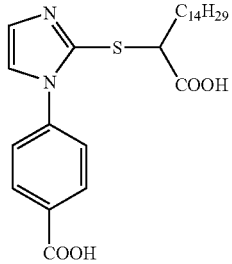
C2-3
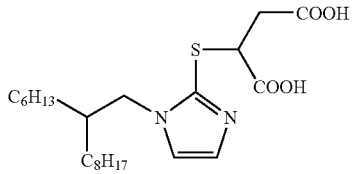
C2-4
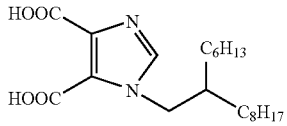
C2-5
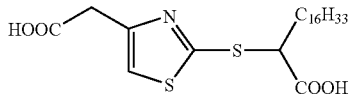
D-Ar Ar:
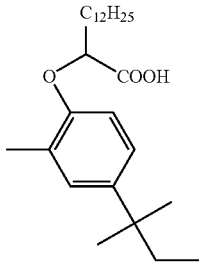
| No. | D-Ar |
|---|---|
| D2-1 | 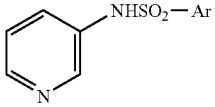 |
| D2-2 | 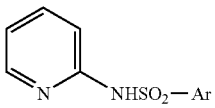 |

-continued
D-Ar Ar:
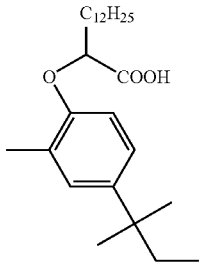
| No. | D-Ar |
|---|---|
| D2-3 | 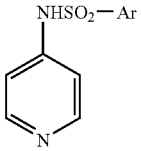 |
| D2-4 | 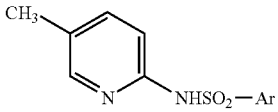 |
| D2-5 | 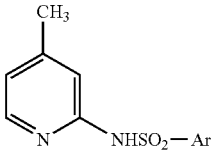 |
| D2-6 | 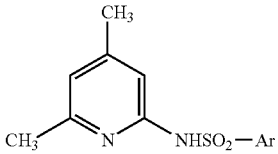 |
| D2-7 | 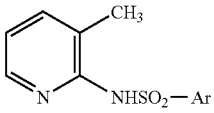 |
| D2-8 | 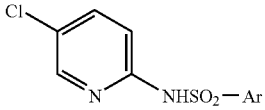 |
| D2-9 | 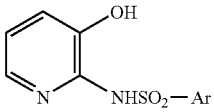 |
| D2-10 | 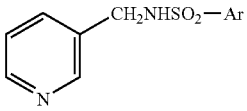 |
| D2-11 | 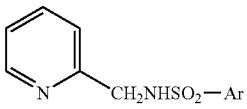 |
-continued
D-Ar Ar:
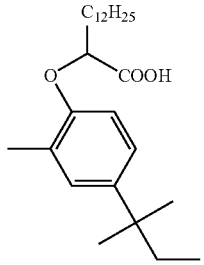
| No. | D-Ar |
|---|---|
| D2-12 | 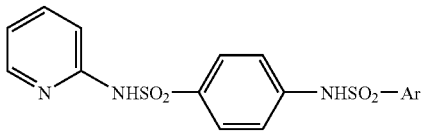 |
| D2-13 | 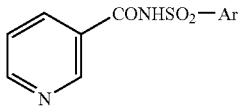 |
| D2-14 | 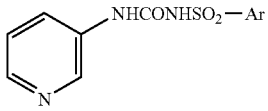 |
| D2-15 | 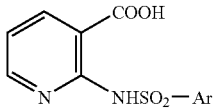 |
| D2-16 | 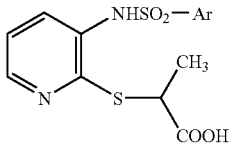 |
| D2-17 | 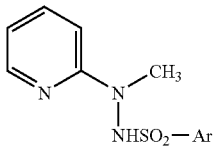 |
| D2-18 | 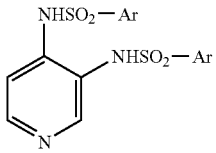 |
| D2-19 | 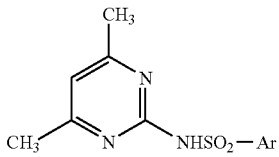 |

-continued
D-Ar Ar:
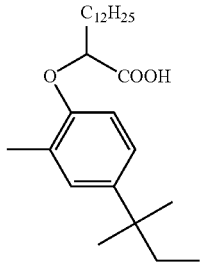
| No. | D-Ar |
|---|---|
| D2-20 | 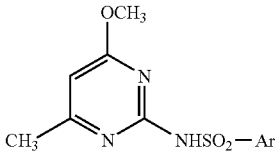 |
| D2-21 | 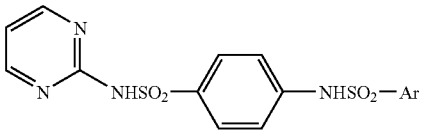 |
| D2-22 | 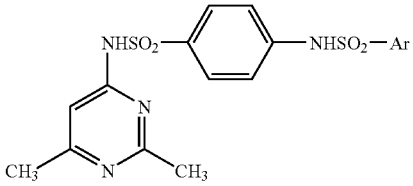 |
| D2-23 | 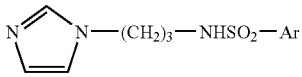 |
| D2-24 | 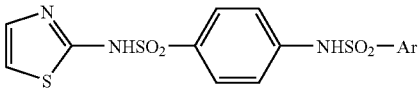 |
E-1
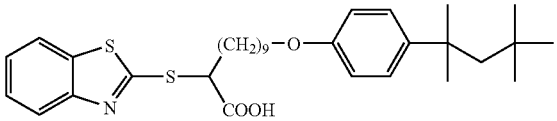
E-2
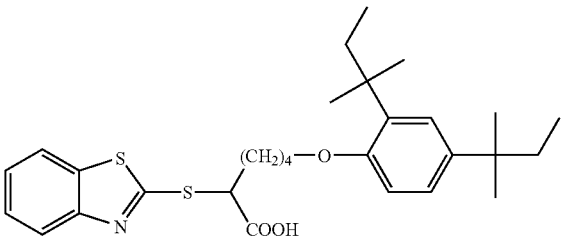
-continued
E-3
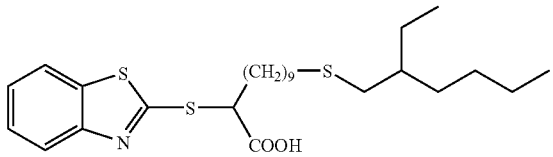
E-4
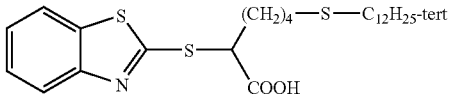
E-5
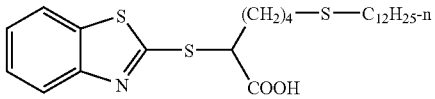
E-6
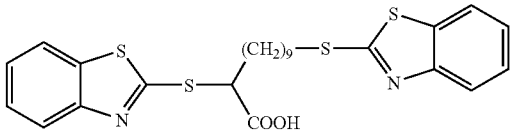
E-7
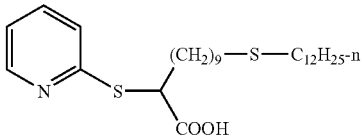
E-8
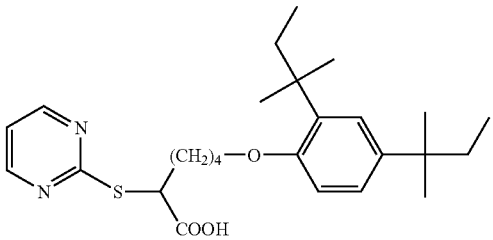
E-9
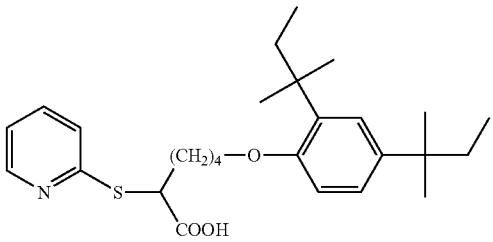
E-10
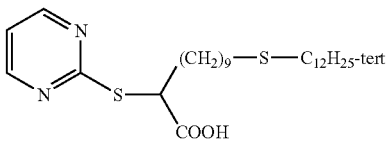
E-11
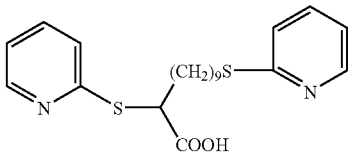

-continued

E-12

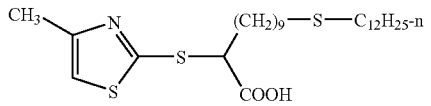

When a compound of the present invention has a plurality of asymmetric carbon atoms in the molecule, there are a plurality of stereoisomers for the same structure. In this specification, all of the possible stereoisomers are indicated. In the present invention, of the plurality of stereoisomers, only a single isomer may be used or alternatively several isomers may be used as a mixture.

It is possible to use a single kind of compound of the present invention or alternatively two or more kinds of compounds may be used. The number and kind of the compounds to be used may be chosen arbitrarily.

Of the compounds disclosed, for example, in "The Chemistry of Heterocyclic Compounds—A Series of Monographs" Vols. 1-59, edited by Edward C. Taylor and Arnold Weissberger, published by John Wiley & Sons and "Heterocyclic Compounds, Vols 1-6" edited by Robert C. Elderfield and published by John Wiley & Sons, the entire contents of which are incorporated herein by reference, compounds that meet the present invention can be used as the compounds of the present invention.

The compounds of the present invention can be synthesized by the methods described in these publications.

Synthesis Example:Synthesis of (18)

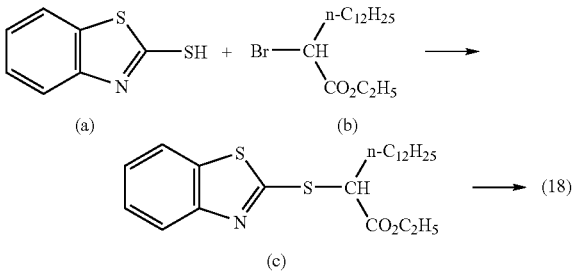

7.4 g of (a), 13.4 g of (b), 100 milliliters (the milliliter will also be referred to as "mL" hereinafter) of acetonitrile and 10 mL of dimethylacetamide were stirred at an internal temperature of 10° C. or lower under ice cooling and 6.1 mL of triethylamine was added dropwise.

After stirring for two hours at room temperature, 200 mL of ethyl acetate was added to the reaction solution. The mixture was washed and separated with a diluted aqueous NaOH solution, then with diluted hydrochloric acid, and then with a saturated brine. The resulting ethyl acetate layer was dried with magnesium sulfate. The solvent was evaporated under reduced pressure. The resulting concentrate was purified by silica gel chromatography (eluent: hexane/ethyl acetate=19:1) to obtain 16.2 g of (c) (yield 96%). After stirring 14.8 g of (c), 2.8 g of NaOH, 50 mL of ethanol and 5 mL of water at room temperature for two hours, 200 mL of water was added. The mixture was washed and separated with hexane and the hexane layer was removed. To the water layer, 200 mL of ethyl acetate and a diluted hydrochloric acid were added and separate, followed by removal of the resulting water layer. The ethyl acetate layer was further washed and separated with saturated brine. The resulting ethyl acetate layer was dried with magnesium sulfate and was concentrated under reduced pressure until the amount of the solution became 30 mL. Hexane was added to the concentrate and stirred. The resulting crystal was collected by filtration with suction. After drying, 13.2 g of colorless crystal (18) was obtained (yield: 96%) (melting point: 75-77° C.).

Synthesis Example: Synthesis of Compound (A1-7)

The compound (A1-7) may be synthesized following the scheme shown below.

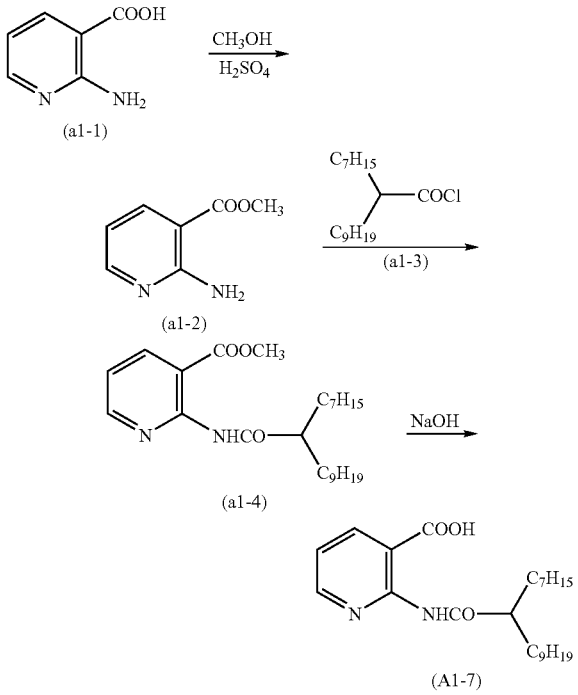

50.0 g of (a1-1) and 500 mL of methanol were stirred at room temperature, and 53 g of conc. sulfuric acid was added dropwise. After heating under reflux for 2 hr, methanol was concentrated under normal pressure. To this, 500 mL of methanol was added and heated under reflex for 2 hr, followed by concentration of methanol again under normal pressure. The mixture was cooled to room temperature, and the reaction liquid was pored into ice water. To this liquid a solution obtained by dissolving 43 g of sodium hydroxide in 500 mL of water was added and stirred. The precipitated crystal was separated by filtration with suction, followed by drying, and then 33.5 g of colorless crystal (a1-2) was obtained (yield: 61%).

7.6 g of (a1-2), 50 mL of dimethylacetamide, and 8.4 mL of triethylamine were stirred under ice cooling at an internal temperature of 0° C. or lower, and 15.1 g of (a1-3) was added dropwise. After stirring the mixture at room temperature for 5 hr, 500 mL of ethyl acetate was added, and the mixture was washed and separated with diluted hydrochloric acid, and further washed and separated with saturated brine, followed by drying the ethyl acetate layer with magnesium sulfate, and the solvent was concentrated under reduced pressure. The concentrate was purified with silica gel column chromatography (eluent:hexane:ethyl acetate=3:1) to obtain 4.8 g of (a1-4) (yield: 71%).

12.0 g of (a1-4), 100 mL of ethanol and 8.6 mL of 5N NaOH were stirred at room temperature for 2 hr. After that, 500 mL of ethyl acetate was added, and washed and separated with diluted hydrochloric acid, and further washed and separated with saturated brine, followed by drying the ethyl acetate layer with magnesium sulfate and concentrated the solvent under reduced pressure. Hexane was added to the concentrate and stirred. The precipitated crystal was separated by filtration with suction. After drying 10.7 g of colorless crystal (A1-7) was obtained (yield: 92%) (melting point: 68-70° C.)

SYNTHESIS EXAMPLE

Synthesis of Compound (B1-8)

The compound (B1-8) may be synthesized following the scheme shown below.

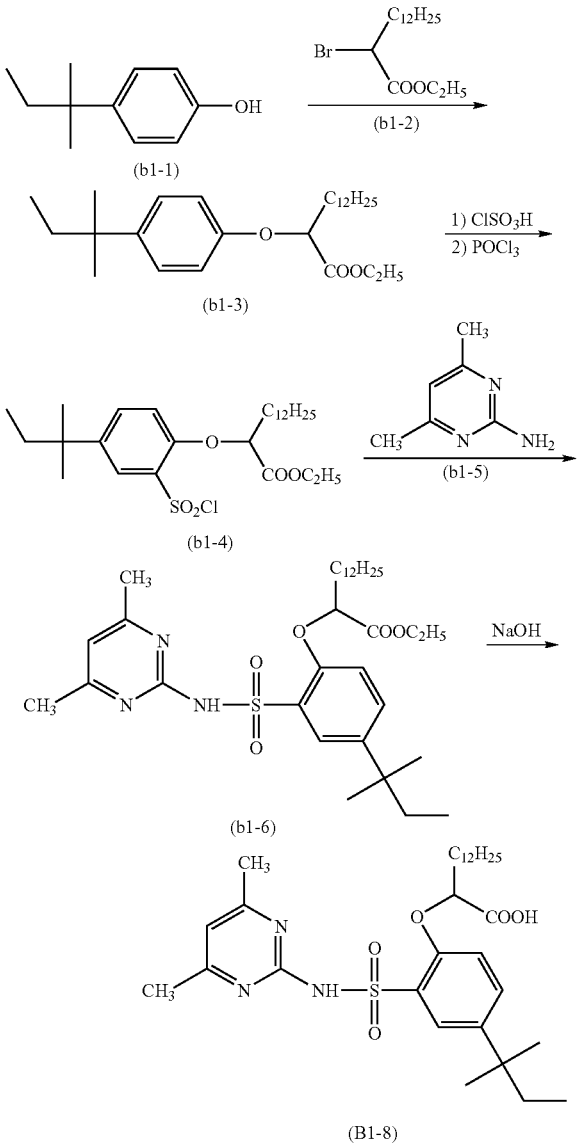

39.4 g of (b1-1), 67.1 g of (b1-2), 69.1 g of potassium carbonate, and 200 mL of dimethylformamide were heated and stirred for 6 hr. The mixture was cooled to room temperature, 1 liter of ethyl acetate was added, and washed and separated with diluted hydrochloric acid, and further washed and separated with saturated brine. The ethyl acetate layer was dried with magnesium sulfate, and the solvent was concentrated under reduced pressure. The concentrate was purified with silica gel column chromatograph (eluent:hexane:ethyl acetate=19:1), to obtain 64.6 g of (b1-3) (yield: 77%).

64.1 g of (b1-3) and 70 mL of methylene chloride were stirred under ice cooling at an internal temperature of 10° C. or lower, and 12 mL of chlorosulfonic acid was added dropwise. After stirring the mixture at room temperature for 2 hr, the mixture was further stirred under ice cooling at an internal temperature of 10° C. or lower. 100 mL of acetonitrile was added dropwise, and subsequently 50 mL of dimethylacetamide was added dropwise. Next, 35 g of phosphorus oxychloride was added drop wise to the mixture, and then heated while stirring it at 40° C. for 2 hr. The mixture was cooled to room temperature, and the reaction liquid was pored into ice water, and 1 liter of hexane was added thereto. After separating the hexane layer, it was washed and separated with saturated brine, and the hexane layer was dried with magnesium sulfate, and concentrated the solvent under reduced pressure to obtain 76.7 g of (b1-4) (yield: 97%).

15.5 g of (b1-4), 9.2 g of (b1-5), 4.9 mL of pyridine and 100 mL of acetonitrile were heated under reflex for 5 hr. The mixture was cooled to room temperature, and 500 mL of ethyl acetate was added. The mixture was washed and separated with diluted hydrochloric acid, and further washed and separated with saturated brine. The ethyl acetate layer was dried with magnesium sulfate, and the solvent was concentrated under reduced pressure. The concentrate was purified with silica gel column chromatography (eluent: hexane:ethyl acetate=3:1) to obtain 9.7 g of (b1-6) (yield: 54%).

9.0 g of (b1-6), 100 mL of ethanol and 7.5 mL of 5N NaOH were stirred at room temperature for 2 hr. After that, 500 mL of ethyl acetate was added and washed and separated with diluted hydrochloric acid, and further washed and separated with saturated brine. The ethyl acetate layer was dried with magnesium sulfate, and the solvent was concentrated under reduced pressure. Hexane was added to the concentrate, and stirred. The precipitated crystal was separated by filtration with suction, and 7.8 g of colorless crystal (B1-8) was obtained (yield: 91%) (melting point: 74-77° C.).

Synthesis Example: Synthesis of Compound (D1-10)

The compound (D1-10) may be synthesized following the scheme shown below.

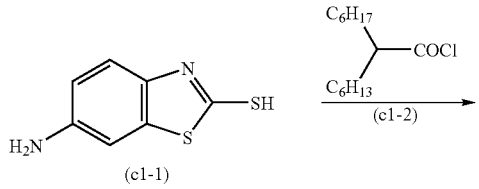

-continued

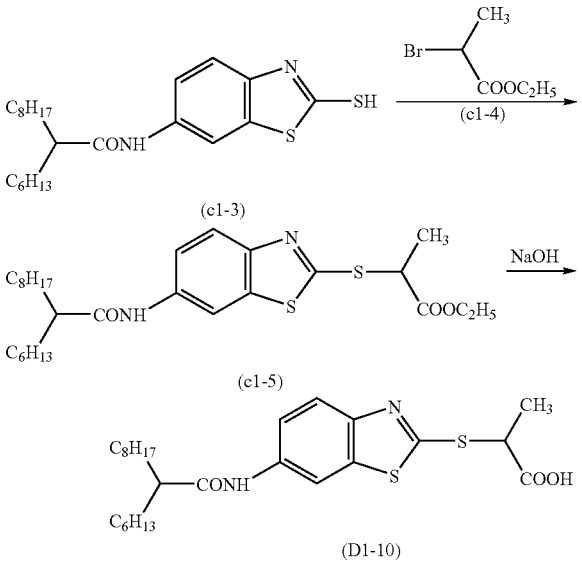

14.6 g of (c1-1) and 70 mL of dimethylacetamide were stirred with ice cooling at an internal temperature of 10° C. or lower, and 22.0 g of (c1-2) was added dropwise. After the mixture was stirred at room temperature for 6 hr, 1 liter of ethyl acetate was added, and the mixture was washed and separated with diluted hydrochloric acid, and further washed and separated with saturated brine. The ethyl acetate layer was dried with magnesium sulfate, and the solvent was concentrated under reduced pressure. Hexane was added to the concentrate and stirred. The precipitated crystal was separated by filtration with suction. After drying 26.7 g of colorless crystal (c1-3) was obtained (yield 79%).

13.5 g of (c1-3), 6.4 g of (c1-4) and 50 mL of dimethylacetamide were stirred with ice cooling at an internal temperature of 10° C. or lower. 4.9 mL of triethylamine was added dropwise. After the mixture was stirred at room temperature for 6 hr, 500 mL of ethyl acetate was added, and the mixture was washed and separated with diluted hydrochloric acid, and further washed and separated with saturated brine. The ethyl acetate layer was dried with magnesium sulfate, and the solvent was concentrated under reduced pressure. The concentrate was purified with silica gel column chromatography (eluent:hexane:ethyl acetate=9:1), to obtain 15.7 g of (c1-5) (yield: 94%).

14.7 g of (c1-5), 100 mL of ethanol and 8.5 mL of 5N NaOH were stirred at room temperature for 2 hr. 500 mL of ethyl acetate was added and the mixture was washed and separated with diluted hydrochloric acid, and further washed and separated with saturated brine. The ethyl acetate layer was dried with magnesium sulfate, and concentrated under reduced pressure. Hexane was added to the concentrate and stirred. The precipitated crystal was separated by filtration with suction. After drying, 12.9 g of colorless crystal (D1-10) was obtained (yield: 93%) (melting point 98-99° C.).

SYNTHESIS EXAMPLE

Synthesis of Compound (D2-1)

The compound (D2-1) may be synthesized following the scheme shown below.

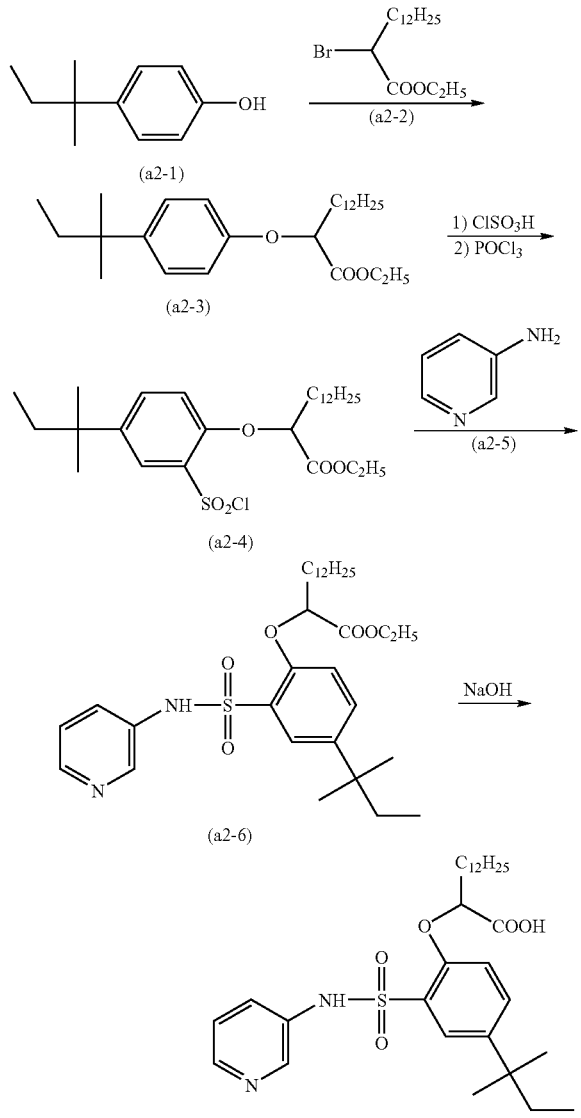

39.4 g of (a2-1), 67.1 g of (a2-2), 69.1 g of potassium carbonate, and 200 mL of dimethylformamide were heated with stirring at 100° C. for 6 hr. The mixture was cooled to room temperature, and 1 liter of ethyl acetate was added. The mixture was washed and separated with diluted hydrochloric acid, and further washed and separated with saturated brine. The ethyl acetate layer was dried with magnesium sulfate, and the solvent was concentrated under reduced pressure. The concentrate was purified with silica gel column chromatograph (eluent:hexane:ethyl acetate=19:1), to obtain 64.6 g of (a2-3) (yield: 77%).

64.1 g of (a2-3) and 70 mL of methylene chloride were stirred under ice cooling at an internal temperature of 10° C. or lower. 12 mL of chlorosulfonic acid was added dropwise. After the mixture was stirred at room temperature for 2 hr, the mixture was further stirred under ice cooling at an internal temperature of 10° C. or lower. 100 mL of acetonitrile was added dropwise, and subsequently 50 mL of dimethylacetamide was added. Next, 35 g of phosphorous oxychloride was added dropwise at room temperature, and the mixture was heated while stirring at 40° C. for 2 hr. The mixture was cooled to room temperature, and the reaction liquid was pored into ice water. 1 liter of hexane was added thereto. After the hexane layer was separated, the layer was washed and separated with saturated brine. The hexane layer was dried with magnesium sulfate, and the solvent was concentrated under reduced pressure to obtain 76.6 g of (a2-4) (yield 97%).

4.2 g of (a2-5), 4.9 mL of pyridine and 100 mL of acetonitrile were stirred under ice cooling at an internal temperature of 0° C. or lower, and 15.5 g of (a2-4) was added dropwise. After stirring the mixture at room temperature for 6 hr, 1 liter of ethyl acetate was added, and washed and separated with diluted hydrochloric acid, and further washed and separated with saturated brine. The ethyl acetate layer was dried with magnesium sulfate, and the solvent was concentrated under reduced pressure. The concentrate was purified with silica gel column chromatography (eluent: hexane:ethyl acetate=7:3), to obtain 16.6 g of (a2-6) (yield: 96%).

15.8 g of (a2-6), 2.8 g of NaOH, 100 mL of ethanol, and 15 mL of water were stirred at room temperature for 2 hr. After that, 500 mL of ethyl acetate was added, and washed and separated with diluted hydrochloric acid, and further washed and separated with saturated brine. The ethyl acetate layer was dried with magnesium sulfate, and the solvent was concentrated under reduced pressure. Hexane was added to the concentrate and stirred. The precipitated crystal was separated by filtration with suction, followed by drying to obtain 13.3 g of colorless crystal (D2-1) was obtained (yield: 89%) (melting point 93-95° C.).

SYNTHESIS EXAMPLE

Synthesis of Compound (D2-4)

The compound (D2-4) may be synthesized following the scheme shown below.

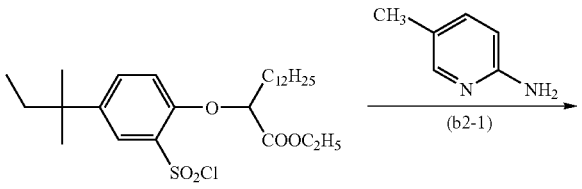

(a2-4)

-continued

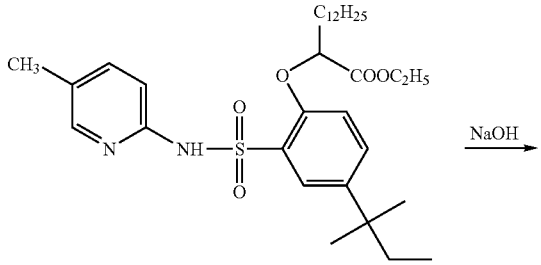

(b2-2)

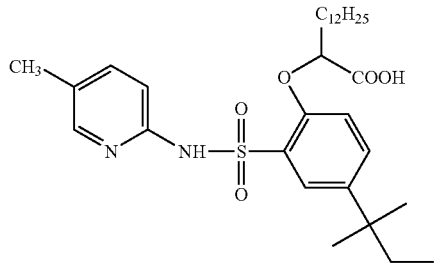

(D2-4)

3.5 g of (b2-1), 4.4 mL of pyridine and 100 mL of acetonitrile were stirred under ice cooling at an internal temperature of 0° C. or lower, and 14.0 g of (a2-4) was added dropwise. After stirring the mixture at room temperature for 6 hr, 1 liter of ethyl acetate was added, and washed and separated with diluted hydrochloric acid, and further washed and separated with saturated brine. The ethyl acetate layer was dried with magnesium sulfate, and the solvent was concentrated under reduced pressure. The concentrate was purified with silica gel column chromatography (eluent: hexane:ethyl acetate=17:3), to obtain 9.5 g of (b2-2) (yield: 60%).

9.0 g of (b2-2), 1.5 g of NaOH, 50 mL of ethanol, and 10 mL of water were stirred at room temperature for 2 hr. After that, 300 mL of ethyl acetate was added, and washed and separated with diluted hydrochloric acid, and further washed and separated with saturated brine. The ethyl acetate layer was dried with magnesium sulfate, and the solvent was concentrated under reduced pressure. Hexane was added to the concentrate and stirred. The precipitated crystal was separated by filtration with suction, followed by drying to obtain 7.2 g of colorless crystal (D2-4) was obtained (yield: 849%) (melting point 79-82° C.).

SYNTHESIS EXAMPLE

Synthesis of Compound (A2-7)

The compound (A2-7) may be synthesized following the scheme shown below.

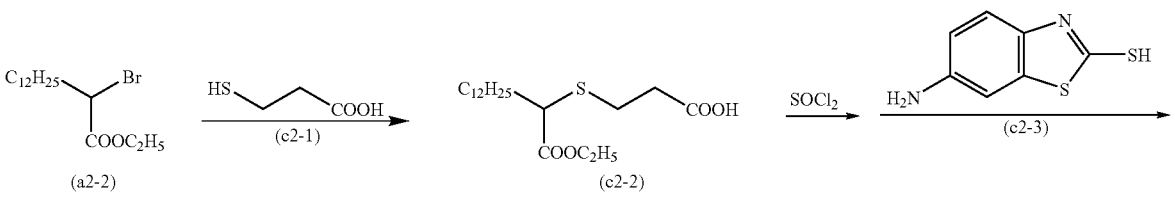

(a2-2)

(c2-2)

-continued

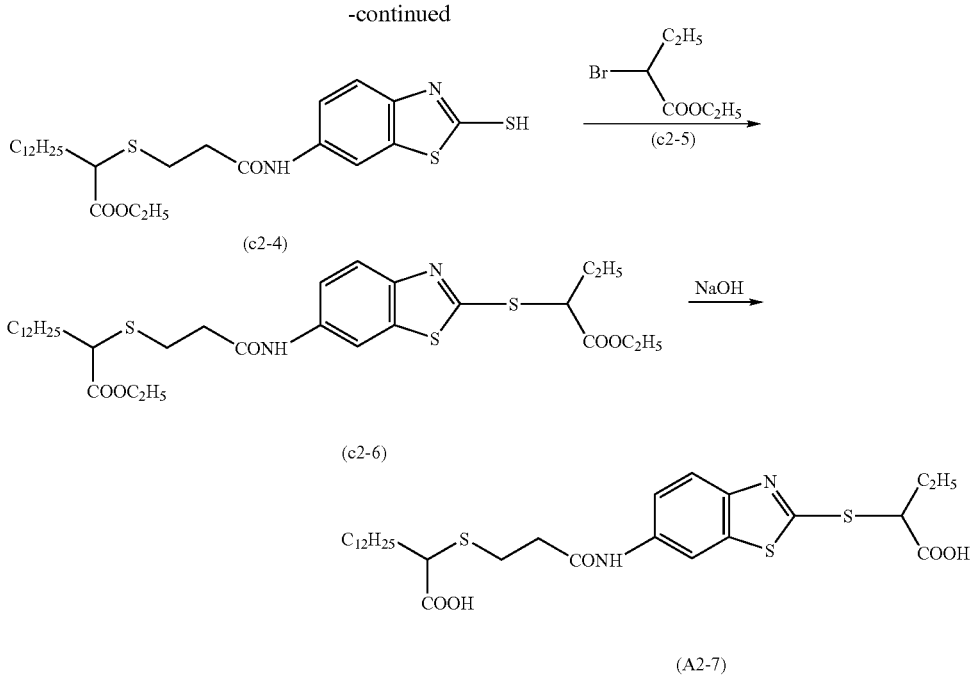

20.1 g of (a2-2), 6.4 g of (c2-1) and 50 mL of dimethylacetamide were stirred under ice cooling at an internal temperature of 10° C. or lower, and 18.4 mL of triethylamine was added dropwise. After stirring the mixture at room temperature for 6 hr, 1 liter of ethyl acetate was added, and washed and separated with diluted hydrochloric acid, and further washed and separated with saturated brine. The ethyl acetate layer was dried with magnesium sulfate, and the solvent was concentrated under reduced pressure. The concentrate was purified with silica gel column chromatography (eluent:hexane:ethyl acetate=7:3), to obtain 18.6 g of (c2-2) (yield: 86%).

18.6 g of (c2-2) and 0.05 mL of dimethylformamide were stirred at room temperature, and 5.6 mL of thionyl chloride was added dropwise. After stirring for 2 hr, the mixture was concentrated under reduced pressure. The concentrate was added dropwise to a solution obtained by stirring 9.4 g of (c2-3) and 50 mL of dimethylacetamide under ice cooling at an internal temperature of 10° C. or lower. After stirring the mixture at room temperature for 2 hr, 500 mL of ethyl acetate was added, and washed and separated with diluted hydrochloric acid, and further washed and separated with saturated brine. The ethyl acetate layer was dried with magnesium sulfate, and the solvent was concentrated under reduced pressure. Hexane was added to the concentrate, and stirred. The precipitated crystal was separated by filtration with suction, followed by drying to obtain 23.4 g of pale yellow crystal (c2-4) (yield: 86%).

23.4 g of (c2-4), 9.1 g of (c2-5) and 100 mL of dimethylacetamide were stirred under ice cooling at an internal temperature of 10° C. or lower, and 6.8 mL of triethylamine was added dropwise. After the mixture was stirred at room temperature for 6 hr, 1 liter of ethyl acetate was added, and washed and separated with diluted hydrochloric acid, and further washed and separated with saturated brine. The ethyl acetate layer was dried with magnesium sulfate, and the solvent was concentrated under reduced pressure. The concentrate was purified with silica gel column chromatography (eluent:hexane:ethyl acetate=7:3) to obtain 26.6 g of (c2-6) (yield: 92%).

26.2 g of (c2-6), 5.7 g of NaOH, 100 mL of ethanol and 20 mL of water were stirred at room temperature for 5 hr. After that, 300 mL of ethyl acetate was added, and washed and separated with diluted hydrochloric acid, and further washed and separated with saturated brine. The ethyl acetate layer was dried with magnesium sulfate, and concentrated under reduced pressure. 50 mL of hexane and 50 mL of ethyl acetate were added to the concentrate, and stirred. The precipitated crystal was separated by filtration with suction, followed by drying to obtain 20.8 g of colorless (A2-7) (yield: 87%) (melting point 95-97° C.).

SYNTHESIS EXAMPLE

Synthesis of Compound (E-3)

The compound (E-3) may be synthesized following the scheme shown below.

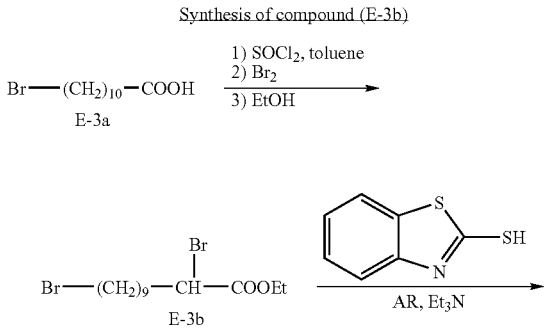

-continued

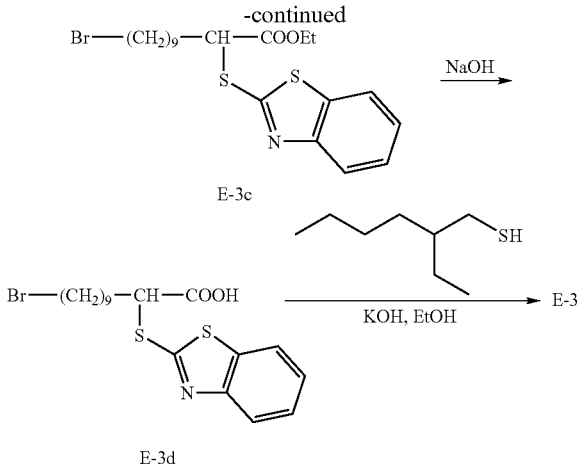

To 106 g of 11-undecanoic acid was added 43.8 g of thionyl chloride, and heated the mixture at an external temperature of 80° C. for 1.5 hr. After the residual thionyl chloride was evaporated under reduced pressure, 31 mL of bromine was added dropwise over 1 hr while heating the mixture at an external temperature of 100° C. After the termination of the dropwise addition, the mixture was further stirred at this temperature for 1 hr. After the reaction liquid was cooled with water, the liquid was slowly pored into 300 mL of stirred ethanol while cooling with iced water. After the solution was further stirred at room temperature for 2 hr, ethanol was evaporated under reduced pressure, and 800 mL of water and 500 mL of ethyl acetate were added to this mixture. The organic layer was separated in reparatory funnel, and dried with magnesium sulfate, followed by concentration. The concentrate was purified by column chromatography (silica gel 1 kg; eluent: only hexane), to obtain 87.3 g of compound (E-3b) (yield 59%).

Synthesis of Compound (E-3c)

To 20 g of compound (E-3b) was added 9.4 g of 2-mercaptobenzothiazole, 100 mL of acetonitrile, and 50 mL of dimethylacetamide, and stirred the mixture at room temperature. To the mixture was added dropwise 8.2 mL of triethylamine. After the termination of the dropwise addition, the mixture was further stirred at room temperature for 1 hr. Water was added to the reaction liquid, and extracted with ethyl acetate. The ethyl acetate layer was concentrated, and then purified by column chromatography (silica gel: 500 g; eluent:hexane:ethyl acetate=15:1) to obtain 12.6 g of compound (E-3c) (yield: 51%).

Synthesis of Compound (E-3d)

10 g of compound (E-3c) was dissolved in 150 mL of ethanol and 6.5 mL of 5M sodium hydroxide aqueous solution was added, and stirred the mixture at an external temperature of 50° C. for 1 hr. After that, 32.7 mL of 1M aqueous hydrochloric acid solution was added to neutralize the mixture. Then, the mixture was extracted with 70 mL of water and 200 mL of ethyl acetate, and concentrated and dried to obtain 9.2 g of compound (E-3d) (yield 98%).

Synthesis of Compound (E-3)

To 10 g of compound (E-3d) was added 3.5 g of 2-ethylhexylmercaptan and 50 mL of ethanol, and stirred the mixture at 0° C. To the mixture was slowly added 24 mL of 2M potassium hydroxide-ethanol solution. After the completion of the addition, the mixture was further stirred at room temperature for 1 hr. To the reaction liquid was slowly added 30 mL of water and 40 mL of hexane, and the hexane layer was removed. To the remaining water layer was added 26 mL of 1M aqueous hydrochloric acid solution and 30 mL of water, and extracted with ethyl acetate. The organic layer was washed with saturated brine, followed by drying with magnesium sulfate, and the solvent was evaporated off. The concentrate was purified with column chromatography (silica gel: 200 g; eluent:hexane:ethyl acetate=7:1), to obtain 7.1 g of pale brown liquid of compound (E-3) (yield: 62%).

The compound of the present invention may be used together with any one or more methods having an effect of increasing speed or compounds having an effect of increasing speed. The number and kind of the method to be used and the compound to be contained may be chosen arbitrarily.

For example, a compound having at least three hetero atoms which is disclosed in JP-A's-2000-194085 and 2003-156823 may be used together with the compound of the present invention.

In the present invention, it is required only that the compound of the present invention can act on a silver halide photosensitive material (preferably silver halide color photosensitive material). There is no limit, for example, on the place where the compound is added. It may be used either in a silver halide light-sensitive layer or in a non-light-sensitive layer.

When the compound is used in a silver halide light-sensitive layer and the light-sensitive layer comprises a plurality of sub-layers having different speeds, it may be contained in any layer. However, it is preferable that the compound be used in the highest speed layer.

When the compound is used in a non-light-sensitive layer, it is preferable that it be used in a no-light-sensitive layer located between a red-sensitive layer and a green-sensitive layer or that located between a green-sensitive layer and a blue-sensitive layer. The non-light-sensitive layer encompasses all layers except silver halide emulsion layers, e.g., an antihalation layer, an interlayer, a yellow filter layer and a protective layer.

The method for adding the compound of the present invention into a photosensitive material is not particularly limited. Examples thereof include a method of adding by emulsifying and dispersing the compound together with a high-boiling organic solvent or the like, a method of adding by solid dispersing, a method of adding to a coating liquid in the form of a solution (for example, adding after dissolving in water, an organic solvent such as methanol, or a mixed solvent), and a method of adding during the preparation of a silver halide emulsion. It is preferable to introduce the compound into a photosensitive material by emulsifying and dispersion or by solid dispersing. More preferred is a case where the compound is introduced into a photosensitive material by emulsifying and dispersing.

As the emulsifying and dispersing method, employed is an oil droplet-in-water dispersion method in which the compound is dissolved in a high-boiling organic solvent (a low-boiling organic solvent may be used together), the resulting solution is emulsified and dispersed in an aqueous solution of gelatin and then added to a silver halide emulsion.

An example of a high boiling point solvent used in the oil droplet-in-water dispersion method is disclosed in U.S. Pat. No. 2,322,027. Specific examples of a latex dispersion method which is a polymer dispersion method are disclosed in U.S. Pat. No. 4,199,363, German Patent (OLS) No. 2541274, JP-B-53-41091, EP's 0727703 and 0727704, and the like. Further, a dispersion method using an organic solvent-soluble polymer is disclosed in the pamphlet of PCT International Publication WO 88/723.

Examples of the high-boiling organic solvents which can be used in the oil droplet-in-water dispersion method include: phthalate esters (e.g., dibutyl phthalate, dioctyl phthalate and di-2-ethylhexyl phthalate), phosphate or phosphonate esters (e.g., triphenyl phosphate, tricresyl phosphate and tri-2-ethylhexyl phosphate), fatty esters (e.g., di-2-ethylhexyl succinate and tributyl citrate), benzoate esters (e.g., 2-ethylhexyl benzoate and dodecyl benzoate), amides (e.g., N,N-diethyldodecane amide and N,N-dimethylolein amide), alcohols or phenols (e.g., isostearyl alcohol and 2,4-di-tert-amylphenol), anilines (e.g., N,N-dibutyl-2-butoxy-5-tert-octylamine), chlorinated paraffins, hydrocarbons (e.g., dodecylbenzene and diisopropylnaphthalene), carboxylic acids (e.g., 2-(2,4-di-tert-amylphenoxy)butyric acid). Further, as an auxiliary solvent, an organic solvent whose boiling point is not lower than 30° C. but not higher than 160° C. (e.g., ethyl acetate, butyl acetate, methyl ethyl ketone, cyclohexanone, methyl cellosolve acetate and dimethyl formamide) can be used in combination with the high-boiling organic solvent. The high-boiling organic solvent is preferably used in a weight ratio of 0 to 10 times and preferably 0 to 4 times the weight of the compound of the present invention.

From the viewpoint of the improvement of the aging stability with the lapse of time during the storage in an emulsified dispersion state and the inhibition of the change of the photographic properties and the improvement of the aging stability with the lapse of time of the final composition for coating mixed with an emulsion, all or a part of the auxiliary solvent may, if necessary, be removed from the emulsified dispersion by means of reduced pressure distillation, noodle washing or ultrafiltration.

The thus-obtained lipophilic fine grain dispersion preferably has an average grain size of from 0.04 to 0.50 μm, more preferably from 0.05 to 0.30 μm, and most preferably from 0.08 to 0.20 μm. The average grain size can be measured with a Coulter submicron grain analyzer model N4 (manufactured by Coulter Electronics Ltd.).

Further, the fine solid particle dispersion methods include a method of dispersing a powder of the compound of the present invention in appropriate solvents such as water by a ball mill, a colloid mill, a vibrating ball mill, a sand mill, a jet mill or a roller mill, or by a supersonic wave to prepare solid dispersions. In that case, protective colloids (e.g., polyvinyl alcohol) and surfactants (e.g., anionic surfactants such as sodium triisopropylnaphthalenesulfonate [a mixture of three isomers different in substitution positions of isopropyl groups] may be used. In the above-mentioned mills, beads of zirconia or the like are usually employed as a dispersion medium and therefore Zr or the like eluted from the beads may contaminate the dispersion. Depending on dispersion conditions, the amount of the contaminants is generally within the range of 1 to 1000 ppm. Zr present in a photosensitive material in a content not more than 0.5 mg per gram of silver will cause no problems in practical use. The aqueous dispersion may contain preservatives (e.g., benzoisothiazolinone sodium salt).

In the present invention, for the purpose of obtaining a solid dispersion having a high S/N and a small particle size and being free of coagulation, it is possible to employ a dispersion method in which the aqueous dispersion is switched to a high speed flow, followed by pressure reduction. The dispersing apparatus and techniques used in practicing the above-described dispersion method are described in detail, for example, in Toshio KAJIUCHI and Hiromoto USUI "Dispersion System Rheology and Dispersion Technology", pp. 357-403, Shinzan-Sha Shuppan K.K. (1991) and The Society of Chemical Engineers, Japan Tokai affiliate (compiler), "Process of Chemical Engineering, No. 24", pp. 184-185, Maki SHOTEN (1990).

The amount of the compound of the present invention to be added is preferably 0.1 to 1000 mg/m$^2$, more preferably 1 to 500 mg/m$^2$, and particularly preferably 5 to 100 mg/m$^2$. When the compound is used in a light-sensitive silver halide emulsion layer, the amount of the compound per mole of silver in the same layer is preferably $1\times10^{-5}$ to 1 mol, more preferably $1\times10^{-4}$ to $1\times10^{-1}$ mol, and particularly preferably $1\times10^{-3}$ to $5\times10^{-2}$ mol. Two or more kinds of compounds of the present invention may be used together. In this case, these compounds may be added either in the same layer or in different layers.

When compound (A) of the present invention is contained in a developing solution, there is no particular limit on the amount of the compound to be added. However, it is preferably $1\times10^{-3}$ to 1 mol/L and more preferably $1\times10^{-2}$ to $1\times10^{-1}$ mol/L. The processing bath to which the compound is added is preferably a developing bath. However, it is also possible to add the compound to a bath before the developing bath to make the compound be present during the development.

The pKa of the compound of the present invention is determined by the following method. To 100 mL of a solution of 0.01 mmol of the compound of the present invention dissolved in tetrahydrofuran/water in a weight ratio of 6:4, 0.5 mL of 1N sodium chloride is added. Then, the solution is titrated with a 0.5N aqueous potassium hydroxide solution under stirring in a nitrogen gas atmosphere. The pH at the center of the inflection point of a titration curve of the amount of the aqueous potassium hydroxide solution dropped on the abscissa versus the pH value on the ordinate was defined as pKa. In the case of a compound having a plurality of dissociation sites, there are a plurality of inflection points and therefore a plurality of pKa values are determined. It is also possible to judge an inflection point by checking the change of absorption through monitoring ultraviolet/visible absorption spectrum.

As described in the foregoing section regarding the prior art, the photographic speed generally depends on the size of silver halide emulsion grains. The larger the emulsion grains, the higher the photographic speed. Since the graininess deteriorates with increase of the size of silver halide grains, the speed and the graininess have a trade-off relationship.

It is possible to increase the speed by a method, for example, of enhancing the activity of a coupler, of reducing the amount of development inhibitor-releasing coupler (DIR coupler), in addition to the above-mentioned enlargement of the size of the silver halide emulsion grains. However, enhancement of the speed using these approaches will be accompanied by deterioration in graininess. The approaches such as the change of emulsion grain size, the adjustment of coupler activity and the adjustment of the amount of DIR couplers are only "regulating means" for deteriorating the graininess while increasing the speed or improving the graininess while reducing the speed within the trade-off relationship between the speed and the graininess.

"To increase the speed" recited in claims of the present invention is not the method of increasing the speed which is accompanied by deterioration of the graininess in proportion to the increase in speed.

The method of the present invention for increasing the speed is a method of increasing the speed which method is not accompanied by deterioration in graininess or a method of increasing the speed by which method the increase in speed is greater than the deterioration in graininess. If the increase in speed and the deterioration in graininess take place simultaneously, it is necessary that a substantial increase in speed be achieved when comparing the speed while making the graininess equal by the "regulating means."

The "substantial increase in speed" is defined that the difference in speed is 0.02 or more when a photosensitive material is exposed to light through a continuous wedge and the speeds are compared using the logarithmic value of the reciprocal of an exposure amount providing (the minimum density+0.8).

In the photosensitive material of the present invention, it is preferable to contain a compound capable of undergoing a one-electron oxidation to thereby form a one-electron oxidation product thereof, wherein the one-electron oxidation product is capable of releasing one or more electrons.

The compounds whose one-electron oxidation product is capable of releasing one or more electrons are preferably those selected from the following type 1 and type 2.

(Type 1)

A compound capable of undergoing a one-electron oxidation to thereby form a one-electron oxidation product thereof, wherein the one-electron oxidation product is capable of releasing further one or more electrons accompanying a subsequent bond cleavage reaction; and (Type 2)

A compound capable of undergoing a one-electron oxidation to thereby form a one-electron oxidation product thereof, wherein the one-electron oxidation product is capable of releasing further one or more electrons accompanying a subsequent bond-forming reaction.

First, the compound of type 1 will be described.

Among the compounds of type 1, examples of the compounds capable of undergoing a one-electron oxidation to thereby form a one-electron oxidation product thereof, wherein the one-electron oxidation product is capable of releasing further one electron accompanying a subsequent bond cleavage reaction are compounds described as "one photon two electrons sensitizers" or "deprotonating electron-donating sensitizers" in the patent publications and specifications of, for example, JP-A-9-211769 (compounds PMT-1 to S-37 listed in Tables E and F on pages 28 to 32), JP-A-9-211774, JP-A-11-95355 (compounds INV 1 to 36), Japanese Patent Application KOHYO Publication 2001-500996 (compounds 1 to 74, 80 to 87 and 92 to 122), U.S. Pat. Nos. 5,747,235 and 5,747,236, EP 786692A1 (compounds INV 1 to 35), EP 893732A1 and U.S. Pat. Nos. 6,054,260 and 5,994,051, the entire contents of which are incorporated herein by reference. Preferable scopes of these compounds are the same as the preferable scopes described in the referred patent specifications.

Further, as the compound capable of undergoing a one-electron oxidation to thereby form a one-electron oxidation product thereof, wherein the one-electron oxidation product is capable of releasing further one or more electrons accompanying a subsequent bond cleavage reaction includes compounds represented by the general formula (1) (having the same meaning as the general formula (1) described in JP-A-2003-114487), the general formula (2) (having the same meaning as the general formula (2) described in JP-A-2003-114487), the general formula (3) (having the same meaning as the general formula (1) described in JP-A-2003-114488), the general formula (4) (having the same meaning as the general formula (2) described in JP-A-2003-114488), the general formula (5) (having the same meaning as the general formula (3) described in JP-A-2003-114488), the general formula (6) (having the same meaning as the general formula (1) described in JP-A-2003-75950), the general formula (7) (having the same meaning as the general formula (2) described in JP-A-2003-75950), the general formula (8) (having the same meaning as the general formula (1) described in Japanese Patent Application No. 2003-25886), and compounds represented by the general formula (9) (having the same meaning as the general formula (3) described in Japanese Patent Application No.2003-33446) included among the compounds capable of undergoing the chemical reaction of the formula (1) (having the same meaning as the chemical reaction formula (1) described in Japanese Patent Application No.2003-33446, the entire contents which disclose the compound of type a mentioned above are incorporated herein by reference. Preferable scopes of these compounds are the same as the preferable scopes described in the referred patent specifications.

General formula (1)

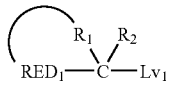

General formula (2)

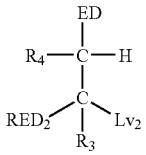

In the formulas (1) and (2), $RED_1$ and $RED_2$ each represent a reducing group. $R_1$ represents a nonmetallic atomic group capable of forming, together with carbon atom (C) and $RED_1$, a cyclic structure corresponding to a tetrahydro form, or octahydro form of a 5-membered or 6-membered aromatic ring (including an aromatic heterocycle). $R_2$, $R_3$, and $R_4$ each represents a hydrogen atom or substituent. $Lv_1$ and $Lv_2$ each represent a split-off group. ED represents an electron-donating group.

General formula (3)

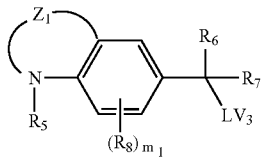

General formula (4)

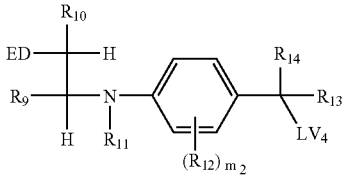

-continued

General formula (5)

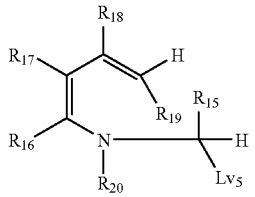

In the formulas (3), (4) and (5) $Z_1$ represents an atomic group capable of forming a 6-membered ring together with the nitrogen atom and the two carbon atoms of the benzene ring. $R_5$, $R_6$, $R_7$, $R_9$, $R_{10}$, $R_{11}$, $R_{13}$, $R_{14}$, $R_{15}$, $R_{16}$, $R_{17}$, $R_{18}$ and $R_{19}$ each represent a hydrogen atom or substituent. $R_{20}$ represents a hydrogen atom or substituent, provided that when $R_{20}$ represents a group other than an aryl group, $R_{16}$ and $R_{17}$ bond together to form an aromatic ring or aromatic hetero ring. $R_8$ and $R_{12}$ each represent a substituent capable of substituting on the benzene ring. $m_1$ represents an integer of 0 to 3, and $m_2$ represents an integer of 0 to 4. Lv3, Lv4, and Lv5 each represent a splitting-off group.

General formula (6)

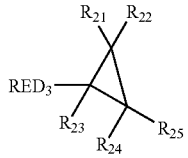

General formula (7)

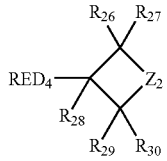

In the formulas (6) and (7), $RED_3$ and $RED_4$ each represent a reducing group. $R_{21}$ to $R_{30}$ each represent a hydrogen atom or substituent. $Z_2$ represents —$CR_{11}1R_{112}$—, —$NR_{113}$—, or —O—. $R_{111}$ and $R_{112}$ each independently represent a hydrogen atom or substituent. $R_{113}$ represents a hydrogen atom, alkyl group, aryl group or heterocyclic group.

General formula (8)

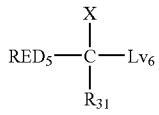

In the formula (8), $RED_5$ represents a reducing group, which includes an arylamino group or heterocyclicamino group. $R_{31}$ represents a hydrogen atom or substituent. X represents an alkoxy group, aryloxy group, heterocyclicoxy group, alkylthio group, arylthio group, heterocyclic thio group, alkylamino group, arylamino group or heterocyclicamino group. $Lv_6$ represents a splitting-off group, which includes a carboxy group or salt thereof, or a hydrogen atom.

Chemical reaction formula (1)

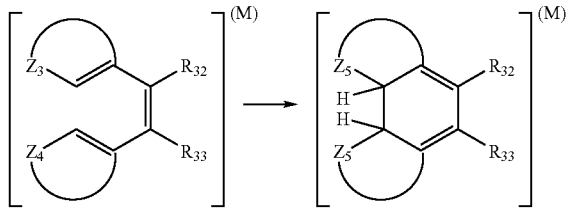

(9)

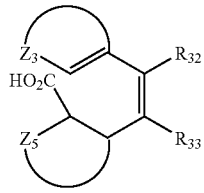

The compound represented by the general formula (9) is one that, after undergoing through two-electron oxidation accompanying decarboxylation, undergoes the bond-forming reaction formula represented by the chemical reaction of (1). In the chemical reaction formula (1), $R_{32}$ and $R_{33}$ each represents a hydrogen atom or substituent. $Z_3$ represents a group to form a 5-memenered or 6-membered hetero ring together with C═C. $Z_4$ represents a group to form a 5-membered or 6-membered aryl group or heterocyclic group together with C═C. M represents a radical, radical ion or cation. In the general formula (9), $R_{32}$, $R_{33}$, and $Z_3$ have the same meaning as those in the chemical reaction formula (1), respectively. $Z_5$ represents a group to form a 5-memebered or 6-membered cyclic aliphatic hydrocarbon group or heterocyclic group together with C—C.

Now the compound of type 2 will be described.

Examples of the compounds of type 2 that is capable of undergoing a one-electron oxidation to thereby form a one-electron oxidation product thereof, wherein the one-electron oxidation product is capable of releasing further one or more electrons accompanying a subsequent bond-forming reaction, are those represented by the formula (1) (having the same meaning as the general formula (1) of JP-A-2003-140287), and those capable of undergoing the chemical reaction formula (1) (having the same meaning as the chemical reaction formula (1) of Japanese Patent Application No. 2003-140287) and represented by the general formula (11) (having the same meaning as the general formula (2) of Japanese Patent Application No. 2003-33446). Preferable scopes of these compounds are the same as the preferable scopes described in the referred patent specifications.

$$RED_6\text{-}Q\text{-}Y \quad (10)$$

In the general formula (10), $RED_6$ represents a reducing group capable of undergoing one-electron oxidation. Y represent a reactive group having a carbon-carbon double bond moiety, carbon-carbon triple bond moiety, aromatic moiety or benzo-condensed nonaromatic heterocyclic group, and capable of reacting with a one-electron oxidation product formed as a result of a one-electron oxidation of $RED_6$ to thereby form a new bond. Q represents a linking group to link $RED_6$ and Y.

Chemical reaction formula (1)

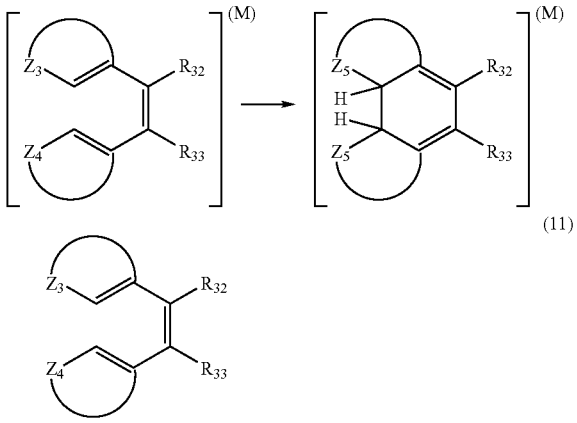

The compound represented by the general formula (11) is one that undergoes, by being oxidized, the bond-forming reaction represented by the chemical reaction formula (1). In the chemical reaction formula (1), $R_{32}$ and $R_{33}$ each represent a hydrogen atom or substituent. $Z_3$ represents a group to form a 5-membered or 6-membered hetero ring together with C═C. $Z_4$ represents a group to form a 5-membered or 6-membered aryl group or heterocyclic group together with C═C. $Z_5$ represents a group to form a 5-membered or 6-membered cyclic aliphatic hydrocarbon group or heterocyclic group. M represents a radical, radical ion or cation. In the general formula (11), $R_{32}$, $R_{33}$, $Z_3$ and $Z_4$ have the same meaning as those in the chemical reaction formula (1), respectively.

Among the compounds of types 1 and 2, "a compound having a adsorptive group to silver halide in a molecular" or "a compound having a partial structure of a spectrally sensitizing dye in a molecular" is preferable. Representative ones of the adsorptive group to silver halide are the groups described in the specification on page 16, right column, line 1 to page 17, right column line 12 of JP-A-2003-156823. The partial structure of the spectrally sensitizing dye is the structure described on page 17, right column, line 34 to page 18, left column, line 6 of the same specification, the entire contents of which are incorporated herein by reference.

As the compounds of types 1 and 2 "a compound having at least one adsorptive group to silver halide in a molecular" is preferable. "A compound having at least two adsorptive groups to silver halide in a molecular" is more preferable. When there are two or more adsorptive groups in a single molecular these adsorptive groups may be the same or different to each other.

As the adsorptive groups preferred ones are nitrogen-containing heterocyclic groups substituted with mercapto (e.g., a 2-mercaptothiadiazole group, 3-mercapto-1,2,4-triazole group, 5-mercaptotetrazole group, 2-mercapto-1,3,4-oxadiazole group, 2-mercaptobenzoxazole group, 2-mercaptobenzothiazole group or 1,5-dimethyl-1,2,4-triazolium-3-thiolate group), or a nitrogen-containing heterocyclic group having an —NH— group capable of forming an iminosilver (>NAg) as a partial structure of the heterocycle (e.g., a benzotriazole group, benzimidazole group or indazole group). More preferably, the adsorptive group is a 5-mercaptotetrazole group, 3-mercapto-1,2,4-triazole group or benzotriazole group. Most preferably, the adsorptive group is a 3-mercapto-1,2,4-triazole group or 5-mercaptotetrazole group.

Among the compounds of the present invention, those having, in its molecule, two or more mercapto groups as partial structures are also especially preferred. Herein, the mercapto group (—SH) may become a thione group when it can be tautomerized. Preferable examples of such compounds possessing in its molecule two or more adsorptive groups as a partial structure (e.g., dimercapto substituted nitrogen-containing heterocyclic group) are 2,4-dimercaptopyrimidine group, 2,4-dimercaptotriazine group, and 3,5-dimercapto-1,2,4-triazole group.

A quaternary salt structure of nitrogen or phosphor may be preferably used as the adsorptive group. The quaternary salt structure of nitrogen specifically is an ammonio group (e.g., trialkylammonio group, dialkylaryl(or heteroaryl)ammonio grup, alkyldiaryl(or heteroaryl)ammonio group) or a group containing a nitrogen-containing group including a quaternary nitrogen atom. The quaternary salt structure of phosphor specifically is a phosphonio group (e.g., trialkylphosphonio, dialkylaryl(or heteroaryl)phosphonio, alkyldiaryl(or heteroaryl)phosphonio group, or triaryl(or heteroaryl)phosphonio). A quaternary salt structure of nitrogen is more preferably used as the adsorptive group, a 5-membered or 6-membered nitrogen-containing aromatic heterocyclic group including a quaternary nitrogen atom is much more preferably used. A pyridinio, quinolinio or isoquinolinio is especially preferably used. These nitrogen-containing heterocyclic group including a quaternary nitrogen atom may have a substituent.

As an example of a counter anion of the quaternary salt, halide ion, carboxylate ion, sulfonate ion, sulfate ion, perchlorite ion, carbonate ion, nitrate ion, $BF_4^-$, $PF_6^-$ or $Ph_4B$ may be mentioned. When a group having a negative charge is present in carboxylate an etc., in a molecular, a intra molecular salt may be formed together with it. As a counter anion that is not present in a molecular, chloride ion, bromide ion, or methansulfonate ion is especially preferable.

Preferable examples of the compound represented by types 1 and 2 having a quaternary salt structure of phosphor or nitrogen as an adsorptive group are represented by general formula (X)

$$(P\text{-}Q_1\text{-})_i\text{—}R(\text{-}Q_2\text{-}S)_j \qquad \text{General formula (X)}$$

In general formula (X), P and R each independently represent a quaternary salt structure of nitrogen or phosphor that is not a partial structure of a sensitizing dye. $Q_1$ and $Q_2$ each independently represent a linking group, specifically a simple bond, alkylene, arylene, heterocyclic group, —O—, —S—, —$NR_N$—, —C(═O)—, —$SO_2$—, —SO— or —P(═O)— alone or combination of these groups. Herein, $R_N$ represents a hydrogen atom, alkyl group, aryl group or heterocyclic group. S represents a residue of the compound represented by type one or two from which an atom is removed. Each of i and j is an integer of 1 or more, and selected from the scope in which i+j is 2 to 6. Preferably, i is 1 to 3, and j is 1 to 2. More preferably, i is one or two and j is 1. Especially preferably, i is 1 and j is 1. The compounds represented by the general formula (X) are those having the total carbon atoms within the scope of preferably 10 to 100, more preferably 10 to 70, much more preferably 11 to 60 and especially preferably 12 to 50.

The compound of type 1 and type 2 may be used at any time during emulsion preparation or in photosensitive material manufacturing step, for example, during grain formation, at desalting step, at the time of chemical sensitization, or before coating. The compound may be added separately in a plurality of times during the steps. Preferable addition timing is from the completion of grain formation to before a desalting step, at the time of chemical sensitization (immediately before the initiation of chemical sensitization to immediately after the completion thereof), or before coating. More preferable addition timing is at chemical sensitization or before coating.

The compound of type 1 and type 2 may preferable be added by dissolving it to a water or water-soluble solvent such as methanol, ethanol or a mixture of solvents. When the compound is added to water, if the solubility of the compound increases in a case where pH is raised or lowered, the compound may be added to the solvent by raising or lowering the pH thereof.

It is preferable that the compound of type 1 and types 2 is used in an emulsion layer, but the compound may be added in a protective layer or interlayer together with the emulsion layer, thereby making the compound diffuse during coating. The addition time of the compound of the invention is irrespective of before or after the addition time of a sensitizing dye. Each of the compounds is preferably contained in a silver halide emulsion layer in an amount of $1\times10^{-9}$ to $5\times10^{-2}$ mol, more preferably $1\times10^{-8}$ to $2\times10^{-3}$ mol pre mol of silver halide.

The present invention is preferably used in combination with a technique of enhancing light absorption efficiency by a spectral sensitizing dye, especially with a technique of multi-layer adsorption of a sensitizing dye. The multi-layer adsorption means that more than one layer of dye chromophore are adsorbed (or layered) on the surface of silver halide grain.

Specifically, the technique, for example, is a method in which sensitizing dyes are adsorbed on the surface of a silver halide grain in an amount of more than the one layer saturated coating amount by using intermolecular force, or a method in which a dye that is formed by linking two or more separate nonconjugated dye chromophores with a covalent bond, i.e., so called a linked dye, is adsorbed on silver halide grain. These techniques are described in the following patent specifications that relate to the multi-layer adsorption.

JP-A's-10-239789, 11-133531, 2000-267216, 2000-275772, 2001-75222, 2001-75247, 2001-75221, 2001-75226, 2001-75223, 2001-255615, 2002-23294, 10-171058, 10-186559, 10-197980, 2000-81678, 2001-5132, 2001-166413, 2002-49113, 64-91134, 10-110107, 10-171058, 10-226758, 10-307358, 10-307359, 10-310715. 2000-231174, 2000-231172, 2000-231173, and 2001-356442, EP's 985965A, 985964A, 985966A, 985967A, 1085372A, 1085373A, 1172688A, 1199595A, and 887700A1.

Further, the present invention is preferably used in combination with the techniques described in the specifications shown in JP-A's 10-239789, 2001-75222, and 10-171058.

The photographic material to which the present invention may be applied is only required to be provided with at least one each of a blue-sensitive silver halide emulsion layer, a green-sensitive silver halide emulsion layer, a red-sensitive silver halide emulsion layer, and a non-light-sensitive emulsion layer on a support. As an typical example, a silver halide photosensitive material provided with at least one each unit of blue-sensitive, green-sensitive and red-sensitive layers each having the same color-sensitivity but different in speed, and at least one non-light-sensitive layer on a support, can be mentioned. The light-sensitive layer is a unit light-sensitive layer sensitive to one of blue light, green light and red light. In a multi-layered silver halide color photographic material, the unit light-sensitive layers are usually arranged in an order of a red-sensitive layer, a green-sensitive-layer, and a blue-sensitive layer on a support in this order from the one closest to the support. However, the arrangement order may be reversed depending on the purpose of the photographic material. Further, the arrangement order in which a different light-sensitive layer is sandwiched between the same color sensitive layers may be acceptable. A non light-sensitive layer can be formed between the silver halide light-sensitive layers and as the uppermost layer and the lowermost layer. These intermediate layers may contain a coupler, a DIR compound, a color-mixing inhibitor an so to be described later. As for a plurality of silver halide emulsion layers constituting respective unit light-sensitive layer, a two-layered structure of high- and low-speed emulsion layers can be preferably arranged so as to the speeds becomes lower toward the support as described in DE (German Patent) 1,121,470 or Great Britain Patent No. (hereinafter referred to as GB) 923,045, the entire contents of which are incorporated herein by reference. Also, as described in JP-A's-57-112751, 62-200350, 62-206541 and 62-206543, the entire contents of which are incorporated herein by reference, layers can be arranged such that a low-speed emulsion layer is formed farther from a support and a high-speed layer is formed closer to the support.

More specifically, layers can be arranged from the farthest side from a support in the order of low-speed blue-sensitive layer (BL)/high-speed blue-sensitive layer (BH)/high-speed green-sensitive layer (GH)/low-speed green-sensitive layer (GL)/high-speed red-sensitive layer (RH)/low-speed red-sensitive layer (RL), the order of BH/BL/GL/GH/RH/RL or the order of BH/BL/GH/GL/RL/RH.

In addition, as described in JP-B-55-34932, the entire contents of which are incorporated herein by reference, layers can be arranged from the farthest side from a support in the order of blue-sensitive layer/GH/RH/GL/RL. Furthermore, as described in JP-A's-56-25738 and 62-63936, the entire contents of which are incorporated herein by reference, layers can be arranged from the farthest side from a support in the order of blue-sensitive layer/GL/RL/GH/RH.

As described in JP-B-49-15495, the entire contents of which are incorporated herein by reference, three layers can be arranged such that a silver halide emulsion layer having the highest sensitivity is arranged as an upper layer, a silver halide emulsion layer having sensitivity lower than that of the upper layer is arranged as an interlayer, and a silver halide emulsion layer having sensitivity lower than that of the interlayer is arranged as a lower layer; i.e., three layers having different sensitivities can be arranged such that the sensitivity is sequentially decreased toward the support. Even when a layer structure is constituted by three layers having different sensitivities, these layers can be arranged in the order of medium-speed emulsion layer/high-speed emulsion layer/low-speed emulsion layer from the farthest side from a support in a layer sensitive to one color as described in JP-A-59-202464, the entire contents of which is incorporated herein by reference.

In addition, the order of high-speed emulsion layer/low-speed emulsion layer/medium-speed emulsion layer or low-speed emulsion layer/medium-speed emulsion layer/high-speed emulsion layer can be adopted.

Furthermore, the arrangement can be changed as described above even when four or more layers are formed.

The silver halide which is preferably employed in the present invention is silver iodobromide, silver iodochloride or silver iodochlorobromide containing up to about 30 mol % of silver iodide. Particularly preferred is silver iodobromide or silver iodochlorobromide containing from about 2 mol % to about 10 mol % of silver iodide.

Silver halide grains contained in a photographic emulsion may have regular crystals such as cubic, octahedral, or tetradecahedral crystals, irregular crystals such as spherical or tabular crystals, crystals having crystal defects such as twin planes, or composite shapes thereof.

Silver halide may be fine grains having a grain size of about 0.2 μm or less or large grains having a projected area diameter of about 10 μm, and also may form either a polydisperse emulsion or a monodisperse emulsion.

A silver halide photographic emulsion which can be used in the present invention can be prepared by methods described, for example, in "I. Emulsion preparation and types," Research Disclosure (hereinafter abbreviated as RD) No. 17643 (December, 1978), pp. 22 and 23, RD No. 18716 (November, 1979), page 648, and RD No. 307105 (November, 1989), pp. 863 to 865; P. Glafkides, "Chemie et Phisique Photographique", Paul Montel, 1967; G. F. Duffin, "Photographic Emulsion Chemistry", Focal Press, 1966; and V. L. Zelikman et al., "Making and Coating Photographic Emulsion", Focal Press, 1964.

Monodisperse emulsions described, for example, in U.S. Pat. Nos. 3,574,628 and 3,655,394, and GB 1,413,748 are also preferable.

Tabular grains having an aspect ratio of 3 or more may also be used in the present invention. Tabular grains can be prepared easily by methods described in Gutoff, "Photographic Science and Engineering", Vol. 14, pp. 248 to 257 (1970); and U.S. Pat. Nos. 4,434,226, 4,414,310, 4,433,048, and 4,439,520, and GB 2,112,157.

It has become clear that the compound of the present invention which improves the speed/graininess ratio shows a particularly significant effect when it is used together with tabular grains having an average aspect ratio of 8 or more in the same layer. The average aspect ratio of the tabular grains is preferably 8 to 100, and more preferably 12 to 50.

A crystal structure may be uniform, may have different halogen compositions in the interior portion and the outer portion, or may be a layered structure. Alternatively, silver halide having a different composition may junction as epitaxial junction or a compound except for silver halide such as silver rhodanide or lead oxide can junction. A mixture of grains having various types of crystal shapes may also be used.

The above emulsion preferably has a dislocation line. In particular, the tabular grains preferably have a dislocation line at a fringe portion. The dislocation line can be introduced by the following methods: a method of adding an aqueous solution containing an alkali iodide, etc., to form a silver-iodide-rich layer; a method of adding the AgI fine grains; and a method described in JP-A-5-323487.

The above emulsion may be any of a surface latent image type emulsion which forms a latent image mainly on the surface of a grain, an internal latent image type emulsion which forms a latent image in the interior of a grain, and another type of emulsion which has latent images on the surface and in the interior of a grain. However, the emulsion must be a negative type emulsion. The internal latent image type emulsion may be a core/shell internal latent image type emulsion described in JP-A-63-264740. A method of preparing this type of emulsion is described in JP-A-59-133542. Although the thickness of a shell of this emulsion varies depending, for example, on development conditions, it is preferably 3 to 40 nm, and especially preferably 5 to 20 nm.

A silver halide emulsion is used normally after being subjected to physical ripening, chemical ripening, and spectral sensitization steps. Additives for use in these steps are described in RD Nos. 17643, 18716, and 307105, the entire contents of which are incorporated herein by reference, and they are summarized in a table presented later.

In a sensitive material of the present invention, it is possible to use two or more types of emulsions different in at least one of characteristics of a light-sensitive silver halide emulsion, i.e., grain size, grain size distribution, halogen composition, grain shape, and speed, as a mixture in a single layer.

It is also possible to preferably use surface-fogged silver halide grains described in U.S. Pat. No. 4,082,553, internally fogged silver halide grains described in U.S. Pat. No. 4,626,498 and JP-A-59-214852, and colloidal silver, in light-sensitive silver halide emulsion layers and/or essentially non-light-sensitive hydrophilic colloid layers. The internally fogged or surface-fogged silver halide grains means a silver halide grain which can be developed uniformly (non-imagewise) regardless of whether the location is a non-exposed or an exposed portion of the photosensitive material. A method of preparing the internally fogged or surface-fogged silver halide grain is described in U.S. Pat. No. 4,626,498 and JP-A-59-214852. A silver halide which forms the core of an internally fogged core/shell type silver halide grain can have the same halogen composition or a different halogen composition. As the silver halide composition of the internally fogged or surface-fogged silver halide grains, any of silver chloride, silver chlorobromide, silver iodobromide and silver chloroiodobromide can be used. Although the grain size of these fogged silver halide grains is not particularly limited, the equivalent sphere diameter thereof is 0.01 to 0.75 μm, and especially preferably 0.05 to 0.6 μm. Further, the grain shape is not specifically limited, and can be a regular grain and a polydisperse emulsion. However, it is preferably a monodisperse, i.e., at least 95% in weight or number of silver halide grains thereof have grain sizes falling within the range of ±40% of the average equivalent sphere diameter).

In the present invention, it is preferable to use a non-sensitive fine grain silver halide. The non-sensitive fine grain silver halide preferably consists of silver halide grains which are not exposed during imagewise exposure for obtaining a dye image and are not substantially developed during development. These silver halide grains are preferably not fogged in advance. In the fine grain silver halide, the content of silver bromide is 0 to 100 mol %, and silver chloride and/or silver iodide can be added if necessary. The fine grain silver halide preferably contains 0.5 to 10 mol % of silver iodide. The average grain size (the average value of equivalent circle diameters of projected areas) of the fine grain silver halide is preferably 0.01 to 0.5 μm, and more preferably, 0.02 to 0.2 μm.

The fine grain silver halide can be prepared following the same procedures as for a common sensitive silver halide. The surface of each silver halide grain need not be optically sensitized nor spectrally sensitized. However, before the silver halide grains are added to a coating solution, it is preferable to add a well-known stabilizer such as a triazole-based compound, azaindene-based compound, benzothiazolium-based compound, mercapto-based compound, or zinc compound. Colloidal silver can be added to this fine grain silver halide grain-containing layer.

The silver coating amount of a sensitive material of the present invention is preferably 8.0 g/m$^2$ or less.

The photographic additives that may be used in the present invention are also described in RD's. The locations where they are described will be listed below.

| Types of additives | RD17643 | RD18716 | RD307105 |
|---|---|---|---|
| 1. Chemical sensitizers | page 23 | page 648 right column | page 866 |
| 2. Sensitivity increasing agents | | page 648 right column | |
| 3. Spectral sensitizers, super-sensitizers | pages 23-24 | page 648, right column to page 649, right column | pages 866-868 |
| 4. Brighteners | page 24 | page 648, right column | page 868 |
| 5. Light absorbents, filter dyes, ultraviolet absorbents | pages 25-26 | page 649, right column to page 650, left column | page 873 |
| 6. Binders | page 26 | page 651, left column | pages 873-874 |
| 7. Plasticizers, lubricants | page 27 | page 650, right column | page 876 |
| 8. Coating aids, surfactants | pages 26-27 | page 650, right column | pages 875-876 |
| 9. Antistatic agents | page 27 | page 650, right column | pages 876-877 |
| 10. Matting agents | | | pages 878-879 |

Various dye forming couplers can be used in a sensitive material of the present invention, and the following couplers are particularly preferable.

Yellow couplers: couplers represented by formulas (I) and (II) in EP502,424A; couplers (particularly Y-28 on page 18) represented by formulas (1) and (2) in EP513,496A; a coupler represented by formula (I) in claim 1 of EP568,037A; a coupler represented by formula (I) in column 1, lines 45 to 55 of U.S. Pat. No. 5,066,576; a coupler represented by formula (I) in paragraph 0008 of JP-A-4-274425; couplers (particularly D-35 on page 18) described in claim 1 on page 40 of EP498,381A1; couplers (particularly Y-1 (page 17) and Y-54 (page 41)) represented by formula (Y) on page 4 of EP447,969A1; and couplers (particularly II-17 and II-19 (column 17), and II-24 (column 19)) represented by formulas (II) to (IV) in column 7, lines 36 to 58 of U.S. Pat. No. 4,476,219.

Magenta couplers: L-57 (page 11, lower right column), L-68 (page 12, lower right column), and L-77 (page 13, lower right column) in JP-A-3-39737; A-4-63 (page 134), and A-4-73 and A-4-75 (page 139) in EP456,257; M-4 and M-6 (page 26), and M-7 (page 27) in EP486,965; M-45 (page 19) in EP571,959A; (M−1) (page 6) in JP-A-5-204106; and M-22 in paragraph 0237 of JP-A-4-362631.

Cyan couplers: CX-1, CX-3, CX-4, CX-5, CX-11, CX-12, CX-14, and CX-15 (pages 14 to 16) in JP-A-4-204843; C-7 and C-10 (page 35), C-34 and C-35 (page 37), and (1-1) and (1-17) (pages 42 and 43) in JP-A-4-43345; and couplers represented by formulas (Ia) and (Ib) in claim 1 of JP-A-6-67385.

Polymer couplers: P-1 and P-5 (page 11) in JP-A-2-44345.

Couplers for forming a colored dye with proper diffusibility are preferably those described in U.S. Pat. No. 4,366,237, GB2,125,570, EP96,873B, and DE3,234,533.

Couplers for correcting unnecessary absorption of a colored dye are preferably yellow colored cyan couplers (particularly YC-86 on page 84) represented by formulas (CI), (CII), (CIII), and (CIV) described on page 5 of EP456,257A1; yellow colored magenta couplers ExM-7 (page 202), EX-1 (page 249), and EX-7 (page 251) in EP456,257A1; magenta colored cyan couplers CC-9 (column 8) and CC-13 (column 10) described in U.S. Pat. No. 4,833,069; (2) (column 8) in U.S. Pat. No. 4,837,136; and colorless masking couplers (particularly compound examples on pages 36 to 45) represented by formula (A) in claim 1 of WO92/11575.

Examples of compounds which release a photographically useful group upon reaction with an oxidized developer (including couplers) are as follows. Development inhibitor-releasing compounds: compounds (particularly T-101 (page 30), T-104 (page 31), T-113 (page 36), T-131 (page 45), T-144 (page 51), and T-158 (page 58)) represented by formulas (I), (II), (III), (IV) described on page 11 of EP378,236A1, compounds (particularly D-49 (page 51)) represented by formula (I) described on page 7 of EP436,938A2, compounds (particularly (23) (page 11)) represented by formula (1) in EP568,037A, and compounds (particularly I-(1) on page 29) represented by formulas (I), (II), and (III) described on pages 5 and 6 of EP440,195A2; bleaching accelerator-releasing compounds: compounds (particularly (60) and (61) on page 61) represented by formulas (I) and (I') on page 5 of EP310,125A2, and compounds (particularly (7) (page 7)) represented by formula (I) in claim 1 of JP-A-6-59411; ligand-releasing compounds: compounds (particularly compounds in column 12, lines 21 to 41) represented by LIG-X described in claim 1 of U.S. Pat. No. 4,555,478; leuco dye-releasing compounds: compounds 1 to 6 in columns 3 to 8 of U.S. Pat. No. 4,749,641; fluorescent dye-releasing compounds: compounds (particularly compounds 1 to 11 in columns 7 to 10) represented by COUP-DYE in claim 1 of U.S. Pat. No. 4,774,181; development accelerator- or fogging agent-releasing compounds: compounds (particularly (1-22) in column 25) represented by formulas (1), (2), and (3) in column 3 of U.S. Pat. No. 4,656,123, and ExZK-2 on page 75, lines 36 to 38 of EP450,637A2; compounds which release a group which does not function as a dye unless it splits off: compounds (particularly Y-1 to Y-19 in columns 25 to 36) represented by formula (I) in claim 1 of U.S. Pat. No. 4,857,447.

Preferred examples of additives other than couplers are as follows.

Dispersants of an oil-soluble organic compound: P-3, P-5, P-16, P-19, P-25, P-30, P-42, P-49, P-54, P-55, P-66, P-81, P-85, P-86, and P-93 (pages 140 to 144) in JP-A-62-215272; impregnating latexes of an oil-soluble organic compound: latexes described in U.S. Pat. No. 4,199,363; developing agent oxidized form scavengers: compounds (particularly I-(1), I-(2), I-(6), and I-(12) (columns 4 and 5)) represented by formula (I) in column 2, lines 54 to 62 of U.S. Pat. No. 4,978,606, and formulas (particularly a compound 1 (column 3)) in column 2, lines 5 to 10 of U.S. Pat. No. 4,923,787; stain inhibitors: formulas (I) to (III) on page 4, lines 30 to 33, particularly I-47, I-72, III-1, and III-27 (pages 24 to 48) in EP298321A; discoloration inhibitors: A-6, A-7, A-20, A-21, A-23, A-24, A-25, A-26, A-30, A-37, A-40, A-42, A-48, A-63, A-90, A-92, A-94, and A-164 (pages 69 to 118) in EP298321A, II-1 to III-23, particularly III-10 in columns 25 to 38 of U.S. Pat. No. 5,122,444, I-1 to III-4, particularly II-2 on pages 8 to 12 of EP471347A, and A-1 to A-48, particularly A-39 and A-42 in columns 32 to 40 of U.S. Pat. No. 5,139,931; materials which reduce the use amount of a color enhancer or a color-mixing inhibitor: I-1 to II-15, particularly I-46 on pages 5 to 24 of EP411324A;

formalin scavengers: SCV-1 to SCV-28, particularly SCV-8 on pages 24 to 29 of EP477932A; film hardeners: H-1, H-4, H-6, H-8, and H-14 on page 17 of JP-A-1-214845, compounds (H-1 to H-54) represented by formulas (VII) to (XII) in columns 13 to 23 of U.S. Pat. No. 4,618,573, compounds (H-1 to H-76), particularly H-14 represented by formula (6) on page 8, lower right column of JP-A-2-214852, and compounds described in claim 1 of U.S. Pat. No. 3,325,287; development inhibitor precursors: P-24, P-37, and P-39 (pages 6 and 7) in JP-A-62-168139; compounds described in claim 1, particularly 28 and 29 in column 7 of U.S. Pat. No. 5,019,492; antiseptic agents and mildewproofing agents: I-1 to III-43, particularly II-1, II-9, II-10, II-18, and III-25 in columns 3 to 15 of U.S. Pat. No. 4,923,790; stabilizers and antifoggants: I-1 to (14), particularly I-1, I-60, (2), and (13) in columns 6 to 16 of U.S. Pat. No. 4,923,793, and compounds 1 to 65, particularly a compound 36 in columns 25 to 32 of U.S. Pat. No. 4,952,483; chemical sensitizers: triphenylphosphine selenide and a compound 50 in JP-A-5-40324; dyes: a-1 to b-20, particularly a-1, a-12, a-18, a-27, a-35, a-36, and b-5 on pages 15 to 18 and V-1 to V-23, particularly V-1 on pages 27 to 29 of JP-A-3-156450, F-I-1 to F-II-43, particularly F-I-11 and F-II-8 on pages 33 to 55 of EP445627A, III-1 to III-36, particularly III-1 and III-3 on pages 17 to 28 of EP457153A, fine crystal dispersions of Dye-1 to Dye-124 on pages 8 to 26 of WO88/04794, compounds 1 to 22, particularly a compound 1 on pages 6 to 11 of EP319999A, compounds D-1 to D-87 (pages 3 to 28) represented by formulas (1) to (3) in EP519306A, compounds 1 to 22 (columns 3 to 10) represented by formula (I) in U.S. Pat. No. 4,268,622, and compounds (1) to (31) (columns 2 to 9) represented by formula (I) in U.S. Pat. No. 4,923,788; UV absorbers: compounds (18b) to (18r) and 101 to 427 (pages 6 to 9) represented by formula (1) in JP-A-46-3335, compounds (3) to (66) (pages 10 to 44) represented by formula (I) and compounds HBT-1 to HBT-10 (page 14) represented by formula (III) in EP520938A, and compounds (1) to (31) (columns 2 to 9) represented by formula (1) in EP521823A.

The present invention can be applied to various color photosensitive materials such as color negative films for general purposes or cinemas, color reversal films for slides and TV, color paper, color positive films and color reversal paper. Moreover, the present invention is suitable to lens-equipped film units described in JP-B-2-32615 and Jpn. Utility Model Appln. KOKOKU Publication No. 3-39784.

Supports which can be suitably used in the present invention are described in, e.g., RD. No. 17643, page 28; RD. No. 18716, from the right column of page 647 to the left column of page 648; and RD. No. 307105, page 879.

The specific photographic speed in the present invention is determined by the method described in JP-A-63-236035. This determination method accords with JIS K 7614-1981, but differs in that the development processing is completed 30 min to 6 hr after sensitometric exposure, and the development processing is conducted by Fuji Color Standard Processing Formula CN-16. Other points are substantially the same as the determination method described in JIS.

In the photosensitive material of the present invention, the thickness from the light-sensitive silver halide layer closest to the support to the surface of this photosensitive material is preferably 24 μm or less, more preferably 22 μm or less. The film swelling speed $T_{1/2}$ is preferably 30 sec or less, and more preferably, 20 sec or less. The film swelling speed $T_{1/2}$ is defined as the time that, when the saturation film thickness means 90% of the maximum swollen film thickness realized by the processing in a color developing solution at 30° C. for 3 min 15 sec, spent for the film thickness to reach ½ of the saturation film thickness. The film thickness means one measured under moisture conditioning at 25° C. and at a relative humidity of 55% (two days). The film swelling speed $T_{1/2}$ can be measured by using a swellometer described in A. Green et al., Photogr. Sci. Eng., Vol. 19, No. 2, pp. 124 to 129. The film swelling speed $T_{1/2}$ can be regulated by adding a film hardening agent to gelatin as a binder or by changing aging conditions after coating. The swelling ratio preferably ranges from 150 to 400%. The swelling ratio can be calculated from the maximum swollen film thickness measured under the above conditions in accordance with the formula:

[maximum swollen film thickness−film thickness]/film thickness.

In the photosensitive material of the present invention, hydrophilic colloid layers (called "back layers") having a total dried film thickness of 2 to 20 μm are preferably formed on the side opposite to the side having emulsion layers. The back layers preferably contain the above light absorbent, filter dye, ultraviolet absorbent, antistatic agent, film hardener, binder, plasticizer, lubricant, coating aid and surfactant. The swelling ratio of the back layers is preferably 150% to 500%.

The photosensitive material of the present invention can be developed by conventional methods described in RD. No. 17643, pages 28 and 29; RD. No. 18716, page 651, left to right columns; and RD No. 307105, pages 880 and 881.

The color negative film processing solution for use in the present invention will be described below.

The compounds listed in page 9, right upper column, line 1 to page 11, left lower column, line 4 of JP-A-4-121739 can be used in the color developing solution for use in the present invention. Preferred color developing agents for use in especially rapid processing are 2-methyl-4-[N-ethyl-N-(2-hydroxyethyl)amino]aniline, 2-methyl-4-[N-ethyl-N-(3-hydroxypropyl)amino]aniline and 2-methyl-4-[N-ethyl-N-(4-hydroxybutyl)amino]aniline.

These color developing agents are preferably used in an amount of 0.01 to 0.08 mol, more preferably 0.015 to 0.06 mol, and much more preferably 0.02 to 0.05 mol per liter (L) of the color developing solution. The replenisher of the color developing solution preferably contains the color developing agent in an amount corresponding to 1.1 to 3 times the above concentration, more preferably 1.3 to 2.5 times the above concentration.

Hydroxylamine can widely be used as preservatives of the color developing solution. When enhanced preserving properties are required, it is preferred to use hydroxylamine derivatives having substituents for example, alkyl, hydroxyalkyl, sulfoalkyl and carboxyalkyl groups, examples of which include N,N-di(sulfoehtyl)hydroxylamine, monomethylhydroxylamine, dimethylhydroxylamine, monoethylhydroxylamine, diethylhydroxylamine and N,N-di(carboxyethyl)hydroxylamine. Of these, N,N-di(sulfoehtyl) hydroxylamine is most preferred. Although these may be used in combination with the hydroxylamine, it is preferred that one or at least two members thereof be used in place of the hydroxylamine.

These preservatives are preferably used in an amount of 0.02 to 0.2 mol, more preferably 0.03 to 0.15 mol, and most preferably 0.04 to 0.1 mol per liter of the color developing solution. The replenisher of the color developing solution preferably contains the preservative in an amount corresponding to 1.1 to 3 times the concentration of the mother liquor (processing tank solution) as in the color developing agent.

Sulfurous salts are used as tarring preventives for the color developing agent in an oxidized form in the color developing solution. Each sulfurous salt is preferably used in the color developing solution in an amount of 0.01 to 0.05 mol, more preferably 0.02 to 0.04 mol per liter, and is preferably used in the replenisher in an amount corresponding to 1.1 to 3 times the above concentration.

The pH value of the color developing solution preferably ranges from 9.8 to 11.0, especially preferably from 10.0 to 10.5. That of the replenisher is preferably set at 0.1 to 1.0 higher than the above value. Common buffers such as carbonate, phosphonate, sulfosalicylate and borate are used for stabilizing the above pH value.

Although the amount of the replenisher of the color developing solution preferably ranges from 80 to 1300 mL per $m^2$ of the photosensitive material, it is desired that the amount be smaller from the viewpoint of reducing environmental pollution load. Specifically, the amount of the replenisher more preferably ranges from 80 to 600 mL, most preferably from 80 to 400 mL.

Although the bromide ion concentration of the color developing solution generally ranges from 0.01 to 0.06 mol per liter, it is preferred that the above concentration be set at 0.015 to 0.03 mol per liter for inhibiting fog while maintaining speed to thereby improve discrimination and for bettering graininess. When the bromide ion concentration is set so as to fall within the above range, the replenisher preferably contains bromide ion in a concentration as calculated by the following formula. However, when C is negative, it is preferred that no bromide ion be contained in the replenisher.

$$C=A-W/V$$

wherein

C: bromide ion concentration of the color developing replenisher (mol/L),

A: target bromide ion concentration of the color developing solution (mol/L),

W: amount of bromide ions which elutes from the photosensitive material to the color developing solution when a 1 $m^2$ of photosensitive material is color-developed (mol), V: amount of color developing replenisher supplied per $m^2$ of the photosensitive material (L).

Development accelerators such as pyrazolidones represented by 1-phenyl-3-pyrazolidone and 1-phenyl-2-methyl-2-hydroxymethyl-3-pyrazolidone and thioether compounds represented by 3,6-dithia-1,8-octanediol are preferably used as means for enhancing speed when the amount of the replenisher has been reduced or when a high bromide ion concentration has been set.

Compounds and processing conditions described on page 4, left lower column, line 16 to page 7, left lower column, line 6 of JP-A-4-125558 can be applied to the processing solution having bleaching capability for use in the present invention.

Bleaching agents having redox potentials of at least 150 mV are preferably used. Specifically, suitable examples thereof are those described in JP-A-5-72694 and JP-A-5-173312, and especially suitable examples thereof are 1,3-diaminopropanetetraacetic acid and ferric complex salts of Example 1 compounds listed on page 7 of JP-A-5-173312.

For improving the biodegradability of the bleaching agent, it is preferred that ferric complex salts of compounds listed in JP-A's-4-251845, and 4-268552, EP's 588,289, and 591,934 and JP-A-6-208213 be used as the bleaching agent. The concentration of the above bleaching agent preferably ranges from 0.05 to 0.3 mol per liter of the solution having bleaching capability, and it is especially preferred that a design be made at 0.1 to 0.15 mol per liter for reducing the discharge to the environment. When the solution having bleaching capability is a bleaching solution, a bromide is preferably incorporated therein in an amount of 0.2 to 1 mol, more preferably 0.3 to 0.8 mol per liter.

Each component is incorporated in the replenisher of the solution having bleaching capability fundamentally in a concentration calculated by the following formula. This enables holding the concentration of the mother liquor constant.

$$C_R=C_T\times(V1+V2)/V1+C_P$$

$C_R$: concentration of each component in the replenisher, $C_T$: concentration of the component in the mother liquor (processing tank solution), V1: amount of replenisher having bleaching capability supplied per $m^2$ of photosensitive material (mL), and V2: amount carried from previous bath by 1 $m^2$ of photosensitive material (mL).

In addition, a pH buffer is preferably incorporated in the bleaching solution, and it is especially preferred to incorporate a dicarboxylic acid of low odor such as succinic acid, maleic acid, malonic acid, glutaric acid or adipic acid. It is also preferred to use common bleaching accelerators listed in JP-A-53-95630, RD No. 17129 and U.S. Pat. No. 3,893,858.

The bleaching solution is preferably replenished with 50 to 1000 mL, more preferably 80 to 500 mL, and much more preferably 100 to 300 mL, of a bleaching replenisher per $m^2$ of the photosensitive material. Further, the bleaching solution is preferably aerated.

Compounds and processing conditions described on page 7, left lower column, line 10 to page 8, right lower column, line 19 of JP-A-4-125558 can be applied to a processing solution having fixing capability.

For enhancing the fixing velocity and preservability, it is especially preferred to incorporate compounds represented by the general formulas (I) and (II) of JP-A-6-301169 either individually or in combination in the processing solution having fixing capability. Further, the use of p-toluenesulfinic salts and sulfinic acids listed in JP-A-1-224762 is preferred from the viewpoint of enhancing the preservability.

Although the incorporation of an ammonium as a cation in the solution having bleaching capability or solution having fixing capability is preferred from the viewpoint of enhancing the desilverization ability, it is preferred that the amount of ammonium be reduced or brought to nil from the viewpoint of minimizing environmental pollution.

Conducting jet agitation described in JP-A-1-309059 is especially preferred in the bleach, bleach-fix and fixation steps.

The amount of replenisher supplied in the bleach-fix or fixation step is in the range of 100 to 1000 mL, preferably 150 to 700 mL, and especially preferably 200 to 600 mL, per $m^2$ of the photosensitive material.

Silver is preferably recovered by installing any of various silver recovering devices in an in-line or off-line mode in the bleach-fix or fixation step. In-line installation enables processing with the silver concentration of the solution lowered, so that the amount of replenisher can be reduced. It is also suitable to conduct an off-line silver recovery and recycle residual solution for use as a replenisher.

The bleach-fix and fixation steps can each be constructed by a plurality of processing tanks. Preferably, the tanks are provided with cascade piping and a multistage counterflow system is adopted. A 2-tank cascade structure is generally effective from the viewpoint of a balance with the size of the developing machine. The ratio of processing time in the former-stage tank to that in the latter-stage tank is preferably in the range of 0.5:1 to 1:0.5, more preferably 0.8:1 to 1:0.8.

From the viewpoint of enhancing the preservability, it is preferred that a chelating agent which is free without forming any metal complex be present in the bleach-fix and fixing solutions. Biodegradable chelating agents described in connection with the bleaching solution are preferably used as such a chelating agent.

Descriptions made on page 12, right lower column, line 6 to page 13, right lower column, line 16 of JP-A-4-125558 mentioned above can preferably be applied to water washing and stabilization steps. In particular, with respect to stabilizing solutions, the use of azolylmethylamines described in EP's 504,609 and 519,190 and N-methylolazoles described in JP-A-4-362943 in place of formaldehyde and the dimerization of magenta coupler into a surfactant solution not containing an image stabilizer such as formaldehyde are preferred from the viewpoint of protecting working environment.

To reduce adhesion of dust to a magnetic recording layer formed on a photosensitive material, a stabilizer described in JP-A-6-289559 can be preferably used.

The replenishment rate of washing water and a stabilizer is preferably 80 to 1,000 mL, more preferably, 100 to 500 mL, and most preferably, 150 to 300 mL per $m^2$ of a photosensitive material in order to maintain the washing and stabilization functions and at the same time reduce the waste liquors for environmental protection. In processing performed with this replenishment rate, it is preferable to prevent the propagation of bacteria and mildew by using known mildewproofing agents such as thiabendazole, 1,2-benzoisothiazoline-3-one, and 5-chloro-2-methylisothiazoline-3-one, antibiotics such as gentamicin, and water deionized by an ion exchange resin or the like. It is more effective to use deionized water together with a mildewproofing agent or an antibiotic.

The replenishment rate of a solution in a washing water tank or stabilizer tank is preferably reduced by performing reverse permeable membrane processing described in JP-A's-3-46652, 3-53246, 3-55542, 3-121448, and 3-126030. A reverse permeable membrane used in this processing is preferably a low-pressure reverse permeable membrane.

In the processing of the present invention, it is particularly preferable to perform processing solution evaporation correction disclosed in Journal of Technical Disclosure No. 94-4992. In particular, a method of performing correction on the basis of (formula-1) on page 2 by using temperature and humidity information of an environment in which a processor is installed is preferable. Water for use in this evaporation correction is preferably taken from the washing water replenishment tank. If this is the case, deionized water is preferably used as the washing replenishing water.

Processing agents described in aforementioned Journal of Technical Disclosure No. 94-4992, page 3, right column, line 15 to page 4, left column, line 32 are preferably used in the present invention. As a processor for these processing agents, a film processor described on page 3, right column, lines 22 to 28 is preferable.

Practical examples of processing agents, automatic processors, and evaporation correction methods suited to practicing the present invention are described in the same Journal of Technical Disclosure No. 94-4992, page 5, right column, line 11 to page 7, right column, last line.

Processing agents used in the present invention can be supplied in any form: a liquid agent having the concentration of a solution to be used, concentrated liquid agent, granules, powder, tablets, paste, and emulsion. Examples of such processing agents are a liquid agent contained in a low-oxygen permeable vessel disclosed in JP-A-63-17453, vacuum-packed powders and granules disclosed in JP-A's-4-19655 and 4-230748, granules containing a water-soluble polymer disclosed in JP-A-4-221951, tablets disclosed in JP-A's-51-61837 and 6-102628, and a paste disclosed in Japanese Patent Application KOHYO Publication No. 57-500485. Although any of these processing agents can be preferably used, the use of a liquid adjusted to have the concentration of a solution to be used is preferable for the sake of convenience in use.

As a vessel for containing these processing agents, polyethylene, polypropylene, polyvinylchloride, polyethyleneterephthalate, and nylon are used singly or as a composite material. These materials are selected in accordance with the level of necessary oxygen permeability. For a readily oxidizable solution such as a color developer, a low-oxygen permeable material is preferable. More specifically, polyethyleneterephthalate or a composite material of polyethylene and nylon is preferable. A vessel made of any of these materials preferably has a thickness of 500 to 1,500 μm and an oxygen permeability of 20 $mL/m^2 \cdot 24$ hrs·atm or less.

Color reversal film processing solutions used in the present invention will be described below.

Processing for a color reversal film is described in detail in Aztech Ltd., Known Technology No. 6 (1991, Apr. 1), page 1, line 5 to page 10, line 5 and page 15, line 8 to page 24, line 2, and any of the contents can be preferably applied.

In the color reversal film processing, an image stabilizing agent is contained in a control bath or a final bath. Preferable examples of this image stabilizing agent are formalin, sodium formaldehyde-bisulfite, and N-methylolazole. Sodium formaldehyde-bisulfite or N-methylolazole is preferable in terms of work environment, and N-methyloltriazole is particularly preferable as N-methylolazole. The contents pertaining to a color developer, bleaching solution, fixing solution, and washing water described in the color negative film processing can be preferably applied to the color reversal film processing.

Preferable examples of color reversal film processing agents containing the above contents are an E-6 processing agent manufactured by Eastman Kodak Co. and a CR-56 processing agent manufactured by Fuji Photo Film Co., Ltd.

The magnetic recording layer for use in the present invention will be described below.

The magnetic recording layer is obtained by coating on a support with a water-base or organic solvent coating liquid having magnetic material grains dispersed in a binder.

Suitable magnetic material grains can be composed of any of ferromagnetic iron oxides such as γ $Fe_2O_3$, Co coated γ $Fe_2O_3$, Co coated magnetite, Co containing magnetite, ferromagnetic chromium dioxide, ferromagnetic metals, ferromagnetic alloys, Ba ferrite of hexagonal system, Sr ferrite, Pb ferrite and Ca ferrite. Of these, Co coated ferromagnetic iron oxides such as Co coated γ $Fe_2O_3$ are preferred. The configuration thereof may be any of acicular, rice grain, spherical, cubic and plate shapes. The specific surface area is preferably at least 20 $m^2/g$, more preferably at least 30 $m^2/g$ in terms of $S_{BET}$. The saturation magnetization (σs) of the ferromagnetic material preferably ranges from $3.0 \times 10^4$ to $3.0\times10^5$ A/m, more preferably from $4.0\times10^4$ to $2.5\times10^5$ A/m. The ferromagnetic material grains may have their surface treated with silica and/or alumina or an organic material. Further, the magnetic material grains may have their surface treated with a silane coupling agent or a titanium coupling agent as described in JP-A-6-161032. Still further, use can be made of magnetic material grains having their surface coated with an organic or inorganic material as described in JP-A's-4-259911 and 5-81652.

The binder for use in the magnetic material grains can be composed of any of natural polymers (e.g., cellulose derivatives and sugar derivatives), acid-, alkali- or bio-degradable polymers, reactive resins, radiation curable resins, thermosetting resins and thermoplastic resins listed in JP-A-4-219569 and mixtures thereof. The Tg of each of the above resins ranges from −40 to 300° C. and the weight average molecular weight thereof ranges from 2 thousand to 1 million. For example, vinyl copolymers, cellulose derivatives such as cellulose diacetate, cellulose triacetate, cellulose acetate propionate, cellulose acetate butyrate and cellulose tripropionate, acrylic resins and polyvinylacetal resins can be mentioned as suitable binder resins. Gelatin is also a suitable binder resin. Of these, cellulose di(tri)acetate is especially preferred. The binder can be cured by adding an epoxy, aziridine or isocyanate crosslinking agent. Suitable isocyanate crosslinking agents include, for example, isocyanates such as tolylene diisocyanate, 4,4'-diphenylmethane diisocyanate, hexamethylene diisocyanate and xylylene diisocyanate, reaction products of these isocyanates and polyalcohols (e.g., reaction product of 3 mol of tolylene diisocyanate and 1 mol of trimethylolpropane), and polyisocyanates produced by condensation of these isocyanates, as described in, for example, JP-A-6-59357.

The method of dispersing the magnetic material in the above binder preferably comprises using a kneader, a pin type mill and an annular type mill either individually or in combination as described in JP-A-6-35092. Dispersants listed in JP-A-5-088283 and other common dispersants can be used. The thickness of the magnetic recording layer ranges from 0.1 to 10 μm, preferably 0.2 to 5 μm, and more preferably from 0.3 to 3 μm. The weight ratio of magnetic material grains to binder is preferably in the range of 0.5:100 to 60:100, more preferably 1:100 to 30:100. The coating amount of magnetic material grains ranges from 0.005 to 3 $g/m^2$, preferably from 0.01 to 2 $g/m^2$, and more preferably from 0.02 to 0.5 $g/m^2$. The transmission yellow density of the magnetic recording layer is preferably in the range of 0.01 to 0.50, more preferably 0.03 to 0.20, and most preferably 0.04 to 0.15. The magnetic recording layer can be applied to the back of a photographic support in its entirety or in striped pattern by coating or printing. The magnetic recording layer can be applied by the use of, for example, an air doctor, a blade, an air knife, a squeeze, an immersion, reverse rolls, transfer rolls, a gravure, a kiss, a cast, a spray, a dip, a bar or an extrusion. Coating liquids set forth in JP-A-5-341436 are preferably used.

The magnetic recording layer may also be provided with, for example, lubricity enhancing, curl regulating, antistatic, sticking preventive and head polishing functions, or other functional layers may be disposed to impart these functions. An abrasive of grains whose at least one member is nonspherical inorganic grains having a Mohs hardness of at least 5 is preferred. The nonspherical inorganic grains are preferably composed of fine grains of any of oxides such as aluminum oxide, chromium oxide, silicon dioxide and titanium dioxide; carbides such as silicon carbide and titanium carbide; and diamond. These abrasives may have their surface treated with a silane coupling agent or a titanium coupling agent. The above grains may be added to the magnetic recording layer, or the magnetic recording layer may be overcoated with the grains (e.g., as a protective layer or a lubricant layer). The binder which is used in this instance can be the same as mentioned above and, preferably, the same as that of the magnetic recording layer. The photosensitive material having the magnetic recording layer is described in U.S. Pat. Nos. 5,336,589, 5,250,404, 5,229,259, and 5,215,874 and EP 466,130.

The polyester support for use in the present invention will be described below. Particulars thereof together with the below mentioned photosensitive material, processing, cartridge and working examples are specified in Journal of Technical Disclosure No. 94-6023 (issued by Japan Institute of Invention and Innovation on Mar. 15, 1994). The polyester for use in the present invention is prepared from a diol and an aromatic dicarboxylic acid as essential components. Examples of suitable aromatic dicarboxylic acids include 2,6-, 1,5-, 1,4- and 2,7-naphthalenedicarboxylic acids, terephthalic acid, isophthalic acid and phthalic acid, and examples of suitable diols include diethylene glycol, triethylene glycol, cyclohexanedimethanol, bisphenol A and other bisphenols. The resultant polymers include homopolymers such as polyethylene terephthalate, polyethylene naphthalate and polycyclohexanedimethanol terephthalate. Polyesters containing 2,6-naphthalenedicarboxylic acid in an amount of 50 to 100 mol % are especially preferred. Polyethylene 2,6-naphthalate is most preferred. The average molecular weight thereof ranges from approximately 5,000 to 200,000. The Tg of the polyester of the present invention is at least 50° C., preferably at least 90° C.

The polyester support is subjected to heat treatment at a temperature of from 40° C. to less than Tg, preferably from Tg minus 20° C. to less than Tg, in order to suppress curling. This heat treatment may be conducted at a temperature held constant within the above temperature range or may be conducted while cooling. The period of heat treatment ranges from 0.1 to 1500 hr, preferably 0.5 to 200 hr. The support may be heat treated either in the form of a roll or while being carried in the form of a web. The surface form of the support may be improved by rendering the surface irregular (e.g., coating with conductive inorganic fine grains of $SnO_2$, $Sb_2O_5$, etc.). Moreover, a scheme is desired such that edges of the support are knurled so as to render only the edges slightly high, thereby preventing photographing of core sections. The above heat treatment may be carried out in any of stages after support film formation, after surface treatment, after back layer application (e.g., application of an antistatic agent or a lubricant) and after undercoating application. The heat treatment is preferably performed after antistatic agent application.

An ultraviolet absorber may be milled into the polyester. Light piping can be prevented by milling, into the polyester, dyes and pigments commercially available as polyester additives, such as Diaresin produced by Mitsubishi Chemical Industries, Ltd. and Kayaset produced by NIPPON KAYAKU CO., LTD.

Next, in the present invention, a surface treatment is preferably conducted for bonding a support and a photosensitive material constituting layer to each other. The surface treatment is, for example, a surface activating treatment such as chemical treatment, mechanical treatment, corona discharge treatment, flame treatment, ultraviolet treatment, high frequency treatment, grow discharge treatment, active plasma treatment, laser treatment, mixed acid treatment or ozone oxidation treatment. Of these surface treatments, ultraviolet irradiation treatment, flame treatment, corona treatment and glow treatment are preferred.

Next, the subbing layer may be composed of a single layer or two or more layers. As the binder for the substratum, there can be mentioned not only copolymers prepared from monomers, as starting materials, selected from among vinyl chloride, vinylidene chloride, butadiene, methacrylic acid, acrylic acid, itaconic acid and maleic anhydride but also polyethyleneimine, an epoxy resin, a grafted gelatin, nitrocellulose and gelatin. Resorcin or p-chlorophenol is used as a support swelling compound. A gelatin hardener such as a chromium salt (e.g., chrome alum), an aldehyde (e.g., formaldehyde or glutaraldehyde), an isocyanate, an active halogen compound (e.g., 2,4-dichloro-6-hydroxy-S-triazine), an epichlorohydrin resin or an active vinyl sulfone compound can be used in the subbing layer. Also, $SiO_2$, $TiO_2$, inorganic fine grains or polymethyl methacrylate copolymer fine grains (0.01 to 10 μm) may be incorporated therein as a matting agent.

Further, an antistatic agent is preferably used in the present invention. Examples of suitable antistatic agents include carboxylic acids and carboxylic salts, sulfonic acid salt containing polymers, cationic polymers and ionic surfactant compounds.

Most preferred as the antistatic agent are fine grains of at least one crystalline metal oxide selected from among ZnO, $TiO_2$, $SnO_2$, $Al_2O_3$, $In_2O_3$, $SiO_2$, MgO, BaO, $MoO_3$ and $V_2O_5$ having a volume resistivity of $10^7$ Ω·cm or less, preferably $10^5$ Ω·cm or less, and having a grain size of 0.001 to 1.0 μm or a composite oxide thereof (Sb, P, B, In, S, Si, C, etc.) and fine grains of sol form metal oxides or composite oxides thereof. The content thereof in the photosensitive material is preferably in the range of 5 to 500 mg/$m^2$, more preferably 10 to 350 mg/$m^2$. The ratio of amount of conductive crystalline oxide or composite oxide thereof to binder is preferably in the range of 1/300 to 100/1, more preferably 1/100 to 100/5.

It is preferred that the photosensitive material of the present invention have lubricity. The lubricant containing layer is preferably provided on both the light-sensitive layer side and the back side. Preferred lubricity ranges from 0.25 to 0.01 in terms of dynamic friction coefficient. The measured lubricity is a value obtained by conducting a carriage on a stainless steel ball of 5 mm in diameter at 60 cm/min (25° C., 60% RH). In this evaluation, value of approximately the same level is obtained even when the opposite material is replaced by the light-sensitive layer side.

The lubricant which can be used in the present invention is, for example, a polyorganosiloxane, a higher fatty acid amide, a higher fatty acid metal salt or an ester of higher fatty acid and higher alcohol. Examples of suitable polyorganosiloxanes include polydimethylsiloxane, polydiethylsiloxane, polystyrylmethylsiloxane and polymethylphenylsiloxane. The lubricant is preferably added to the back layer or the outermost layer of the emulsion layer. Especially, polydimethylsiloxane and an ester having a long chain alkyl group are preferred.

A matting agent is preferably used in the photosensitive material of the present invention. Although the matting agent may be used on the emulsion side or the back side indiscriminately, it is especially preferred that the matting agent be added to the outermost layer of the emulsion side. The matting agent may be soluble in the processing solution or insoluble in the processing solution, and it is preferred to use the soluble and insoluble matting agents in combination. For example, polymethyl methacrylate, poly(methyl methacrylate/methacrylic acid) (9/1 or 5/5 in molar ratio) and polystyrene grains are preferred. The grain size thereof preferably ranges from 0.8 to 10 μm. Narrow grain size distribution thereof is preferred, and it is desired that at least 90% of the whole number of grains be included in the range of 0.9 to 1.1 times the average grain size. Moreover, for enhancing the mat properties, it is preferred that fine grains of 0.8 μm or less be simultaneously added, which include, for example, fine grains of polymethyl methacrylate (0.2 μm), poly(methyl methacrylate/methacrylic acid) (9/1 in molar ratio, 0.3 μm), polystyrene (0.25 μm) and colloidal silica (0.03 μm).

The film patrone employed in the present invention will be described below. The main material composing the patrone for use in the present invention may be a metal or a synthetic plastic.

Examples of preferable plastic materials include polystyrene, polyethylene, polypropylene and polyphenyl ether. The patrone for use in the present invention may contain various types of antistatic agents and can preferably contain, for example, carbon black, metal oxide grains, nonionic, anionic, cationic or betaine type surfactants and polymers. Such an antistatic patrone is described in JP-A's-1-312537 and 1-312538. The resistance thereof at 25° C. in 25% RH is preferably $10^{12}$ Ω or less. The plastic patrone is generally molded from a plastic having carbon black or a pigment milled thereinto for imparting light shielding properties. The patrone size may be the same as the current size 135, or for miniaturization of cameras, it is advantageous to decrease the diameter of the 25 mm cartridge of the current size 135 to 22 mm or less. The volume of the case of the patrone is preferably 30 $cm^3$ or less, more preferably 25 $cm^3$ or less. The weight of the plastic used in each patrone or patrone case preferably ranges from 5 to 15 g.

The patrone for use in the present invention may be one capable of feeding a film out by rotating a spool. Further, the patrone may be so structured that a film front edge is accommodated in the main frame of the patrone and that the film front edge is fed from a port part of the patrone to the outside by rotating a spool shaft in a film feeding out direction. These are disclosed in U.S. Pat. Nos. 4,834,306 and 5,226,613. The photographic film for use in the present invention may be a generally so termed raw stock having not yet been developed or a developed photographic film. The raw stock and the developed photographic film may be accommodated in the same new patrone or in different patrones.

A color photosensitive material of the present invention is also suitably used as a negative film for an advanced photo system (to be referred to as an APS hereinafter). Examples are NEXIA A, NEXIA F, and NEXIA H (ISO 200, 100, and 400, respectively) manufactured by Fuji Photo Film Co., Ltd. (to be referred to as Fuji Film hereinafter). These films are so processed as to have an APS format and set in an exclusive cartridge. These APS cartridge films are loaded into APS cameras such as the Fuji Film EPION Series represented by the EPION 300Z. A color photosensitive film of the present invention is also suited as a film with lens such as Fuji Film FUJICOLOR UTSURUNDESU SUPER SLIM.

A photographed film is printed through the following steps in a miniature laboratory system.

1) Reception (an exposed cartridge film is received from a customer)
2) Detaching step (the film is transferred from the cartridge to an intermediate cartridge for development)
3) Film development
4) Reattaching step (the developed negative film is returned to the original cartridge)

5) Printing (prints of three types C, H, and P and an index print are continuously automatically printed on color paper [preferably Fuji Film SUPER FA8])
6) Collation and shipment (the cartridge and the index print are collated by an ID number and shipped together with the prints).

As these systems, the Fuji Film MINILABO CHAMPION SUPER FA-298, FA-278, FA-258, FA-238 are preferable. Examples of a film processor are the FP922AL, FP562B, FP562BL, FP362B, and FP3622BL, and a recommended processing chemical is the FUJICOLOR JUST-IT CN-16L. Examples of a printer processor are the PP3008AR, PP3008A, PP1828AR, PP1828A, PP1258AR, PP1258A, PP728AR, and PP728A, and a recommended processing chemical is the FUJICOLOR JUST-IT CP-47L. A detacher used in the detaching step and a reattacher used in the reattaching step are preferably the Fuji Film DT200 or DT100 and AT200 or AT100, respectively.

The APS can also be enjoyed by PHOTO JOY SYSTEM whose main component is the Fuji Film Aladdin 1000 digital image scanner. For example, a developed APS cartridge film is directly loaded into the Aladdin 1000, or image information of a negative film, positive film, or print is input to the Aladdin 1000 by using the FE-550 35-mm film scanner or the PE-550 flat head scanner. Obtained digital image data can be easily processed and edited. This data can be printed out by the NC-550AL digital color printer using a photo-fixing heat-sensitive color printing system or the PICTOROGRAPHY 3000 using a laser exposure thermal development transfer system, or by existing laboratory equipment through a film recorder. The Aladdin 1000 can also output digital information directly to a floppy disk or Zip disk or to an CD-R via a CD writer.

In a home, a user can enjoy photographs on a TV set simply by loading a developed APS cartridge film into the Fuji Film Photo Player AP-1. Image information can also be continuously input to a personal computer by loading a developed APS cartridge film into the Fuji Film Photo Scanner AS-1. The Fuji Film Photo Vision FV-10 or FV-5 can be used to input a film, print, or three-dimensional object. Furthermore, image information recorded in a floppy disk, Zip disk, CD-R, or hard disk can be variously processed on a computer by using the Fuji Film Photo Factory application software. The Fuji Film NC-2 or NC-2D digital color printer using a photo-fixing heat-sensitive color printing system is suited to outputting high-quality prints from a personal computer.

To keep developed APS cartridge films, the FUJICOLOR POCKET ALBUM AP-5 POP L, AP-1 POP L, or AP-1 POP KG, or the CARTRIDGE FILE 16 is preferable.

Examples of the present invention will be described below. However, the present invention is not limited to the examples.

EXAMPLE 1

The support used in this example was prepared by the following method.

1) First Layer and Substratum:

Both surfaces of a 90 μm thick polyethylene naphthalate support were treated with glow discharge under such conditions that the treating ambient pressure was 2.66×10 Pa, the $H_2O$ partial pressure of ambient gas 75%, the discharge frequency 30 kHz, the output 2500 W, and the treating strength 0.5 kV·A·min/m$^2$. This support was coated, in a coating amount of 5 mL/m$^2$, with a coating liquid of the following composition to provide a 1st layer in accordance with the bar coating method described in JP-B-58-4589.

Conductive fine grain dispersion ($SnO_2/Sb_2O_5$ grain conc. 10% water dispersion, secondary agglomerate of 0.005 μm grain size primary grains which has an average grain size of 0.05 μm)

| | |
|---|---|
| Conductive fine grain dispersion ($SnO_2/Sb_2O_5$ grain conc. 10% water dispersion, secondary agglomerate of 0.005 μm grain size primary grains which has an average grain size of 0.05 μm | 50 parts by weight |
| Gelatin | 0.5 part by weight |
| Water | 49 parts by weight |
| Polyglycerol polyglycidyl ether | 0.16 part by weight |
| Polyoxyethylene sorbitan monolaurate (polymerization degree 20) | 0.1 part by weight |

The support furnished with the first coating layer was wound round a stainless steel core of 20 cm diameter and heated at 110° C. (Tg of PEN support: 119° C.) for 48 hr to thereby effect heat history annealing. The other side of the support opposite to the first layer was coated, in a coating amount of 10 mL/m$^2$, with a coating liquid of the following composition to provide a substratum for emulsion in accordance with the bar coating method.

| | |
|---|---|
| Gelatin | 1.01 parts by weight |
| Salicylic acid | 0.30 part by weight |
| Resorcin | 0.40 part by weight |
| Polyoxyethylene nonylphenyl ether (polymerization degree 10) | 0.11 part by weight |
| Water | 3.53 |
| Methanol | 84.57 parts by weight |
| n-Propanol | 10.08 parts by weight |

Furthermore, the following second layer and third layer were superimposed in this sequence on the first layer by coating. Finally, multilayer coating of a color negative photosensitive material of the composition indicated below was performed on the opposite side. Thus, a transparent magnetic recording medium with silver halide emulsion layers was obtained.

2) Second Layer (Transparent Magnetic Recording Layer):
(i) Dispersion of Magnetic Substance:

1100 parts by weight of Co-coated γ-$Fe_2O_3$ magnetic substance (average major axis length: 0.25 μm, $S_{BET}$: 39 m$^2$/g, Hc: 6.56×10$^4$ A/m, σS: 77.1 Am$^2$/kg, and σr: 37.4 Am$^2$/kg), 220 parts by weight of water and 165 parts by weight of silane coupling agent [3-(poly(polymerization degree: 10)oxyethynyl)oxypropyltrimethoxysilane] were fed into an open kneader, and blended well for 3 hr. The resulting coarsely dispersed viscous liquid was dried at 70° C. round the clock to thereby remove water, and heated at 110° C. for 1 hr. Thus, surface treated magnetic grains were obtained.

Further, in accordance with the following formulation, a composition was prepared by blending by means of the open kneader once more for 4 hr:

| | |
|---|---|
| The above surface treated magnetic grains | 855 g |
| Diacetylcellulose | 25.3 g |

-continued

| | |
|---|---|
| Methyl ethyl ketone | 136.3 g |
| Cyclohexanone | 136.3 g |

Still further, in accordance with the following formulation, a composition was prepared by carrying out fine dispersion by means of a sand mill (1/4G sand mill) at 2000 rpm for 4 hr. Glass beads of 1 mm diameter were used as medium.

| | |
|---|---|
| The above blend liquid | 45 g |
| Diacetylcellulose | 23.7 g |
| Methyl ethyl ketone | 127.7 g |
| Cyclohexanone | 127.7 g |

Moreover, in accordance with the following formulation, a magnetic substance-containing intermediate liquid was prepared.

(ii) Preparation of Magnetic Substance-Containing Intermediate Liquid:

| | |
|---|---|
| The above fine dispersion of magnetic substance | 674 g |
| Diacetylcellulose solution (solid content 4.34%, solvent: methyl ethyl ketone/cyclohexanone = 1/1) | 24,280 g |
| Cyclohexanone | 46 g |

These were mixed together and agitated by means of a disperser to thereby obtain a "magnetic substance-containing intermediate liquid."

An α-alumina abrasive dispersion of the present invention was produced in accordance with the following formulation.

(a) Preparation of Sumicorundum AA-1.5 (Average Primary Grain Diameter: 1.5 μm, Specific Surface Area: 1.3 $m^2/g$) Grain Dispersion

| | |
|---|---|
| Sumicorundum AA-1.5 | 152 g |
| Silane coupling agent KBM903 (produced by Shin-Etsu Chemical Co., Ltd.) | 0.48 g |
| Diacetylcellulose solution (solid content 4.5%, solvent: methyl ethyl ketone/cyclohexanone = 1/1) | 227.52 g |

In accordance with the above formulation, fine dispersion was carried out by means of a ceramic-coated sand mill (1/4G sand mill) at 800 rpm for 4 hr. Zirconia beads of 1 mm diameter were used as medium.

(b) Colloidal Silica Grain Dispersion (Fine Grains)

Use was made of "MEK-ST" produced by Nissan Chemical Industries, Ltd.

This is a dispersion of colloidal silica having an average primary grain diameter of 0.015 μm in methyl ethyl ketone as a dispersion medium, wherein the solid content is 30%.

(iii) Preparation of a Coating Liquid for Second Layer:

| | |
|---|---|
| The above magnetic substance-containing intermediate liquid | 19,053 g |
| Diacetylcellulose solution (solid content 4.5%, solvent: methyl ethyl ketone/cyclohexanone = 1/1) | 264 g |
| Colloidal silica dispersion "MEK-ST" [dispersion b] (solid content 30%) | 128 g |
| AA-1.5 dispersion [dispersion a] | 12 g |
| Millionate MR-400 (produced by Nippon Polyurethane Industry Co., Ltd.) diluent (solid content 20%, dilution solvent: methyl ethyl ketone/cyclohexanone = 1/1) | 203 g |
| Methyl ethyl ketone | 170 g |
| Cyclohexanone | 170 g |

A coating liquid obtained by mixing and agitating these was applied in a coating amount of 29.3 $mL/m^2$ by use of a wire bar. Drying was performed at 110° C. The thickness of magnetic layer after drying was 1.0 μm.

3) Third Layer (Higher Fatty Acid Ester Slipping Agent Containing Layer)

(i) Preparation of Raw Dispersion of Slipping Agent

The following liquid A was heated at 100° C. to thereby effect dissolution, added to liquid B and dispersed by means of a high-pressure homogenizer, thereby obtaining a raw dispersion of slipping agent.

| | |
|---|---|
| **Liquid A:** | |
| Compound of the formula below $C_6H_{13}CH(OH)(CH_2)_{10}COOC_{50}H_{101}$ | 399 parts by weight |
| Compound of the formula below $n\text{-}C_{50}H_{101}O(CH_2CH_2O)_{16}H$ | 171 parts by weight |
| Cyclohexanone | 830 parts by weight |
| **Liquid B:** | |
| Cyclohexanone | 8600 parts by weight |

(ii) Preparation of Spherical Inorganic Grain Dispersion

Spherical inorganic grain dispersion [c1] was prepared in accordance with the following formulation.

| | |
|---|---|
| Isopropyl alcohol | 93.54 parts by weight |
| Silane coupling agent KBM903 (produced by Shin-Etsu Chemical Co., Ltd.) Compound 1-1: $(CH_3O)_3Si—(CH_2)_3—NH_2$ | 5.53 parts by weight |
| Compound 1 | 2.93 parts by weight |
| Compound 1 | 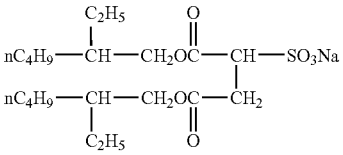 |
| Seahostar KEP50 (amorphous sperical silica, average grain size 0.5 μm, produced by Nippon Shokubai Co., Ltd.) | 88.00 parts by weight |

(amorphous spherical silica, average grain size 0.5 μm, produced by Nippon Shokubai Co., Ltd.)

This composition was agitated for 10 min, and further the following was added.

| | |
|---|---|
| Diacetone alcohol | 252.93 parts by weight |

The resulting liquid was dispersed by means of ultrasonic homogenizer "SONIFIER 450 (manufactured by BRANSON)" for 3 hr while cooling with ice and stirring, thereby finishing spherical inorganic grain dispersion c1.

(iii) Preparation of Spherical Organic Polymer Grain Dispersion

Spherical organic polymer grain dispersion [c2] was prepared in accordance with the following formulation.

| | |
|---|---|
| XC99-A48804 (spherical cross-linked polysiloxane grains, average grain size 0.9 μm (produced by Toshiba Silicone) | 60 parts by weight |
| Methyl ethyl ketone | 120 parts by weight |
| Cyclohexanone | 120 parts by weight |
| (solid content 20%, solvent: methyl ethyl ketone/cyclohexanone = 1/1) | |

This mixture was dispersed by means of ultrasonic homogenizer "SONIFIER 450 (manufactured by BRANSON)" for 2 hr while cooling with ice and stirring, thereby finishing spherical organic polymer grain dispersion c2.

(iv) Preparation of Coating Liquid for 3rd Layer

A coating liquid for 3rd layer was prepared by adding the following components to 542 g of the aforementioned raw dispersion of slipping agent:

| | |
|---|---|
| Diacetone alcohol | 5950 g |
| Cyclohexanone | 176 g |
| Ethyl acetate | 1700 g |
| Above Seahostar KEP50 dispersion [c1] | 53.1 g |
| Above spherical organic polymer grain dispersion [c2] | 300 g |
| FC431 (produced by 3M, solid content 50%, solvent: ethyl acetate) | 2.65 g |
| BYK310 (produced by BYK ChemiJapan, solid content 25%) | 5.3 g |

The above 3rd-layer coating liquid was applied to the 2nd layer in a coating amount of 10.35 mL/m$^2$, dried at 110° C. and further postdried at 97° C. for 3 min.

4) Application of Light-Sensitive Layer by Coating:

On the side opposite to the thus obtained back layers to the support was coated with a plurality of layers of the following respective compositions, thereby obtaining a color negative film sample 101.

(Composition of Light-Sensitive Layer)

The figures given beside the description of each component is for the coating amount expressed in the unit of g/m$^2$. With respect to the silver halide, the coating amount is in terms of silver quantity.

(Sample 101)

| | | |
|---|---|---|
| 1st Layer (1st antihalation layer) | | |
| Black colloidal silver | silver | 0.108 |
| Silver iodobromide emulsion grains (average grain diameter of 0.07 μm, silver iodide content 2 mol %) | silver | 0.011 |

-continued

| | | |
|---|---|---|
| Gelatin | | 0.900 |
| ExM-1 | | 0.040 |
| ExC-1 | | 0.002 |
| ExC-3 | | 0.002 |
| Cpd-2 | | 0.001 |
| F-8 | | 0.001 |
| HBS-1 | | 0.050 |
| HBS-2 | | 0.002 |
| 2nd Layer (2nd antihalation layer) | | |
| Black colloidal silver | silver | 0.058 |
| Gelatin | | 0.440 |
| ExF-1 | | 0.003 |
| F-8 | | 0.001 |
| Solid disperse dye ExF-7 | | 0.130 |
| HBS-1 | | 0.080 |
| 3rd Layer (Intermediate Layer) | | |
| ExC-2 | | 0.045 |
| Cpd-1 | | 0.092 |
| Poly(ethyl acrylate) latex | | 0.220 |
| HBS-1 | | 0.120 |
| Gelatin | | 0.740 |
| 4th Layer (Low-speed red-sensitive emulsion layer) | | |
| Em-C | silver | 0.520 |
| Em-D | silver | 0.340 |
| ExC-1 | | 0.188 |
| ExC-2 | | 0.012 |
| ExC-3 | | 0.077 |
| ExC-4 | | 0.123 |
| ExC-5 | | 0.012 |
| ExC-6 | | 0.008 |
| ExC-8 | | 0.053 |
| ExC-9 | | 0.020 |
| ExY-3 | | 0.009 |
| Cpd-2 | | 0.025 |
| Cpd-4 | | 0.023 |
| Cpd-7 | | 0.015 |
| UV-2 | | 0.050 |
| UV-3 | | 0.080 |
| UV-4 | | 0.020 |
| HBS-1 | | 0.250 |
| HBS-5 | | 0.038 |
| Gelatin | | 0.998 |
| 5th Layer (Middle-speed red-sensitive emulsion layer) | | |
| Em-B | silver | 0.928 |
| ExC-1 | | 0.140 |
| ExC-2 | | 0.080 |
| ExC-3 | | 0.028 |
| ExC-4 | | 0.110 |
| ExC-5 | | 0.018 |
| ExC-6 | | 0.012 |
| ExC-8 | | 0.019 |
| ExC-9 | | 0.004 |
| ExY-3 | | 0.007 |
| Cpd-2 | | 0.036 |
| Cpd-4 | | 0.028 |
| Cpd-7 | | 0.020 |
| HBS-1 | | 0.120 |
| Gelatin | | 0.890 |
| 6th Layer (High-speed red-sensitive red emulsion layer) | | |
| Em-A | silver | 1.300 |
| ExC-1 | | 0.240 |
| ExC-3 | | 0.030 |
| ExC-6 | | 0.022 |
| ExC-8 | | 0.110 |
| ExC-9 | | 0.024 |
| ExY-3 | | 0.014 |
| Cpd-2 | | 0.060 |
| Cpd-4 | | 0.079 |
| Cpd-7 | | 0.030 |
| HBS-1 | | 0.329 |
| HBS-2 | | 0.120 |
| Gelatin | | 1.350 |

-continued

| | | |
|---|---|---|
| **7th Layer (Intermediate layer)** | | |
| Cpd-1 | | 0.090 |
| Cpd-6 | | 0.372 |
| Solid disperse dye ExF-4 | | 0.032 |
| HBS-1 | | 0.052 |
| Poly(ethyl acrylate) latex | | 0.090 |
| Gelatin | | 0.900 |
| **8th Layer (Layer imparting an interlayer effect to a red-sensitive layer)** | | |
| Em-E | silver | 0.337 |
| Cpd-4 | | 0.030 |
| ExM-2 | | 0.140 |
| ExM-3 | | 0.016 |
| ExM-4 | | 0.010 |
| ExY-1 | | 0.017 |
| ExY-3 | | 0.005 |
| ExY-4 | | 0.041 |
| ExC-7 | | 0.020 |
| HBS-1 | | 0.222 |
| HBS-3 | | 0.003 |
| HBS-5 | | 0.030 |
| Gelatin | | 0.610 |
| **9th Layer (Low-speed green-sensitive emulsion layer)** | | |
| Em-I | silver | 0.343 |
| Em-J | silver | 0.325 |
| Em-H | silver | 0.064 |
| ExM-2 | | 0.245 |
| ExM-3 | | 0.050 |
| ExM-4 | | 0.120 |
| ExY-1 | | 0.010 |
| ExY-3 | | 0.006 |
| ExC-7 | | 0.008 |
| HBS-1 | | 0.090 |
| HBS-3 | | 0.008 |
| HBS-4 | | 0.070 |
| HBS-5 | | 0.530 |
| Cpd-5 | | 0.010 |
| Cpd-7 | | 0.020 |
| Gelatin | | 1.408 |
| **10th Layer (Middle-speed green-sensitive emulsion layer)** | | |
| Em-G | silver | 0.448 |
| ExM-2 | | 0.057 |
| EXM-3 | | 0.022 |
| ExM-4 | | 0.010 |
| ExY-3 | | 0.006 |
| ExC-6 | | 0.014 |
| ExC-7 | | 0.010 |
| ExC-8 | | 0.010 |
| HBS-1 | | 0.060 |
| HBS-3 | | 0.002 |
| HBS-4 | | 0.020 |
| HBS-5 | | 0.020 |
| Cpd-5 | | 0.004 |
| Cpd-7 | | 0.010 |
| Gelatin | | 0.430 |
| **11th Layer (High-speed green-sensitive layer)** | | |
| Em-F | silver | 0.860 |
| Em-H | silver | 0.130 |
| ExC-6 | | 0.003 |
| ExC-8 | | 0.014 |
| ExM-1 | | 0.017 |
| ExM-2 | | 0.025 |
| ExM-3 | | 0.030 |
| ExY-3 | | 0.008 |
| ExY-4 | | 0.005 |
| Cpd-3 | | 0.005 |
| Cpd-4 | | 0.007 |
| Cpd-5 | | 0.010 |
| Cpd-7 | | 0.020 |
| HBS-1 | | 0.149 |
| HBS-3 | | 0.003 |
| HBS-4 | | 0.020 |
| HBS-5 | | 0.037 |

-continued

| | | |
|---|---|---|
| Poly(ethyl acrylate) latex | | 0.090 |
| Gelatin | | 0.975 |
| **12th Layer (Yellow filter layer)** | | |
| Cpd-1 | | 0.090 |
| Solid disperse dye ExF-2 | | 0.074 |
| Solid disperse dye ExF-5 | | 0.008 |
| Oil-soluble dye ExF-6 | | 0.008 |
| HBS-1 | | 0.040 |
| Gelatin | | 0.615 |
| **13th Layer (Low-speed blue-sensitive emulsion layer)** | | |
| Em-O | silver | 0.114 |
| Em-M | silver | 0.312 |
| Em-N | silver | 0.204 |
| ExC-1 | | 0.022 |
| ExC-7 | | 0.013 |
| ExY-1 | | 0.003 |
| ExY-2 | | 0.350 |
| ExY-3 | | 0.007 |
| ExY-4 | | 0.050 |
| ExY-5 | | 0.410 |
| Cpd-2 | | 0.100 |
| Cpd-3 | | 0.004 |
| HBS-1 | | 0.220 |
| HBS-5 | | 0.070 |
| Gelatin | | 1.402 |
| **14th Layer (High-speed blue-sensitive emulsion layer)** | | |
| Em-K | silver | 0.790 |
| Em-L | silver | 0.120 |
| ExY-2 | | 0.082 |
| ExY-3 | | 0.008 |
| ExY-4 | | 0.070 |
| ExY-5 | | 0.098 |
| Cpd-2 | | 0.070 |
| Cpd-3 | | 0.001 |
| Cpd-7 | | 0.032 |
| HBS-1 | | 0.120 |
| Gelatin | | 0.686 |
| **15th Layer (1st Protective layer)** | | |
| Silver iodobromide emulsion grains (Average grain diameter 0.07 μm, silver iodide content = 2 mol %) | silver | 0.323 |
| UV-1 | | 0.210 |
| UV-2 | | 0.127 |
| UV-3 | | 0.190 |
| UV-4 | | 0.020 |
| UV-5 | | 0.204 |
| F-11 | | 0.009 |
| S-1 | | 0.086 |
| HBS-1 | | 0.170 |
| HBS-4 | | 0.052 |
| Gelatin | | 2.150 |
| **16th Layer (2nd Protective layer)** | | |
| H-1 | | 0.400 |
| B-1 (1.7 μm in diameter) | | 0.050 |
| B-2 (1.7 μm in diameter) | | 0.150 |
| B-3 | | 0.050 |
| S-1 | | 0.200 |
| Gelatin | | 0.700 |

In addition to the above components, W-1 to W-13, B-4 to B-6, F-1 to F-19, a lead salt, a platinum salt, an iridium salt and a rhodium salt were appropriately added to the individual layers in order to improve the storability, processability, resistance to pressure, mildewproofing and antiseptic properties, antistatic properties and coating property thereof.

Preparation of Dispersion of Organic Solid Disperse dye:

| The solid disperse dye ExF-2 of the 12th layer was dispersed by the following method. | |
|---|---|
| Wet cake of ExF-2 (containing 17.6% by weight of water) | 2.800 kg |
| Sodium octylphenyldiethoxymethanesulfonate (31% by weight aqueous solution) | 0.376 kg |
| F-15 (7% aqueous solution) | 0.011 kg |
| Water | 4.020 kg |
| Total | 7.210 kg |

(adjusted to pH = 7.2 with NaOH)

Slurry of the above composition was agitated by means of a dissolver, and further dispersed by means of agitator mill LMK-4 under such conditions that the peripheral speed, delivery rate and packing ratio of 0.3 mm-diameter zirconia beads were 10 m/s, 0.6 kg/min and 80%, respectively, until the absorbance ratio of the dispersion became 0.29. Thus, a solid particulate dispersion was obtained, wherein the average particle diameter of dye particulate was 0.29 μm.

Solid dispersions of ExF-4 and ExF-7 were obtained in the same manner. The average particle diameters of these dye particulates were 0.28 μm and 0.49 μm, respectively. ExF-5 was dispersed by the microprecipitation dispersion method described in Example 1 of EP Publication No. 549,489A. The average particle diameter thereof was 0.06 μm.

The sensitizing dyes used in the Examples of the present invention are shown below.

Sensitizing dye 1

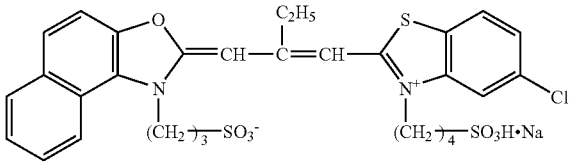

Sensitizing dye 2

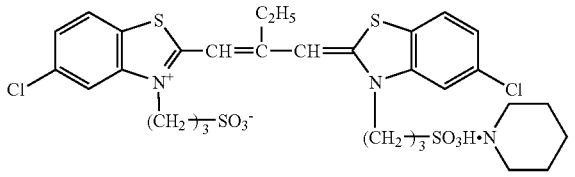

Sensitizing dye 3

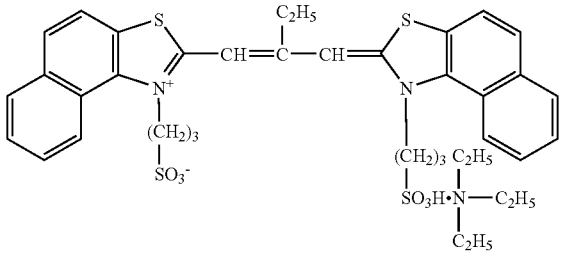

-continued

Sensitizing dye 4

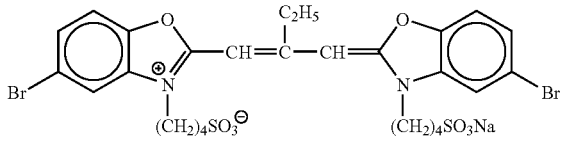

Sensitizing dye 5

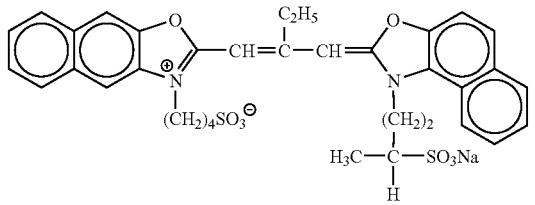

Sensitizing dye 6

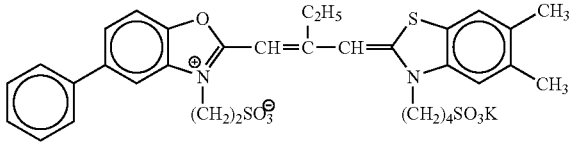

Sensitizing dye 7

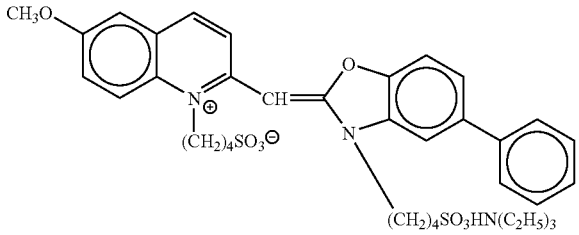

Sensitizing dye 8

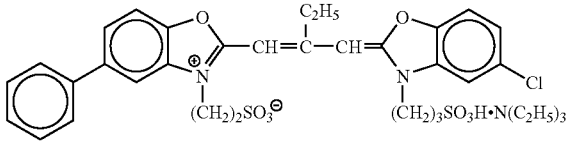

Sensitizing dye 9

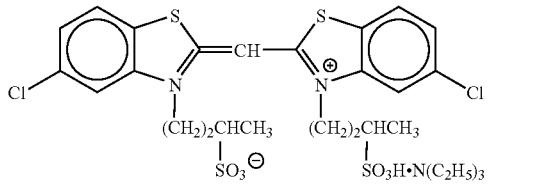

Sensitizing dye 10

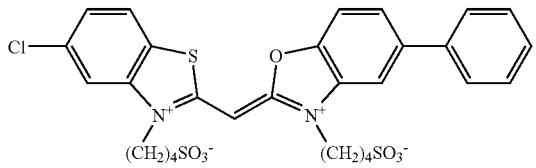

-continued
Sensitizing dye 11
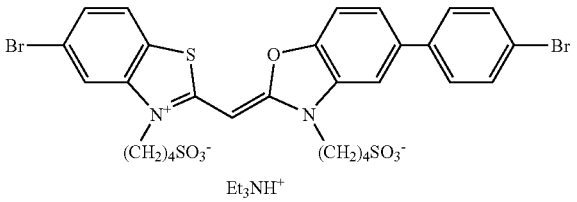
Sensitizing dye 12
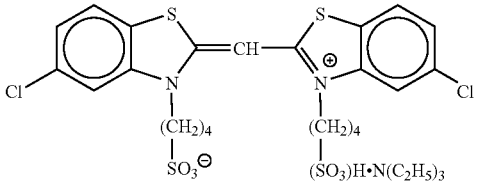
Sensitizing dye 13
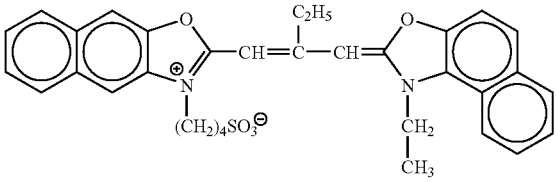
-continued
Sensitizing dye 14
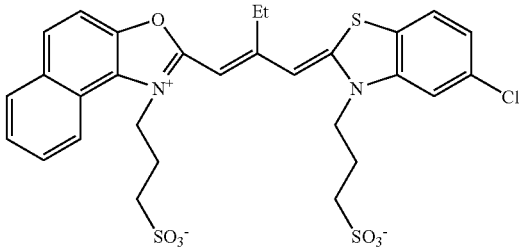
Sensitizing dye 15
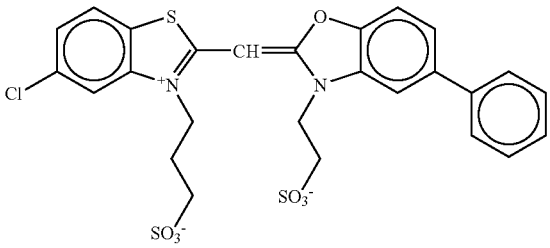
Sensitizing dye 16
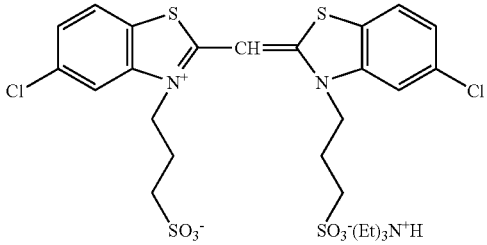
The other compounds used in the Examples are shown below.
ExC-1
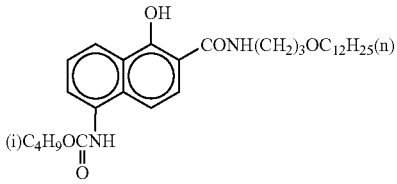
ExC-2
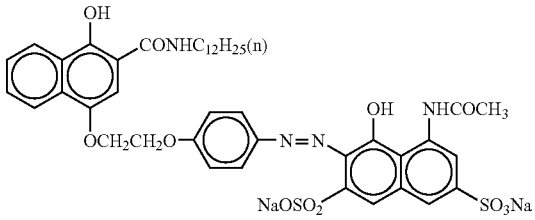
ExC-3
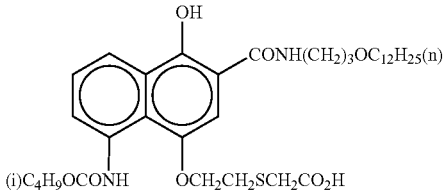
ExC-4
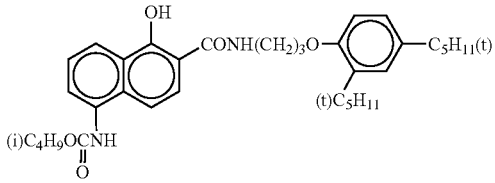

-continued
ExC-5
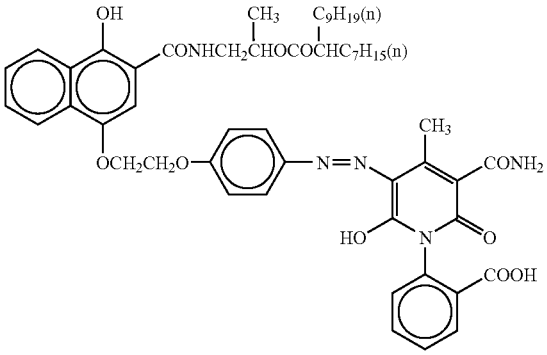
ExC-6
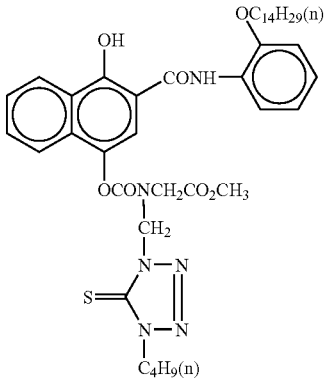
ExC-7
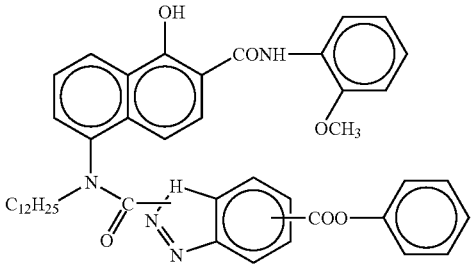
ExC-8
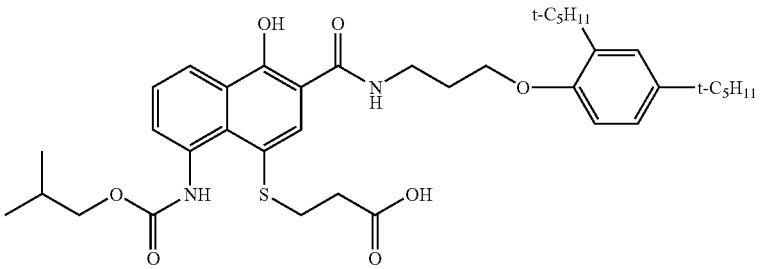
ExC-9
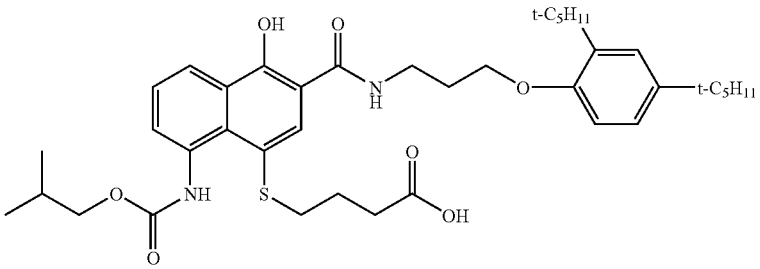

-continued
ExM-1
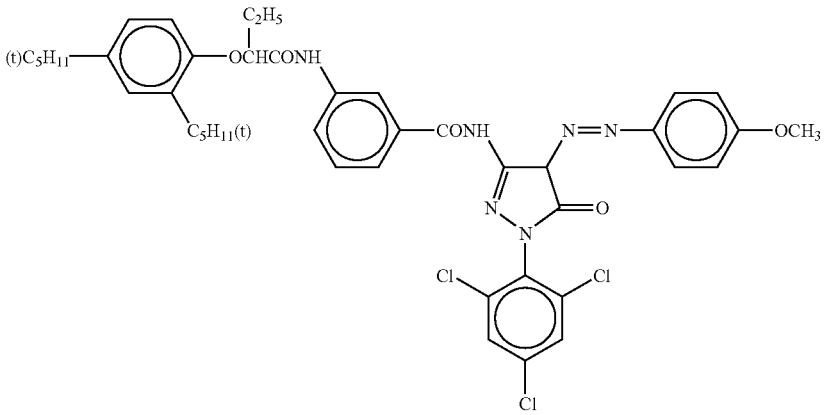
ExM-2
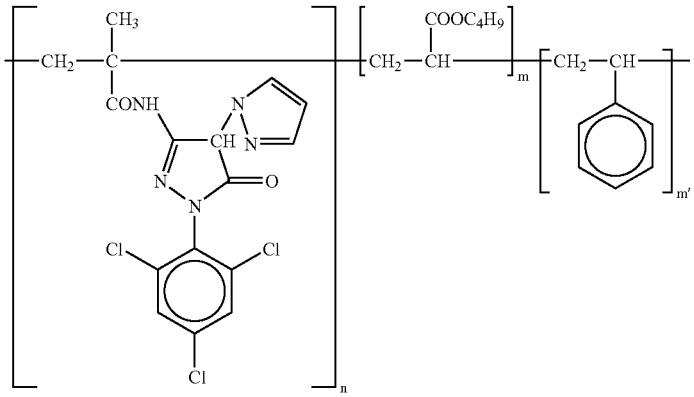
n = 50
m = 25
m′ = 25
Mol. Wt. About 20,000
ExM-3
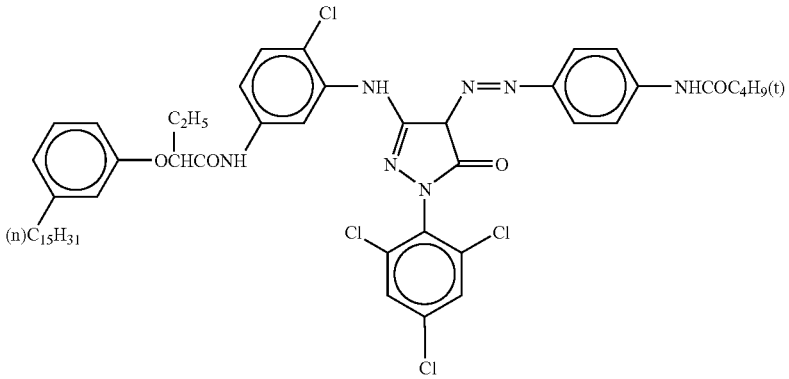
ExM-4
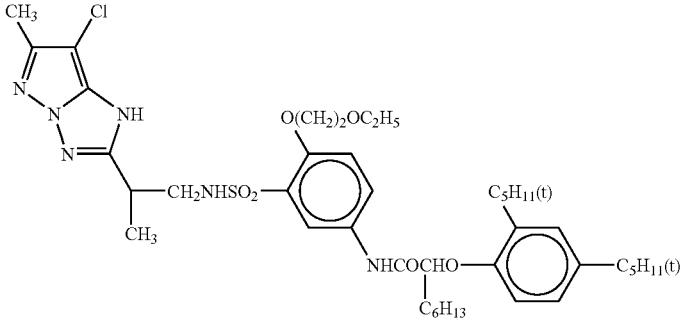

-continued
ExY-1
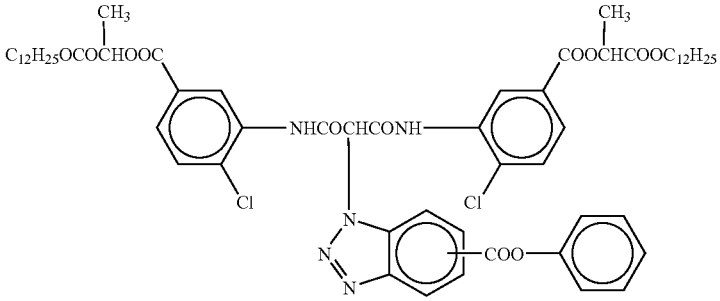
ExY-2
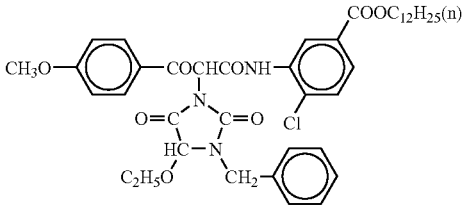
ExY-3
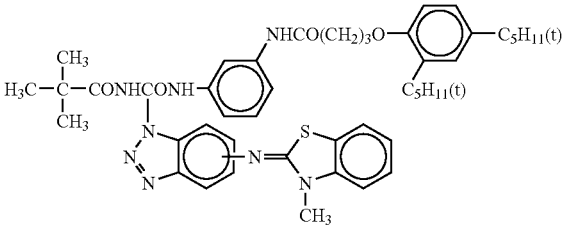
ExY-4
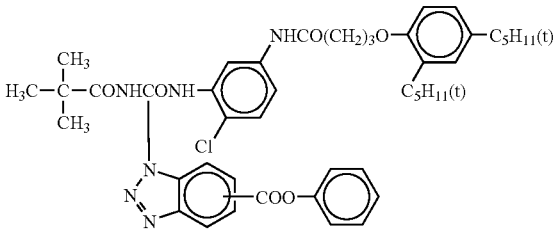
ExY-5
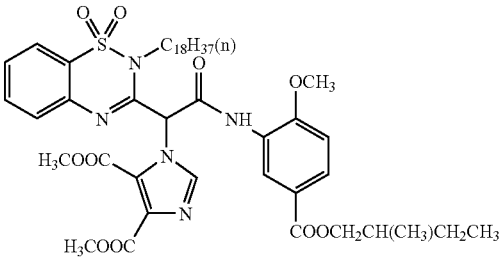
Cpd-1
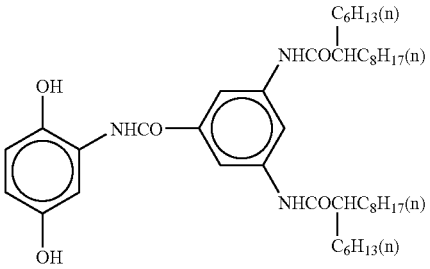
Cpd-2
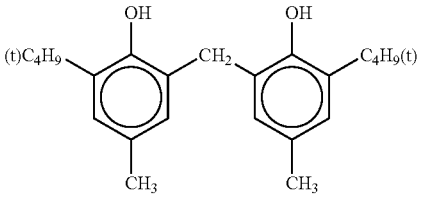
Cpd-3
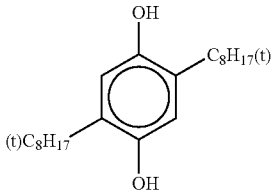
Cpd-4
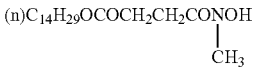
Cpd-5
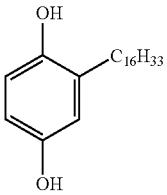
Cpd-6
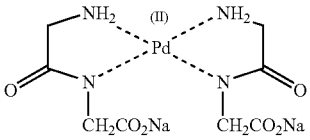

-continued
Cpd-7
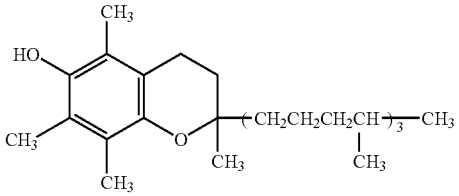
UV-1
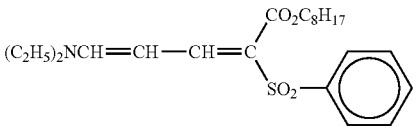
UV-2
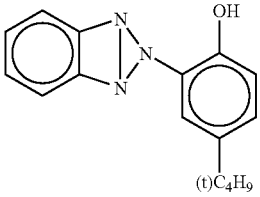
UV-3
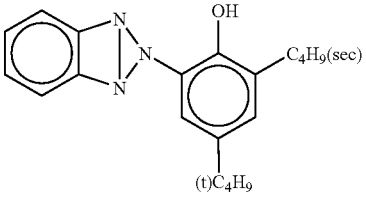
UV-4
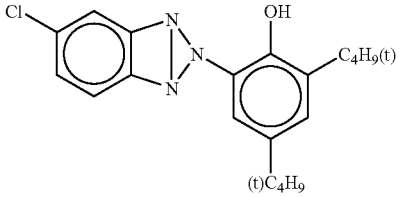
UV-5
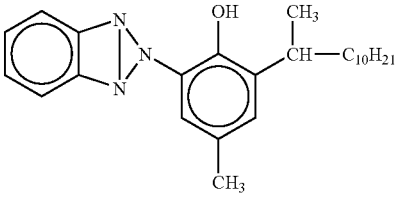
B-1
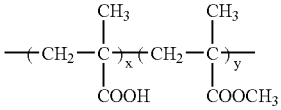
x/y = 10/90 (wt. ratio)
Av. Mol. Wt.:about 35,000
B-2
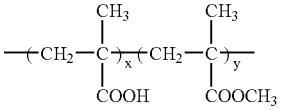
x/y = 40/60 (wt. ratio)
Av. Mol. Wt.:about 20,000
B-3
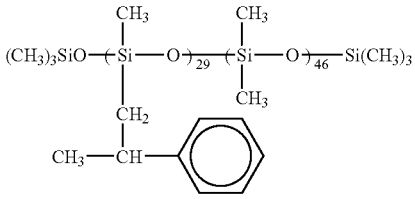
(Molar ratio)
Av. Mol. Wt.:about 20,000
B-4
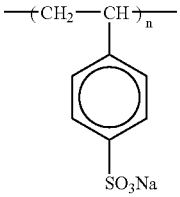
Av. Mol. Wt.:about 750,000
B-5
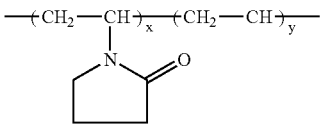
X/y = 70/80 (wt. Ratio)
Av. Mol. Wt.:about 17,000
B-6
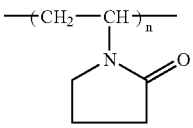
Av. Mol. Wt.:about 10,000
HBS-1
Tricresyl phosphate
HBS-2
Di-n-butyl phthalate
HBS-3
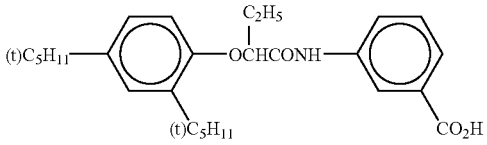
HBS-4
Tri(2-ethylhexyl) phosphate -continued
HBS-5
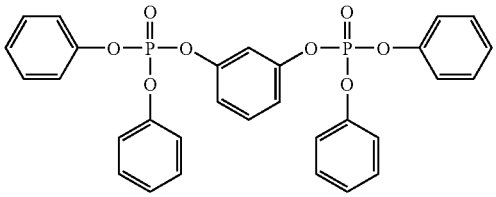
S-1
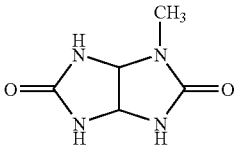
H-1
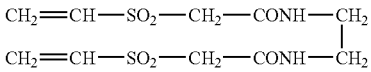
F-1
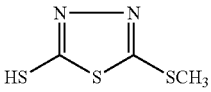
F-2
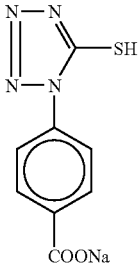
F-3
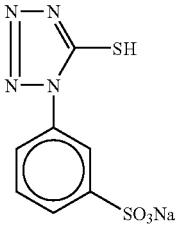
F-4
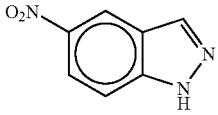
F-5
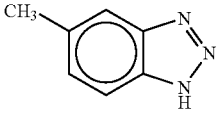
F-6
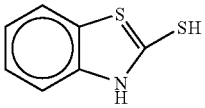
F-7
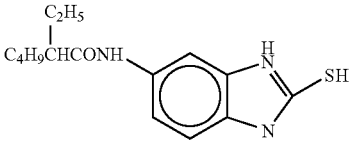
F-8
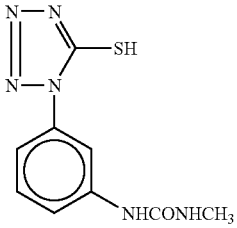
F-9
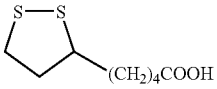
F-10
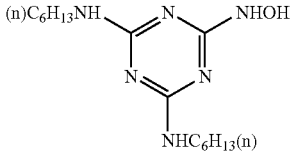
F-11
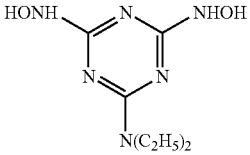
F-12
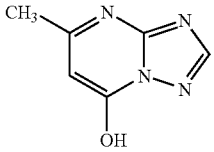
F-13
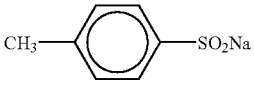
F-14
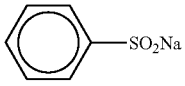
F-15
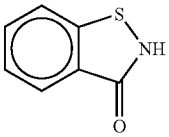

-continued
F-16
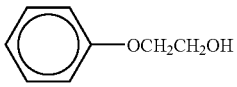
F-17
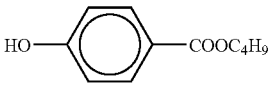
F-18
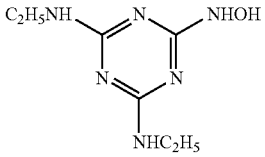
F-19
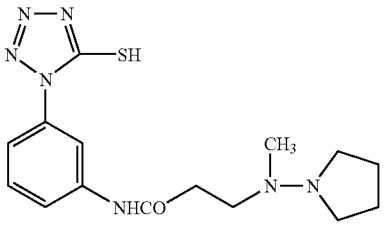
W-1
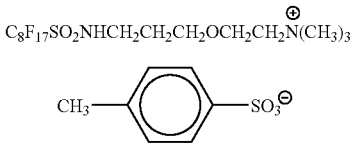
W-2
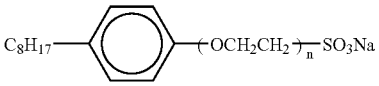
n = 2–4
W-3
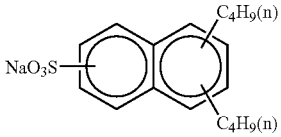
W-4
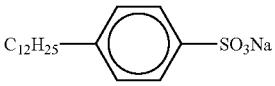
W-5
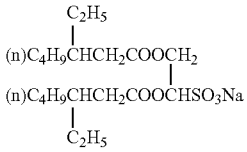
W-6
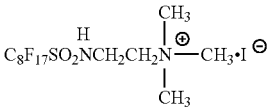
W-7
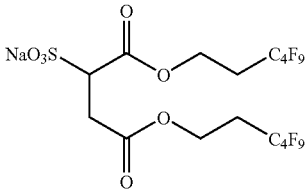
W-8
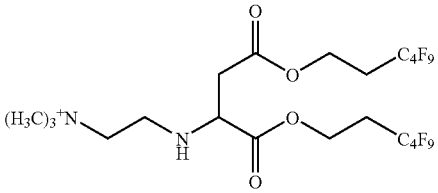
W-9
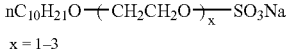
x = 1–3
W-10
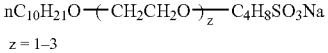
z = 1–3
W-11
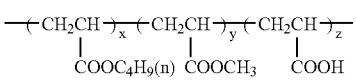
x/y/z = 20/60/20
Average mol. Wt.:about 36,000
W-12
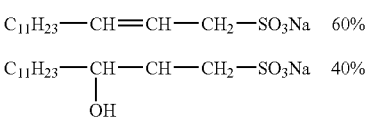
W-13
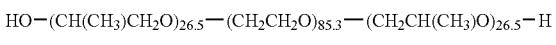
ExF-1
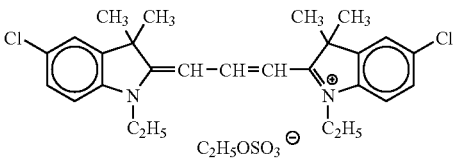

-continued
ExF-2
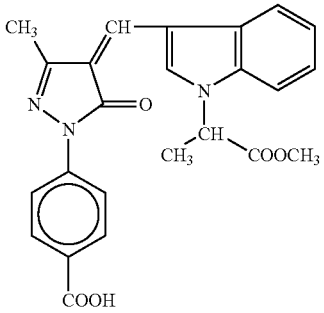
ExF-4
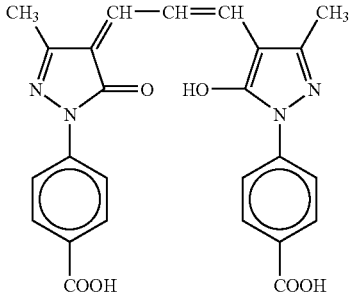
ExF-5
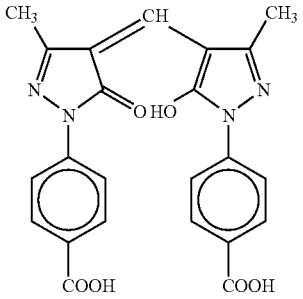
ExF-6
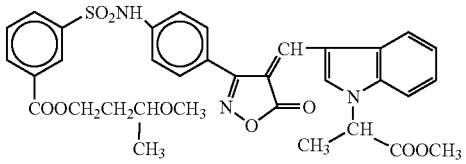
ExF-7
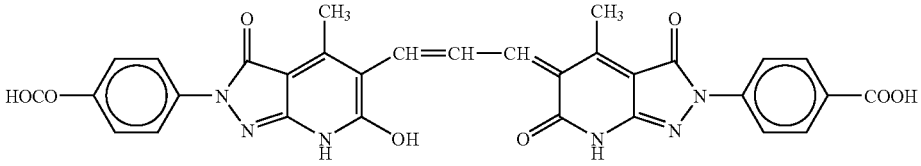
Comparative compound A
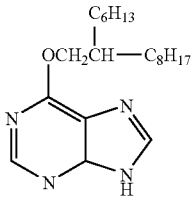
Comparative compound B
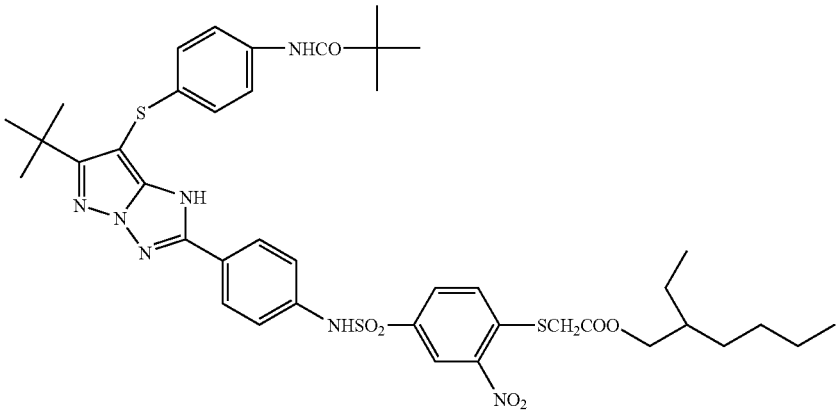

TABLE 1

Characteristics of silver halide grains contained in emulsions Em-A to Em-O

| | Layer used | Grain shape | Av. ESD (μm) | Av. ECD (μm)/ COV (%) | Av. Thickness (μm)/ COV (%) | Av. aspect ratio | Ratio to the total projected area occupied by tabular grains (%) | Thickness of core (μm) | Annual growth ring structure at core portion | Number of dislocation line per grain |
|---|---|---|---|---|---|---|---|---|---|---|
| Em-A | High speed red-sensitive layer | (111) main plane tabular grain | 0.95 | 2.20/32 | 0.12/14 | 18 | 97 | 0.09 | absent | 20 |
| Em-B | Medium speed red-sensitive layer | (111) main plane tabular grain | 0.69 | 1.30/35 | 0.10/15 | 13 | 98 | 0.07 | absent | 15 |
| Em-C | Low speed red-sensitive layer | (111) main plane tabular grain | 0.48 | 0.89/17 | 0.09/12 | 10 | 99 | — | — | 10 |
| Em-D | Low speed red-sensitive layer | (111) main plane cubic grain | 0.31 | 0.40/20 | 0.09/9.3 | 4.5 | 98 | — | — | 10 |
| Em-E | A layer inparting interlayer effect to red-sensitive layer | (111) main plane tabular grain | 0.78 | 1.38/24 | 0.15/13 | 9.2 | 97 | 0.12 | present | 20 |
| Em-F | High speed green-sensitive layer | (111) main plane tabular grain | 1.00 | 2.40/33 | 0.13/14 | 19 | 99 | 0.09 | absent | 20 |
| Em-G | Medium speed green-sensitive layer | (111) main plane tabular grain | 0.74 | 1.64/34 | 0.10/15 | 16 | 96 | 0.07 | absent | 15 |
| Em-H | Low and high speed green-sensitive layers | (111) main plane tabular grain | 0.74 | 1.39/25 | 0.14/11 | 9.9 | 98 | 0.12 | present | 20 |
| Em-I | Low speed green-sensitive layer | (111) main plane tabular grain | 0.55 | 0.79/30 | 0.14/13 | 5.5 | 97 | 0.11 | present | 30 |
| Em-J | Low speed green-sensitive layer | (111) main plane tabular grain | 0.44 | 0.53/30 | 0.17/18 | 3.2 | 97 | 0.13 | present | 20 |
| Em-K | High speed blue-sensitive layer | (111) main plane tabular grain | 1.60 | 3.00/25 | 0.31/21 | 10 | 99 | 0.16 | present | 15 |
| Em-L | HIgh speed blue-sensitive layer | (111) main plane tabular grain | 1.30 | 2.20/24 | 0.34/22 | 7 | 98 | 0.14 | present | 20 |
| Em-M | Low speed blue-sensitive layers | (111) main plane tabular grain | 0.81 | 1.10/30 | 0.23/18 | 4.7 | 97 | 0.13 | present | 20 |
| Em-N | Low speed blue-sensitive layer | (111) main plane tabular grain | 0.40 | 0.55/32 | 0.13/16 | 4.6 | 96 | 0.11 | present | 20 |
| Em-O | Low speed blue-sensitive layer | (100) main plane tabular grain | 0.21 | 0.21/20 | 0.21/20 | 1 | — | — | — | — |

COV = Coefficient of variation
Av. ECD = Average equivalent circle diameter
Av. ESD = Average equivalent sphere diameter

TABLE 2

Composition structure of silver holide grains contained in emulsions Em-A to Em-O

| | Layer used | Characteristics of grains ocuppying 70% or more of the total projected area | Grain structure and ratio of silver amount (%) and halide composition (described from the center) Halide composition of epitaxial junction portion is shown in < > |
|---|---|---|---|
| Em-A | High speed red-sensitive layer | (111) main plane tabular grain | (11%)AgBr/(35%)$AgBr_{97}I_3$/(18%)AgBr/(9%)$AgBr_{62}I_{38}$/(27%)AgBr |
| Em-B | Medium speed red-sensitive layer | (111) main plane tabular grain | (7%)AgBr/(31%)$AgBr_{97}I_3$/(16%)AgBr/(12%)$AgBr_{62}I_{38}$/(34%)AgBr |
| Em-C | Low speed red-sensitive layer | (111) main plane tabular grain | (1%)AgBr/(77%)$AgBr_{99}I_1$/(9%)$AgBr_{95}I_5$/(13%)<$AgBr_{63}Cl_{35}I_2$> |
| Em-D | Low speed red-sensitive layer | (111) main plane cubic grain | (57%)AgBr/(14%)$AgBr_{96}I_4$/(29%)<$AgBr_{57}Cl_{41}I_2$> |
| Em-E | A layer inparting interlayer effect to red-sensitive layer | (111) main plane tabular grain | (13%)AgBr/(36%)$AgBr_{97}I_3$/(7%)AgBr/(11%)$AgBr_{62}I_{38}$/(33%)AgBr |
| Em-F | High speed green-sensitive layer | (111) main plane tabular grain | (11%)AgBr/(35%)$AgBr_{97}I_3$/(18%)AgBr/(4%)AgI/(32%)AgBr |
| Em-G | Medium speed green-sensitive layer | (111) main plane tabular grain | (7%)AgBr/(31%)$AgBr_{97}I_3$/(15%)AgBr/(14%)$AgBr_{62}I_{38}$/(33%)AgBr |
| Em-H | Low and high speed green-sensitive layers | (111) main plane tabular grain | (14%)AgBr/(36%)$AgBr_{97}I_3$/(7%)AgBr/(11%)$AgBr_{62}I_{38}$/(32%)AgBr |
| Em-I | Low speed green-sensitive layer | (111) main plane tabular grain | (15%)AgBr/(44%)$AgBr_{97}I_3$/(11%)AgBr/(5%)AgI/(25%)AgBr |
| Em-J | Low speed green-sensitive layer | (111) main plane tabular grain | (60%)AgBr/(2%)AgI/(38%)AgBr |
| Em-K | High speed blue-sensitive layer | (111) main plane tabular grain | (68%)$AgBr_{93}I_7$/(21%)AgBr/(1%)AgI/(10%)AgBr |
| Em-L | High speed blue-sensitive layer | (111) main plane tabular grain | (8%)AgBr/(10%)$AgBr_{95}I_5$/(52%)$AgBr_{93}I_7$/(11%)AgBr/(2%)AgI/(17%)AgBr |
| Em-M | Low speed blue-sensitive layers | (111) main plane tabular grain | (12%)AgBr/(43%)$AgBr_{90}I_{10}$/(14%)AgBr/(2%)AgI/(29%)AgBr |
| Em-N | Low speed blue-sensitive layer | (111) main plane tabular grain | (58%)AgBr/(4%)AgI/(38%)AgBr |
| Em-O | Low speed blue-sensitive layer | (100) main plane tabular grain | (6%)AgBr/(94%)$AgBr_{96}I_4$ |

TABLE 3

Characteristics of silver halide grains contained in emulsions Em-A to Em-O

| | Layer used | Av. AgI content (mol %)/ Inter grain COV (%) | AgI content at grain surface (mol %) | Av. AgCl content (mol %)/ Inter grain COV (%) | AgCl content at grain surface (mol %) | Twin plane distance (μm)/ COV (%) | (100) face ratio to side planes (%) | Ratio in number of grains meeting Requirement A among all the grains (%) |
|---|---|---|---|---|---|---|---|---|
| Em-A | High speed red-sensitive layer | 4.5/10 | 3.90 | 0 | 0 | 0.011/30 | 20 | 55 |
| Em-B | Medium speed red-sensitive layer | 5.5/11 | 5.00 | 0 | 0 | 0.010/30 | 30 | 75 |
| Em-C | Low speed red-sensitive layer | 1.5/10 | 3.70 | 4.7/8.0 | 16 | 0.010/31 | 25 | — |
| Em-D | Low speed red-sensitive layer | 1.1/11 | 5.00 | 12/9.0 | 23 | 0.009/29 | 25 | — |
| Em-E | A layer inparting interlayer effect to red-sensitive layer | 5.3/10 | 5.90 | 0 | 0 | 0.012/30 | 35 | 20 |
| Em-F | High speed green-sensitive layer | 5.1/10 | 3.90 | 0 | 0 | 0.012/30 | 20 | 60 |

TABLE 3-continued

Characteristics of silver halide grains contained in emulsions Em-A to Em-O

| | Layer used | Av. AgI content (mol %)/ Inter grain COV (%) | AgI content at grain surface (mol %) | Av. AgCl content (mol %)/ Inter grain COV (%) | AgCl content at grain surface (mol %) | Twin plane distance (μm)/ COV (%) | (100) face ratio to side planes (%) | Ratio in number of grains meeting Requirement A among all the grains (%) |
|---|---|---|---|---|---|---|---|---|
| Em-G | Medium speed green-sensitive layer | 6.3/13 | 5.60 | 0 | 0 | 0.010/30 | 30 | 65 |
| Em-H | Low and high speed green-sensitive layers | 5.3/14 | 5.97 | 0 | 0 | 0.011/30 | 30 | 25 |
| Em-I | Low speed green-sensitive layer | 6.3/12 | 7.39 | 0 | 0 | 0.016/32 | 20 | 15 |
| Em-J | Low speed green-sensitive layer | 2.0/14 | 5.68 | 0 | 0 | 0.016/32 | 35 | 18 |
| Em-K | High speed blue-sensitive layer | 5.8/7.0 | 3.88 | 0 | 0 | 0.010/29 | 40 | 25 |
| Em-L | High speed blue-sensitive layer | 6.1/8.0 | 5.50 | 0 | 0 | 0.017/33 | 20 | 20 |
| Em-M | Low speed blue-sensitive layers | 6.3/9.0 | 1.90 | 0 | 0 | 0.019/30 | 30 | 15 |
| Em-N | Low speed blue-sensitive layer | 4.0/10 | 5.50 | 0 | 0 | 0.020/31 | 30 | 20 |
| Em-O | Low speed blue-sensitive layer | 3.8/9.0 | 4.50 | 0 | 0 | — | — | — |

COV = Coefficient of variation

Requirement A: Comprising silver iodobromide or silver chloroiodobromide grains having (111) planes as main planes, and having equivalent circle diameter of 1.0 μm or more and thickness of 0.15 μm or less, and having a core portion of silver iodobromide withouth annular growth ring and thickness of 0.1 μm, and having 10 or more dislocation lines.

TABLE 4

Sensitizing dyes and dopants used in emulsions Em-A to Em-O

| Emulsion No. | Layer used | Sensitizing dyes | Dopant |
|---|---|---|---|
| Em-A | High speed red-sensitive layer | 2, 3, 14 | $K_2IrCl_6$, $K_4Fe(CN)_6$ |
| Em-B | Medium speed red-sensitive layer | 1, 2, 3 | $K_2IrCl_6$, $K_2IrCl_5(H_2O)$, $K_4Ru(CN)_6$ |
| Em-C | Low speed red-sensitive layer | 2, 3, 14 | $K_2IrCl_6$, $K_4Fe(CN)_6$ |
| Em-D | Low speed red-sensitive layer | 2, 3, 14 | $K_2IrCl_6$, $K_4Fe(CN)_6$ |
| Em-E | A layer inparting interlayer effect to red-sensitive layer | 7, 8 | $K_4Fe(CN)_6$ |
| Em-F | High speed green-sensitive layer | 5, 6, 8 | $K_4Ru(CN)_6$ |
| Em-G | Medium speed green-sensitive layer | 5, 6, 8 | $K_2IrCl_6$, $K_4Fe(CN)_6$ |

TABLE 4-continued

Sensitizing dyes and dopants used in emulsions Em-A to Em-O

| Emulsion No. | Layer used | Sensitizing dyes | Dopant |
|---|---|---|---|
| Em-H | Low and high speed green-sensitive layers | 4, 5, 6, 8, 13 | $K_2IrCl_6$, $K_4Fe(CN)_6$ |
| Em-I | Low speed green-sensitive layer | 4, 5, 6 | $K_2IrCl_6$ |
| Em-J | Low speed green-sensitive layer | 6, 8, 13 | $K_2IrCl_6$, $K_4Fe(CN)_6$ |
| Em-K | High speed blue-sensitive layer | 16 | — |
| Em-L | High speed blue-sensitive layer | 9 | — |
| Em-M | Low speed blue-sensitive layers | 16 | — |
| Em-N | Low speed blue-sensitive layer | 9, 15 | — |

TABLE 4-continued

Sensitizing dyes and dopants used in emulsions Em-A to Em-O

| Emulsion No. | Layer used | Sensitizing dyes | Dopant |
|---|---|---|---|
| Em-O | Low speed blue-sensitive layer | 12, 15 | $K_2IrCl_6$ |

The emulsions contained the optimum amount of spectral sensitizing dye listed in Table 4, and were subjected to gold sensitization, sulfur sensitization and selenium sensitization optimally.

The above-mentioned silver halide color photosensitive material is named Sample 101.

(Preparation of Samples 102 to 120)

Samples 102 to 120 were prepared in the same manner as Sample 101, except that compound (A) of the present invention was added to the 4th, 5th, 6th, 8th, 9th, 10th, 11th, 13th and 14th layers of Sample 101, as shown in Table 5.

Samples 101 to 120 were exposed for 1/100 second through a gelatin filter SC-39 manufactured by Fuji Photo Film Co., Ltd. and a continuous wedge.

Each of the exposed samples was processed by the following method.

(Processing Steps)

| Step | Time | Temp. |
|---|---|---|
| Color development | 3 min 15 sec | 38° C. |
| Bleaching | 3 min 00 sec | 38° C. |
| Washing | 30 sec | 24° C. |
| Fixing | 3 min 00 sec | 38° C. |
| Washing (1) | 30 sec | 24° C. |
| Washing (2) | 30 sec | 24° C. |
| Stabilization | 30 sec | 38° C. |
| Drying | 4 min 20 sec | 55° C. |

The composition of each processing solution was as follows.

| | (unit: g) |
|---|---|
| (Color developer) | |
| Diethylenetriaminepentaacetic acid | 1.0 |
| 1-Hydroxyethylidene-1,1-diphosphonic acid | 2.0 |
| Sodium sulfite | 4.0 |
| Potassium carbonate | 30.0 |
| Potassium bromide | 1.4 |
| Potassium iodide | 1.5 mg |
| Hydroxylamine sulfate | 2.4 |
| 4-[N-ethyl-N-(β-hydroxyethyl)amino]-2-methylaniline sulfate | 4.5 |
| Water to make | 1.0 L |
| pH (adjusted by potassium hydroxide and sulfuric acid) | 10.05 |
| (Bleach-fix soln.) | |
| Fe(III) sodium ethylenediaminetetraacetate trihydrate | 100.0 |
| Disodium ethylenediaminetetraacetate | 10.0 |
| 3-Mercapto-1,2,4-triazole | 0.03 |
| Ammonium bromide | 140.0 |
| Ammonium nitrate | 30.0 |
| Aq. ammonia (27%) | 6.5 ml |
| Water to make | 1.0 L |
| pH (adjusted by aqueous ammonia and nitric acid) | 6.0 |

-continued

| | (unit: g) |
|---|---|
| (Fixing solution) | |
| Disodium ethylenediaminetetraacetate | 0.5 |
| Sodium sulfite | 20.0 |
| Aq. soln. of ammonium thiosulphate (700 g/L) | 295.0 ml |
| Acetic acid (90%) | 3.3 |
| Water to make | 1.0 L |
| pH (adjusted by aqueous ammonia and nitric acid) | 6.7 |
| (Stabilizer solution) | |
| p-Nonylphenoxypolyglycidol (glycidol av. polymerization degree: 10) | 0.2 |
| Ethylenediaminetetraacetic acid | 0.05 |
| 1,2,4-Triazole | 1.3 |
| 1,4-Bis(1,2,4-triazol-1-ylmethyl)piperazine | 0.75 |
| Hydroxyacetic acid | 0.02 |
| Hydroxyethylcellulose (HEC SP-2000 produced by Daicel Chemical Industries, Ltd.) | 0.1 |
| 1,2-Benzisothiazolin-3-one | 0.05 |
| Water to make | 1.0 L |
| pH | 8.5 |

The speeds of the red-sensitive layer, green-sensitive layer and blue-sensitive layer were indicated with the logarithmic value of the reciprocal of the exposure amount necessary to give the cyan, magenta, and yellow color image densities of the minimum density plus 0.8, respectively, and represented by the differences with respect to those of Sample 101.

With respect to the graininess, the RMS granularity of the cyan, magenta, and yellow color images at the fog density plus 0.8 was determined and evaluated. The graininess was indicated with the relative value where the graininess of Sample 101 is assumed as 100.

In order to evaluate the substantial speed increase, if the RMS granularity varied with the increase of speed, the amounts of ExY-3 in the 4th, 5th, 6th, 8th, 9th, 10th, 11th, 13th and 14th layers were adjusted, thereby matching the RMS granularity with that of Sample 101. The speed was then compared.

Regarding the storability, measured was the fog density after leaving a raw sample for 14 days under forced degradation conditions: a temperature of 50° C. and a humidity of 60%. The storability was evaluated using the difference relative to the fog density measured when the sample was not left under the forced degradation conditions. The smaller this value, the less the fog increase with time and the more favorable it is.

For evaluating the image stability, a processed sample was left for 40 days under conditions: a temperature of 60° C. and a humidity of 70% and then was measured for the densities of a cyan, magenta and yellow color images. The image stability was indicated with the relative value where the value measured just after the processing at a density of the fog plus 0.8 is assumed as 100. The closer to 100 this value is, the smaller the change of image density with time is and the more favorable it is.

TABLE 5

| Sample No. | Compound of the invention (Addition amount per mol × $10^{-3}$ mol) | Speed | | | Graininess | | | Storability | | | Image | | |
|---|---|---|---|---|---|---|---|---|---|---|---|---|---|
| | | RS layer | GS layer | BS layer | RS layer | GS layer | BS layer | RS layer | GS layer | BS layer | RS layer | GS layer | BS layer |
| 101(Comp.) | — | 0.00 | 0.00 | 0.00 | 100 | 100 | 100 | +0.08 | +0.07 | +0.08 | 105 | 115 | 88 |
| 102(Comp.) | Compound A (10) | +0.02 | +0.02 | +0.02 | 101 | 100 | 100 | +0.12 | +0.10 | +0.11 | 106 | 114 | 89 |
| 103(Comp.) | Compound B (10) | +0.03 | +0.03 | +0.03 | 100 | 101 | 101 | +0.11 | +0.12 | +0.12 | 106 | 115 | 87 |
| 104(Inv.) | Compound(1) (10) | +0.06 | +0.06 | +0.06 | 100 | 101 | 102 | +0.08 | +0.07 | +0.08 | 103 | 107 | 94 |
| 105(Inv.) | Compound(9) (10) | +0.06 | +0.05 | +0.06 | 101 | 101 | 100 | +0.09 | +0.08 | +0.08 | 102 | 106 | 95 |
| 106(Inv.) | Compound(11) (10) | +0.05 | +0.05 | +0.06 | 101 | 101 | 101 | +0.08 | +0.06 | +0.08 | 103 | 105 | 95 |
| 107(Inv.) | Compound(13) (10) | +0.05 | +0.05 | +0.05 | 101 | 101 | 100 | +0.08 | +0.07 | +0.07 | 103 | 105 | 95 |
| 108(Inv.) | Compound(16) (10) | +0.07 | +0.06 | +0.07 | 101 | 100 | 99 | +0.07 | +0.07 | +0.08 | 103 | 106 | 96 |
| 109(Inv.) | Compound(17) (10) | +0.07 | +0.07 | +0.07 | 101 | 101 | 101 | +0.08 | +0.07 | +0.08 | 103 | 107 | 95 |
| 110(Inv.) | Compound(18) (10) | +0.09 | +0.09 | +0.08 | 101 | 100 | 101 | +0.08 | +0.06 | +0.08 | 103 | 106 | 94 |
| 111(Inv.) | Compound(19) (10) | +0.10 | +0.11 | +0.10 | 102 | 99 | 101 | +0.08 | +0.07 | +0.07 | 104 | 106 | 95 |
| 112(Inv.) | Compound(20) (10) | +0.10 | +0.10 | +0.11 | 102 | 98 | 102 | +0.07 | +0.06 | +0.07 | 103 | 106 | 96 |
| 113(Inv.) | Compound(21) (10) | +0.11 | +0.11 | +0.12 | 101 | 101 | 100 | +0.08 | +0.07 | +0.08 | 104 | 105 | 94 |
| 114(Inv.) | Compound(18) (10), Comparative compound B (10) | +0.12 | +0.12 | +0.12 | 100 | 100 | 100 | +0.07 | +0.07 | +0.08 | 103 | 105 | 95 |
| 115(Inv.) | Compound(19) (10), Comparative compound B (10) | +0.13 | +0.13 | +0.12 | 98 | 101 | 101 | +0.08 | +0.07 | +0.07 | 102 | 105 | 96 |
| 116(Inv.) | Compound(20) (10), Comparative compound B (10) | +0.13 | +0.13 | +0.14 | 99 | 98 | 100 | +0.07 | +0.06 | +0.08 | 103 | 106 | 94 |
| 117(Inv.) | Compound(21) (10), Comparative compound B (10) | +0.14 | +0.14 | +0.15 | 100 | 101 | 99 | +0.08 | +0.07 | +0.07 | 103 | 105 | 95 |
| 118(Inv.) | A1-18 (10) Comparative compound B (10) | +0.18 | +0.20 | +0.18 | 100 | 99 | 100 | +0.07 | +0.06 | +0.06 | 103 | 104 | 96 |
| 119(Inv.) | A2-7 (10) Comparative compound B (10) | +0.19 | +0.17 | +0.17 | 99 | 100 | 100 | +0.07 | +0.07 | +0.07 | 103 | 105 | 96 |
| 120(Inv.) | E-3 (10) Comparative compound B (10) | +0.16 | +0.15 | +0.16 | 100 | 100 | 99 | +0.07 | +0.07 | +0.07 | 103 | 105 | 95 |

RS layer = Red-sensitive layer;
GS layer = Green-sensitive layer;
BS layer = Blue-sensitive layer As described above, it is apparent that the method of the present invention is excellent in obtaining a high quality image without deteriorating the graininess and that it is excellent also in storability and image stability.

EXAMPLE 2

Sample 101 used in Example 1 was exposed to light, processed and measured in the same methods as those described in Example 1. It should be noted that the processing was conducted by changing only the color developing solution disclosed in Example 1 as shown in Table 6.

TABLE 6

| Experiment No. | Color developing solution | Speed | | | Graininess | | |
|---|---|---|---|---|---|---|---|
| | | Red-sensitive layer | Green-sensitive layer | Blue-sensitive layer | Red-sensitive layer | Green-sensitive layer | Blue-sensitive layer |
| 201(Comp.) | Color developing solution of Example 1 | 0.00 | 0.00 | 0.00 | 100 | 100 | 100 |
| 202(Inv.) | Compound (1) was added to sample 201 in an amount of 5 × $10^{-2}$ mol/L | +0.06 | +0.04 | +0.05 | 101 | 101 | 101 |
| 203(Inv.) | Compound (2) was added to sample 201 in an amount of 5 × $10^{-2}$ mol/L | +0.04 | +0.03 | +0.04 | 100 | 101 | 102 |
| 204(Inv.) | Compound (10) was added to sample 201 in an amount of 5 × $10^{-2}$ mol/L | +0.05 | +0.03 | +0.04 | 101 | 102 | 102 |
| 205(Inv.) | Compound (14) was added to sample 201 in an amount of 5 × $10^{2}$ mol/L | +0.04 | +0.03 | +0.04 | 101 | 101 | 101 |

Table 6 clearly shows that the method of processing with a processing solution containing compound (A) of the present invention is favorable because it can increase the speed.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A method for forming color images comprising subjecting a silver halide color photosensitive material to a development processing in the presence of a compound (A) defined below, wherein the silver halide color photosensitive material having a blue-sensitive unit, a green-sensitive unit and a red-sensitive unit, each of which comprises at least one silver halide emulsion layer, and at least one non-light-sensitive layer on a support, compound (A): a heterocyclic compound having a hetero ring containing only one or two hetero atoms in its whole ring system, the heterocyclic compound being capable of increasing speed of the silver halide color photosensitive material by the presence thereof in comparison to the case where the heterocyclic compound is absent.

2. The method for forming color images according to claim 1, wherein the compound (A) is contained in a developing solution.

3. The method for forming color images according to claim 1, wherein the compound (A) is represented by general formula (I):

General formula (I)

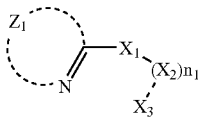

wherein $Z_1$ represents a group forming a hetero ring having one or two hetero atoms including the nitrogen atom in the formula, $X_1$ represents a sulfur atom, an oxygen atom, a nitrogen atom (N(Va)), or a carbon atom (C(Vb)(Vc)), wherein Va, Vb and Vc each represent a hydrogen atom or a substituent, $X_2$ has the same meaning as $X_1$, $n_1$ is 0, 1, 2 or 3, provided that when $n_1$ is 2 or larger a plurality of $X_2$'s may be the same or different, $X_3$ represents a sulfur atom, an oxygen atom or a nitrogen atom, provided that the bond between $X_2$ and $X_3$ is a single bond or a double bond, and that $X_3$ may further have a substituent or have a charge according to the type of the bond.

4. The method for forming color images according to claim 1, wherein the compound (A) is represented by general formula (11):

General formula (11)

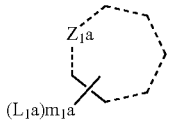

wherein $Z_1a$ represents a group to form a hetero ring containing one or two hetero atoms, $L_1a$ represents a substituent, $m_1a$ represents an integer of not less than 1 but not more than a maximum substitutable number to the hetero ring, provided that when $m_1a$ is 2 or more, a plurality of $L_1a$'s may be the same or different and the plurality of $L_1a$'s may bond together to form a ring, and that the compound represented by the formula (11) has at least one dissociative group.

5. The method for forming color images according to claim 1, wherein the compound (A) is represented by general formula (12):

General formula (12)

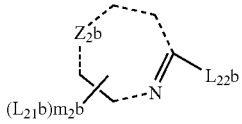

wherein $Z_2b$ represents a group to form a hetero ring containing one or two hetero atoms including the nitrogen atom in the formula, $L_{21}b$ and $L_{22}b$ each represent a hydrogen atom or a substituent, $m_2b$ represents an integer of not less than 0 but not more than a maximum substitutable number to the hetero ring, provided that when $m_2b$ is 2 or more, a plurality of $L_{21}b$'s may be the same or different and they may bond together to form a ring, and that the compound represented by the formula (12) has at least one dissociative group at $L_{21}b$ or $L_{22}b$.

6. The method for forming color images according to claim 1, wherein the compound (A) is represented by general formula (13):

General formula (13)

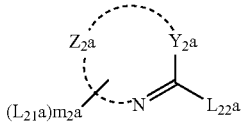

wherein $Z_2a$ represents a group to form a hetero ring containing one or two hetero atoms including the nitrogen atom and $Y_2a$ in the formula, $Y_2a$ represents a carbon atom, nitrogen atom or sulfur atom, $L_{21}a$ and $L_{22}a$ each represent a hydrogen atom or a substituent, $m_2a$ represents an integer of not less than 0 but not more than a maximum substitutable number to the hetero ring, provided that when $m_2a$ is 2 or more, a plurality of $L_{21}a$'s may be the same or different and they may bond together to form a ring, and that at least one of $L_{21}a$ and $L_{22}a$ has a dissociative group.

7. The method for forming color images according to claim 1, wherein the compound (A) is represented by general formula (21):

General formula (21)

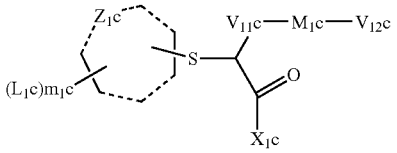

wherein $Z_1c$ represents a group to form a hetero ring containing one or two hetero atoms, $L_1c$ represents a hydrogen atom or substituent, $m_1c$ represent an integer of not less than 0 but not more than a maximum substitutable number to the hetero ring, provided that when $m_1c$ is 2 or more, a plurality of $L_1c$'s may be the same or different, and that they may bond together to form a ring, $X_1c$ represents S-$Va_1$, O-$Vb_1$ or N($Vc_1$)($Vd_1$), wherein $Va_1$, $Vb_1$, $Vc_1$, and $Vd_1$ each represent a hydrogen atom or substituent, provided that when $Va_1$, $Vb_1$, $Vc_1$, or $Vd_1$ represents a hydrogen atom, this hydrogen atom may dissociate to make $X_1c$ charge negatively, $V_{11}c$ represents a linking group, $V_{12}C$ represents a substituent, and $M_1c$ represents a sulfur atom or oxygen atom.

8. A silver halide color photosensitive material having a blue-sensitive unit, a green-sensitive unit and a red-sensitive unit, each of which comprises at least one silver halide emulsion layer, and at least one non-light-sensitive layer on a support, wherein at least one layer in the silver halide color photosensitive material contains a compound (A) defined below, compound (A): a heterocyclic compound having a hetero ring containing only one or two hetero atoms in its whole ring system, the heterocyclic compound being capable of increasing speed of the silver halide color photosensitive material by the presence thereof in the silver halide color photosensitive material in comparison to the case where the heterocyclic compound is absent.

* * * * *